US009261322B1

(12) United States Patent
Conkel

(10) Patent No.: US 9,261,322 B1
(45) **Date of Patent: *Feb. 16, 2016**

(54) RIFLE BOW ASSEMBLY AND RIFLE BOW INCLUDING THE SAME

(71) Applicant: Howard Emery Conkel, Galloway, OH (US)

(72) Inventor: Howard Emery Conkel, Galloway, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/672,873

(22) Filed: Mar. 30, 2015

Related U.S. Application Data

(63) Continuation-in-part of application No. 14/257,792, filed on Apr. 21, 2014, now Pat. No. 8,991,374.

(60) Provisional application No. 61/814,712, filed on Apr. 22, 2013.

(51) Int. Cl.

| | |
|---|---|
| ***F41B 5/00*** | (2006.01) |
| ***F41B 5/12*** | (2006.01) |
| ***F41B 5/18*** | (2006.01) |
| ***F41B 5/22*** | (2006.01) |
| ***F41B 5/14*** | (2006.01) |
| ***F41B 7/00*** | (2006.01) |

(52) U.S. Cl.
CPC . *F41B 5/126* (2013.01); *F41B 5/14* (2013.01); *F41B 5/143* (2013.01); *F41B 7/003* (2013.01); *F41B 7/006* (2013.01)

(58) Field of Classification Search
CPC ..... F41B 5/14; F41B 5/143; F41B 5/126; F41B 7/006
USPC ..... 124/23.1, 24.1, 25.5, 44.5, 82, 86, 88, 124/25, 41.1; 473/578
See application file for complete search history.

(56) References Cited

U.S. PATENT DOCUMENTS

| | | | | | |
|---|---|---|---|---|---|
| 2,069,821 | A | | 2/1937 | Douglas | |
| 2,125,591 | A | * | 8/1938 | Smith | F41B 5/1415 124/24.1 |
| 2,214,224 | A | | 9/1940 | Douglas | |
| 2,313,803 | A | | 3/1943 | Carlson | |
| 2,909,167 | A | * | 10/1959 | Fredrickson | F41B 5/14 124/24.1 |
| 3,572,311 | A | * | 3/1971 | Baer | F41B 3/02 124/20.1 |

(Continued)

OTHER PUBLICATIONS

Printout of Bowtech Airow Gun from archived webpage (http://www.airowgun.com), dated Sep. 22, 2008.

*Primary Examiner* — Alexander Niconovich
(74) *Attorney, Agent, or Firm* — The Law Office of Patrick F. O'Reilly, III, LLC

(57) ABSTRACT

A rifle bow assembly is disclosed herein. The rifle bow assembly includes: an outer barrel slide subassembly having an elongate cavity disposed therethrough, and being configured to affixedly attached to a bow assembly such that the outer barrel slide subassembly remains stationary relative to the bow assembly; a projectile barrel subassembly configured to be slidingly received within the elongate cavity of the outer barrel slide subassembly, and the projectile barrel subassembly having a rifled projectile passageway extending in a lengthwise direction thereof; a magazine subassembly coupled to a second end of the projectile barrel subassembly and having attachment means for securing a projectile magazine thereto; and a release subassembly coupled to an end portion of the magazine subassembly, and having at least one string release mechanism for releasably engaging a bow string of the bow assembly. A rifle bow, which incorporates the rifle bow assembly, is also disclosed herein.

20 Claims, 48 Drawing Sheets

(56) References Cited

U.S. PATENT DOCUMENTS

| | | | | | |
|---|---|---|---|---|---|
| 3,895,621 | A | | 7/1975 | Kellogg | |
| 3,968,783 | A | * | 7/1976 | Pfotenhauer | F41B 7/006 124/25 |
| 4,027,645 | A | * | 6/1977 | Damron | F41B 5/0005 124/24.1 |
| 4,146,009 | A | | 3/1979 | Adams | |
| 4,261,321 | A | | 4/1981 | Nishioka | |
| 4,291,664 | A | | 9/1981 | Nishioka | |
| 4,385,618 | A | | 5/1983 | Nishioka | |
| 4,446,844 | A | | 5/1984 | Nishioka | |
| 4,662,345 | A | | 5/1987 | Stephens | |
| 4,688,539 | A | | 8/1987 | Lawrence | |
| 4,693,229 | A | | 9/1987 | Nishioka | |
| 4,696,281 | A | | 9/1987 | Nishioka | |
| 4,708,341 | A | | 11/1987 | Paraskevakos | |
| 4,829,974 | A | * | 5/1989 | Anderson | F41B 5/143 124/24.1 |
| 4,958,617 | A | | 9/1990 | Anderson | |
| 5,066,021 | A | | 11/1991 | DeLucia | |
| 5,119,797 | A | * | 6/1992 | Anderson | F41B 5/143 124/24.1 |
| 5,224,464 | A | * | 7/1993 | Burnham | F41B 7/00 124/16 |
| 5,242,323 | A | * | 9/1993 | Rappaport | F41B 11/642 124/63 |
| 5,263,465 | A | * | 11/1993 | Anderson | F41B 5/1469 124/24.1 |
| 5,437,260 | A | | 8/1995 | King | |
| 5,458,341 | A | | 10/1995 | Forrest et al. | |
| 5,544,641 | A | * | 8/1996 | Jenn | F41B 5/12 124/25 |
| 5,649,519 | A | | 7/1997 | Linderman | |
| 5,649,521 | A | * | 7/1997 | King | F41B 5/12 124/25 |
| 5,678,528 | A | * | 10/1997 | Hadley | F41B 5/12 124/24.1 |
| 5,711,284 | A | | 1/1998 | Keenan, Jr. | |
| 5,931,146 | A | | 8/1999 | Schrader et al. | |
| 6,142,133 | A | | 11/2000 | Anderson | |
| 6,595,880 | B2 | * | 7/2003 | Becker | F42B 6/04 124/44.5 |
| 6,715,481 | B1 | * | 4/2004 | Anderson | F41B 5/10 124/23.1 |
| 6,752,136 | B1 | * | 6/2004 | Anderson | F41B 5/143 124/24.1 |
| 6,868,845 | B1 | * | 3/2005 | Moore | F41B 5/126 124/25 |
| 6,877,500 | B1 | * | 4/2005 | Hollars | F42B 10/26 124/24.1 |
| 6,997,770 | B2 | * | 2/2006 | Lapointe | F41B 11/00 124/66 |
| 7,017,568 | B1 | | 3/2006 | Smith | |
| 7,823,572 | B2 | | 11/2010 | Anderson | |
| 7,891,348 | B2 | | 2/2011 | Colley | |
| 7,918,219 | B2 | * | 4/2011 | Belokin | A01M 3/027 124/16 |
| 8,062,155 | B2 | | 11/2011 | Butcher | |
| 8,087,405 | B2 | * | 1/2012 | Mitchell | F41B 11/646 124/56 |
| 8,157,680 | B2 | | 4/2012 | Anderson | |
| 8,485,171 | B2 | * | 7/2013 | Romney | F41A 21/10 124/65 |
| 8,505,524 | B2 | * | 8/2013 | Lyon | F41B 5/14 124/23.1 |
| 2007/0044782 | A1 | * | 3/2007 | Norkus | F41B 5/0094 124/25.6 |
| 2008/0248904 | A1 | | 10/2008 | Cyr et al. | |
| 2009/0223500 | A1 | | 9/2009 | Stanziale | |
| 2010/0024791 | A1 | * | 2/2010 | Romney | F41A 21/10 124/65 |
| 2010/0170486 | A1 | * | 7/2010 | Shepley | F41A 11/02 124/25 |
| 2012/0125302 | A1 | | 5/2012 | Stanziale | |

* cited by examiner

SECTION B-B

SECTION D-D

SECTION B-B

SECTION C-C

RIFLE BOW ASSEMBLY AND RIFLE BOW INCLUDING THE SAME

CROSS-REFERENCE TO RELATED APPLICATIONS

This is a continuation-in-part of U.S. patent application Ser. No. 14/257,792, entitled "Rifle Bow Assembly and Rifle Bow Including The Same", filed on Apr. 21, 2014, and further claims the benefit of U.S. Provisional Patent Application No. 61/814,712, entitled "Rifle Bow Assembly and Rifle Bow Including The Same", filed on Apr. 22, 2013, the disclosure of each of which is hereby incorporated by reference as if set forth in their entirety herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a rifle bow assembly and a rifle bow including the same. More particularly, the invention relates to a rifle bow assembly and a rifle bow including the same that includes a projectile barrel subassembly having a helical projectile passageway extending in a lengthwise direction thereof.

2. Background and Description of Related Art

Throughout the world, there are millions of people that thoroughly enjoy the sport of bow hunting. However, the sport of bow hunting can be quite costly. For example, the cost of each arrow and broadhead, which are used during bow hunting, can range anywhere from $13.50 to $58.50 each. Typically, bow hunters are only able to get a single use out of each arrow. After being shot, many arrows are simply lost (e.g., arrows frequently become embedded into the ground). Even if the arrows are recovered by the hunter after being shot, they are often destroyed as a result of striking hard objects in the wilderness (e.g., tree limbs and rocks).

Conventional bow hunting equipment has other limitations as well. For example, with a typical bow and arrow, it is almost impossible to shoot a quick second shot, when necessary to pursue an elusive target, because the reloading of another arrow from the quiver simply takes too much time. Also, the reloading of another arrow from the quiver typically creates a substantial amount of noise. This noise often scares away the animal that is being pursued by the hunter. As a result, the animal often escapes from the area before the hunter is able to shoot another arrow from his or her bow.

Therefore, what is needed is a rifle bow assembly and a rifle bow including the same that is capable of significantly reducing the cost associated with bow hunting by utilizing projectiles that are much less expensive than conventional arrows and broadheads. Moreover, a rifle bow assembly is needed that is capable of accommodating a magazine of projectiles, thereby enabling a plurality of projectiles to be quickly shot from the bow assembly in succession. Furthermore, there is a need for a rifle bow assembly that can be easily incorporated into almost any conventional compound bow design as a retrofit assembly, or can be easily incorporated into a crossbow design.

BRIEF SUMMARY OF EMBODIMENTS OF THE INVENTION

Accordingly, the present invention is directed to a rifle bow assembly and a rifle bow including the same that substantially obviates one or more problems resulting from the limitations and deficiencies of the related art.

In accordance with one or more embodiments of the present invention, there is provided a rifle bow assembly that includes: an outer barrel slide subassembly having an elongate cavity disposed therethrough, the outer barrel slide subassembly configured to be affixedly attached to a bow assembly such that the outer barrel slide subassembly remains stationary relative to the bow assembly; a projectile barrel subassembly having a first end and a second end, the projectile barrel subassembly configured to be slidingly received within the elongate cavity of the outer barrel slide subassembly, and the projectile barrel subassembly having a rifled projectile passageway extending in a lengthwise direction thereof; a magazine subassembly coupled to the second end of the projectile barrel subassembly, the magazine subassembly having attachment means for securing a projectile magazine thereto; and a release subassembly coupled to an end portion of the magazine subassembly, the release subassembly including at least one string release mechanism for releasably engaging a bow string of the bow assembly.

In a further embodiment of the present invention, the projectile barrel subassembly comprises an elongate slot disposed along a length thereof, the elongate slot configured to receive the bow string therein, and the elongate slot of the projectile barrel subassembly only extending along a portion of the length of the projectile barrel subassembly.

In yet a further embodiment, the projectile barrel subassembly is formed by a pair of barrel half portions, each of the barrel half portions including approximately a half section of the rifled projectile passageway.

In still a further embodiment, at least one of the barrel half portions of the projectile barrel subassembly includes a plurality of alignment pins that are configured to matingly engage the at least one of the barrel half portions with the other of the barrel half portions.

In yet a further embodiment, the rifled projectile passageway of the projectile barrel subassembly comprises a plurality of circumferentially spaced-apart grooves in a bounding sidewall thereof, each of the plurality of circumferentially spaced-apart grooves configured to receive a respective protrusion of a projectile shell.

In still a further embodiment, the plurality of circumferentially spaced-apart grooves in the bounding sidewall of the rifled projectile passageway of the projectile barrel subassembly comprises three or more circumferentially spaced-apart grooves that are generally equally spaced-apart from one another.

In yet a further embodiment, the magazine subassembly and the release subassembly are mounted to a common body portion, the common body portion of the magazine subassembly and the release subassembly including opposed raised portions disposed on opposite sides thereof, each of the opposed raised portions of the common body portion comprising a central cavity disposed therein for receiving one or more components of the release subassembly.

In still a further embodiment, the release subassembly further comprises a pair of cover plates, each of the pair of cover plates configured to be coupled to a respective one of the opposed raised portions of the common body portion, and each of the pair of cover plates configured to enclose the one or more components of the release subassembly that are disposed within the central cavity of the opposed raised portion.

In yet a further embodiment, the common body portion of the magazine subassembly and the release subassembly further includes at least one elongate slot disposed along a length thereof, the at least one elongate slot of the common body portion configured to receive the bow string therein, and the at least one elongate slot of the common body portion generally aligned with a respective elongate slot of the projectile barrel subassembly.

In still a further embodiment, the common body portion of the magazine subassembly and the release subassembly further includes a fastener access notch or aperture disposed in a first side thereof, the common body portion additionally including an elongate groove disposed in a second side thereof for receiving a portion of a magazine latching subassembly, the second side of the common body portion being disposed opposite to the first side, and the fastener access notch or aperture in the first side enabling a tool to gain access to a fastener securing the magazine latching subassembly within the elongate groove on the second side.

In yet a further embodiment, the rifle bow assembly further comprises a handle subassembly coupled to an end portion of the common body portion of the magazine subassembly and the release subassembly.

In still a further embodiment, the handle subassembly includes a tubular member, a handle member affixedly coupled to the tubular member, and an end cap removably coupled to the tubular member, the tubular member having a first end and a second end, the first end of the tubular member being affixed to the end portion of the common body portion, and the second end of the tubular member being removably coupled with the end cap.

In yet a further embodiment, the tubular member further comprises a central passageway disposed therein for receiving a retractable chamber insert member that is configured to be slidingly received within a portion of the rifled projectile passageway of the projectile barrel subassembly.

In still a further embodiment, the release subassembly comprises a trigger mechanism configured to disengage the at least one string release mechanism from the bow string of the bow assembly so as to discharge a projectile from the first end of the projectile barrel subassembly.

In accordance with one or more other embodiments of the present invention, there is provided a rifle bow comprising (i) a bow assembly, the bow assembly comprising a central portion, an upper limb extending upwardly from the central portion, a lower limb extending downwardly from the central portion, and a bow string extending between an upper end portion of the upper limb and a lower end portion of the lower limb; and (ii) a rifle bow assembly coupled to the bow assembly. The rifle bow assembly including an outer barrel slide subassembly having an elongate cavity disposed therethrough, the outer barrel slide subassembly being affixedly attached to the central portion of the bow assembly such that the outer barrel slide subassembly remains stationary relative to the central portion of the bow assembly; a projectile barrel subassembly having a first end and a second end, the projectile barrel subassembly slidingly received within the elongate cavity of the outer barrel slide subassembly, and the projectile barrel subassembly having a rifled projectile passageway extending in a lengthwise direction thereof; a magazine subassembly coupled to the second end of the projectile barrel subassembly, the magazine subassembly having attachment means for securing a projectile magazine thereto; and a release subassembly coupled to an end portion of the magazine subassembly, the release subassembly including at least one string release mechanism for releasably engaging the bow string of the bow assembly. In this embodiment, the projectile barrel subassembly is configured to retract with the bow string when the bow string is pulled back by a user, and wherein the projectile barrel subassembly is configured to remain stationary when a projectile is discharged from the rifle bow.

In accordance with yet one or more other embodiments of the present invention, there is provided a rifle bow comprising: (i) a bow assembly, the bow assembly comprising a central portion, an upper limb extending upwardly from the central portion, a lower limb extending downwardly from the central portion, and a bow string extending between an upper end portion of the upper limb and a lower end portion of the lower limb; and (ii) a rifle bow assembly coupled to the bow assembly. The rifle bow assembly including an outer barrel slide subassembly having an elongate cavity disposed therethrough, the outer barrel slide subassembly being affixedly attached to the central portion of the bow assembly such that the outer barrel slide subassembly remains stationary relative to the central portion of the bow assembly; a projectile barrel subassembly having a first end and a second end, the projectile barrel subassembly slidingly received within the elongate cavity of the outer barrel slide subassembly, and the projectile barrel subassembly having a rifled projectile passageway extending in a lengthwise direction thereof; a magazine subassembly coupled to the second end of the projectile barrel subassembly, the magazine subassembly having attachment means for securing a projectile magazine thereto; a release subassembly coupled to an end portion of the magazine subassembly, the release subassembly including at least one string release mechanism for releasably engaging the bow string of the bow assembly; and a projectile magazine coupled to the magazine subassembly by the attachment means, the projectile magazine having a plurality of projectiles disposed therein. In this embodiment, the projectile barrel subassembly is configured to retract with the bow string when the bow string is pulled back by a user, and wherein the projectile barrel subassembly is configured to remain stationary when the projectile is discharged from the rifle bow.

In a further embodiment of the present invention, one or more of the plurality of projectiles comprises a projectile shell, the projectile shell including at least one notch configured to engage with an alignment rail of the projectile magazine, and the projectile shell further including at least one protrusion configured to engage with a groove in a bounding sidewall of the rifled projectile passageway of the projectile barrel subassembly.

In yet a further embodiment, the at least one protrusion of the projectile shell comprises a plurality of protrusions spaced apart about a circumference of the projectile shell, each of the plurality of protrusions configured to engage with a respective groove in the bounding sidewall of the rifled projectile passageway of the projectile barrel subassembly.

In still a further embodiment, each of the plurality of projectiles is not in the form of an arrow, and does not comprise a nock or sabot.

In yet a further embodiment, the magazine subassembly and the release subassembly are mounted to a common body portion, the common body portion of the magazine subassembly and the release subassembly being removably engaged with the projectile barrel subassembly by means of a locking mechanism.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which:

FIG. 58A is a front end view of a combination magazine subassembly and string release subassembly of the rifle bow assembly, according to an alternative embodiment of the invention;

FIG. 58B is a first side view of the combination magazine subassembly and string release subassembly of FIG. 58A;

FIG. 58C is another front end view of the combination magazine subassembly and string release subassembly of FIG. 58A, wherein the end view of FIG. 58C is generally the same as the end view of FIG. 58A except for being rotated ninety (90) degrees counter-clockwise;

FIG. 58D is a top view of the combination magazine subassembly and string release subassembly of FIG. 58A;

FIG. 58E is yet another front end view of the combination magazine subassembly and string release subassembly of FIG. 58A, wherein the end view of FIG. 58E is generally the same as the end view of FIG. 58A except for being rotated one-hundred and eighty (180) degrees counter-clockwise;

FIG. 58F is a second side view of the combination magazine subassembly and string release subassembly of FIG. 58A;

FIG. 58G is another front end view of the combination magazine subassembly and string release subassembly of FIG. 58A, wherein the end view of FIG. 58G is generally the same as the end view of FIG. 58A except for being rotated ninety (90) degrees clockwise;

FIG. 58H is a bottom view of the combination magazine subassembly and string release subassembly of FIG. 58A;

FIG. 59A is a side view of the housing cover plate of the string release subassembly of FIG. 58A, according to an alternative embodiment of the invention;

FIG. 59B is a front view of the housing cover plate of FIG. 59A;

FIG. 59C is an end view of the housing cover plate of FIG. 59A;

FIG. 59D is a rear view of the housing cover plate of FIG. 59A;

Figure 60A:
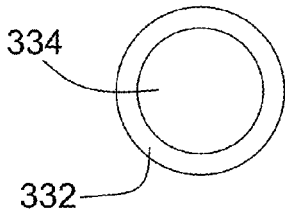
Figure 60B:
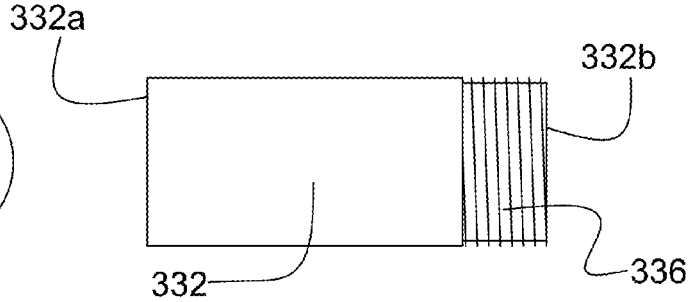
Figure 61A:
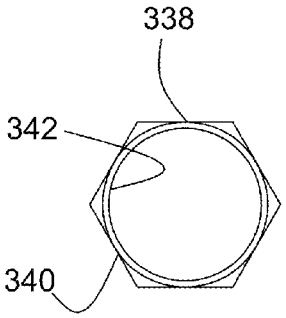
Figure 61B:
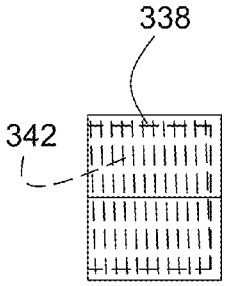
Figure 61C:
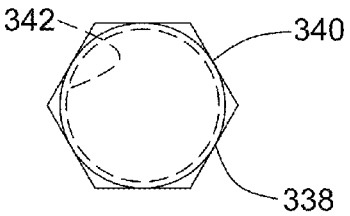
Figure 62A:
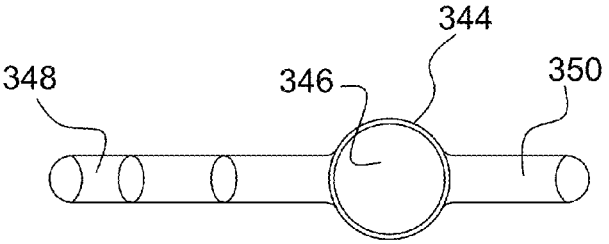
Figure 62B:
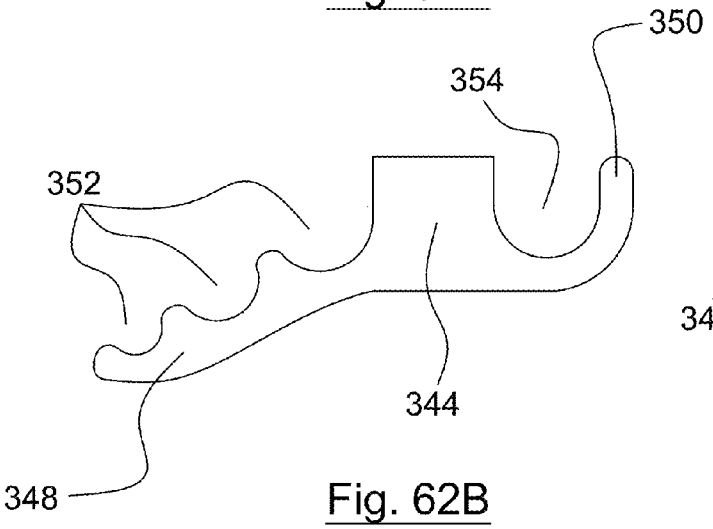
Figure 62C:
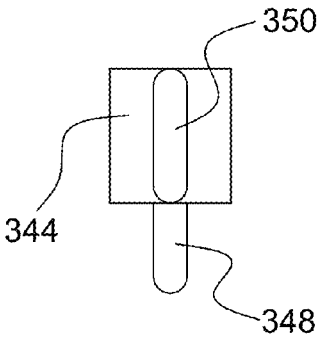
Figure 63A:
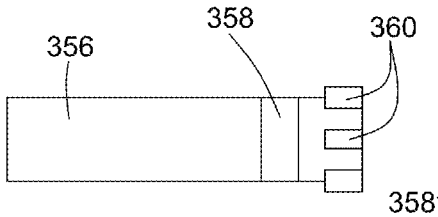
Figure 63B:
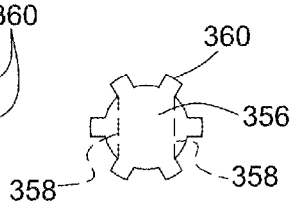
Figure 63C:
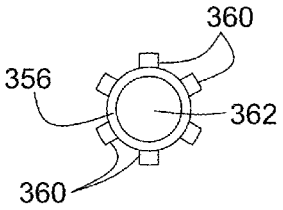
Figure 63D:
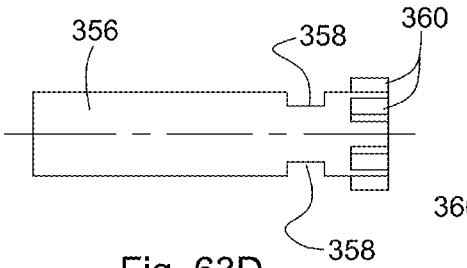
Figure 63E:
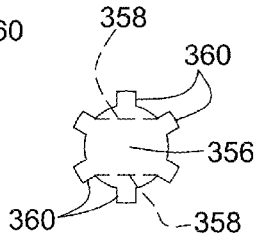
Figure 64A:
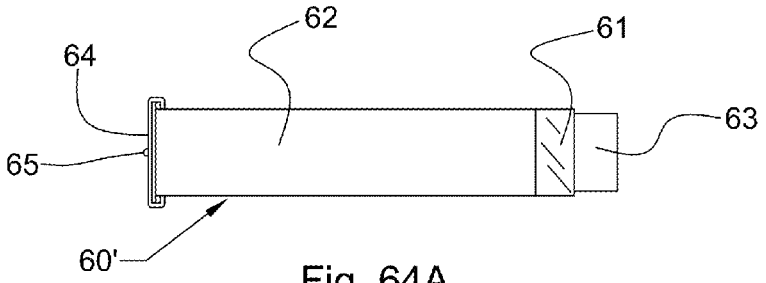
Figure 64B:
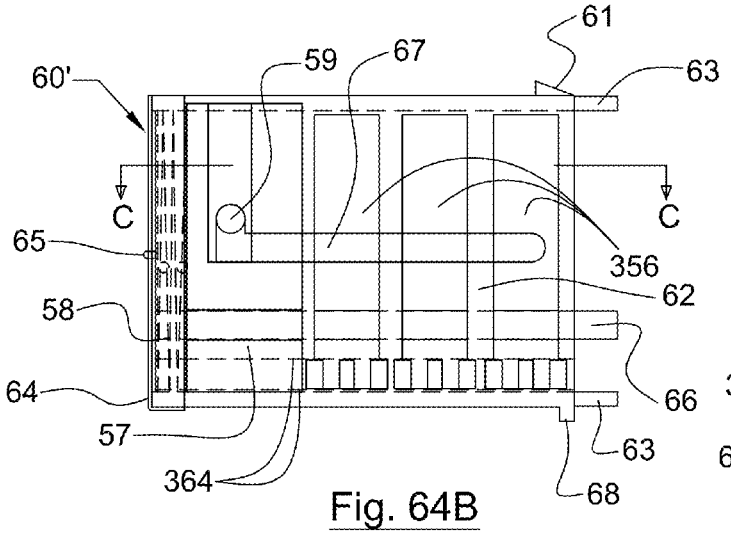
Figure 64C:
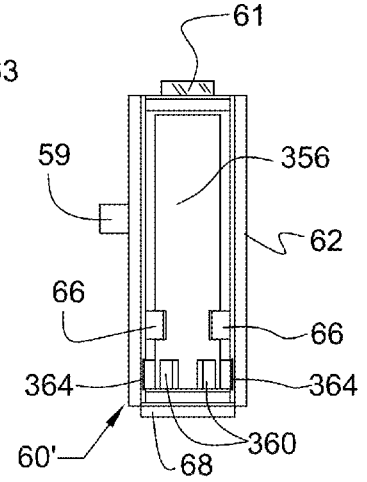
Figure 64D:
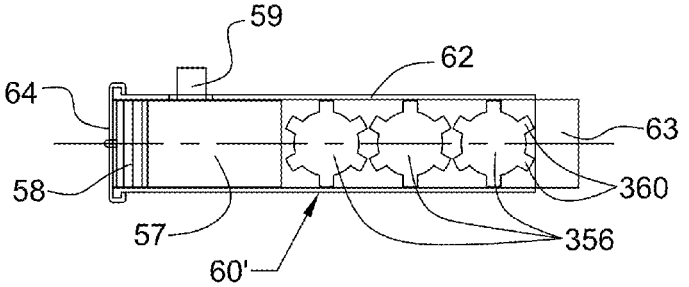
Figure 65A:
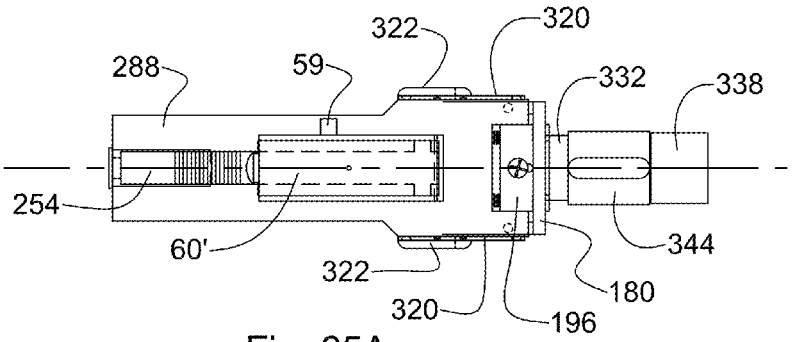
Figure 65B:
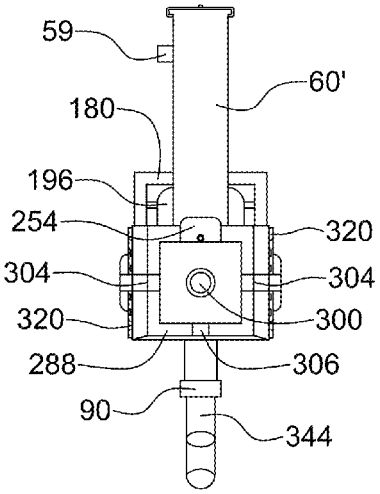
Figure 65C:
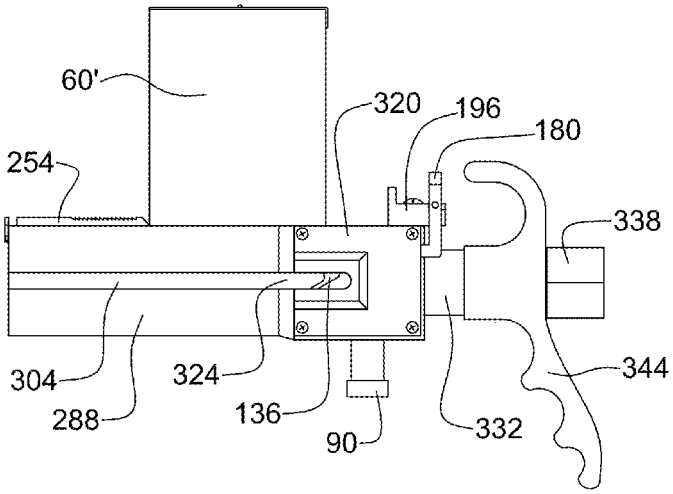

FIG. 60A is an end view of a handle tubular member of the handle subassembly of FIGS. 65A-65C;

FIG. 60B is a side view of the handle tubular member of FIG. 60A;

FIG. 61A is a front end view of a threaded end cap of the handle tubular member of FIGS. 60A and 60B;

FIG. 61B is a side view of the threaded end cap of FIG. 61A;

FIG. 61C is a rear end view of the threaded end cap of FIG. 61A;

FIG. 62A is a rear end view of a handle member of the handle subassembly of FIGS. 65A-65C, according to an alternative embodiment of the invention;

FIG. 62B is a side view of the handle member of FIG. 62A;

FIG. 62C is a top view of the handle member of FIG. 62A;

FIG. 63A is a top view of a projectile shell of a projectile of the rifle bow assembly, according to an alternative embodiment of the invention;

FIG. 63B is a rear end view of the projectile shell of FIG. 63A;

FIG. 63C is a front end view of the projectile shell of FIG. 63A;

FIG. 63D is a side view of the projectile shell of FIG. 63A;

FIG. 63E is another rear end view of the projectile shell of FIG. 63A, wherein the rear end view of FIG. 63E is generally the same as the rear end view of FIG. 63B except for being rotated ninety (90) degrees counter-clockwise;

FIG. 64A is a side view of a projectile magazine of the rifle bow assembly, according to an alternative embodiment of the invention;

FIG. 64B is a top view of the projectile magazine of FIG. 64A;

FIG. 64C is an end view of the projectile magazine of FIG. 64A;

FIG. 64D is a longitudinal sectional view of the projectile magazine of FIG. 64A, wherein the section is cut along the cutting-plane line C-C in FIG. 64B;

FIG. 65A is a side view of the combination magazine subassembly and string release subassembly, handle subassembly, and projectile magazine assembled together, according to an alternative embodiment of the invention;

FIG. 65B is a front end view of the combination magazine subassembly and string release subassembly, handle subassembly, and projectile magazine of FIG. 65A; and FIG. 65C is a bottom view of the combination magazine subassembly and string release subassembly, handle subassembly, and projectile magazine of FIG. 65A.

Throughout the figures, the same parts are always denoted using the same reference characters so that, as a general rule, they will only be described once.

DETAILED DESCRIPTION OF EMBODIMENTS OF THE INVENTION

Figure 1A:
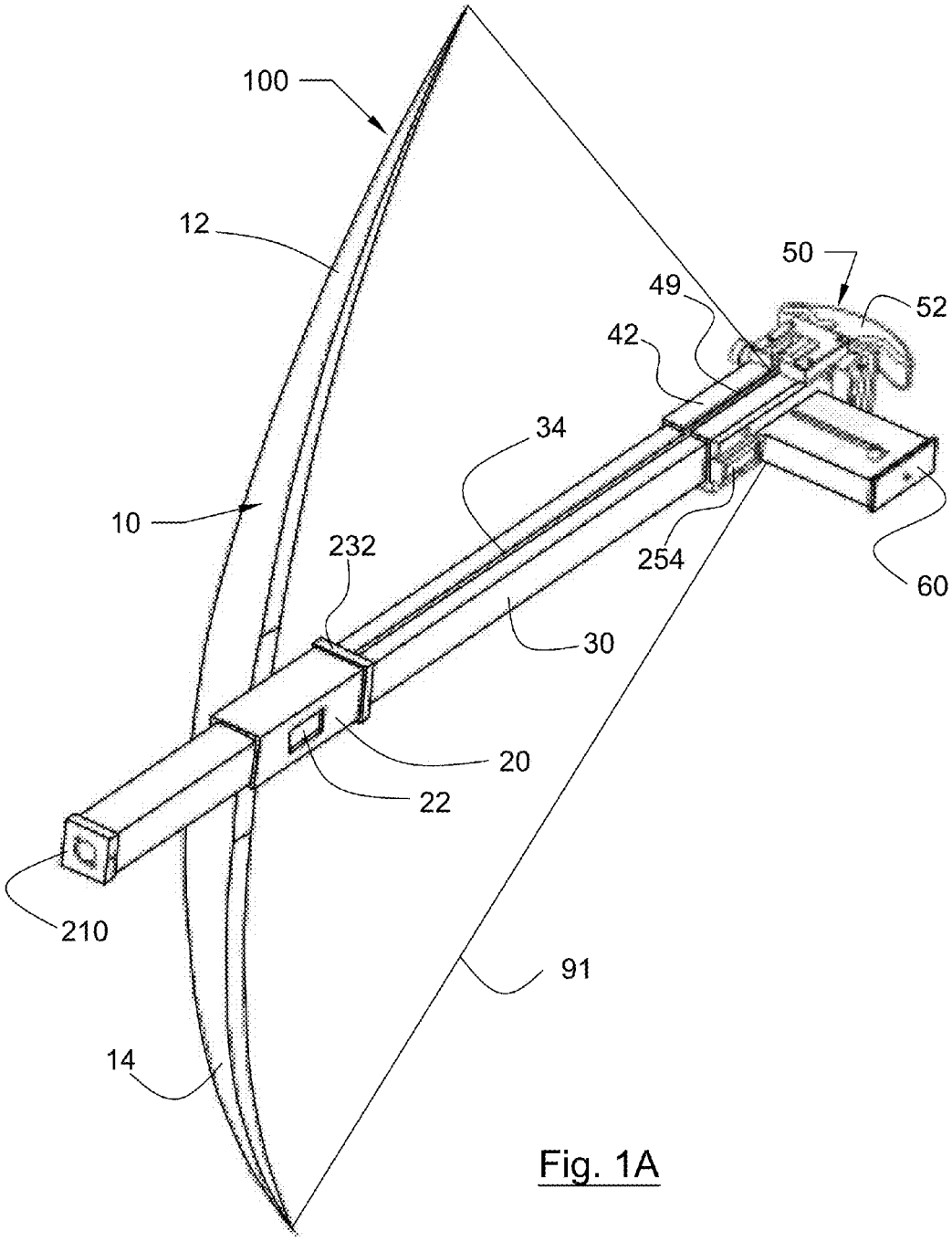
FIG. 1A is a perspective view of a rifle bow having a rifle bow assembly installed thereon according to an embodiment of the invention.

An illustrative embodiment of a rifle bow with the rifle bow assembly mounted thereon is seen generally at 100 in FIG. 1A. As illustrated in this figure, the bow assembly 10 generally comprises a central portion (to which the outer barrel slide subassembly 20 of the rifle bow assembly is attached), an upper limb 12 extending upwardly from the central portion, a lower limb 14 extending downwardly from the central portion, and a bow string 91 extending between an upper end portion of the upper limb 12 and a lower end portion of the lower limb 14. In FIG. 1A, it can be seen that the rifle bow assembly is operatively coupled to the bow assembly. With continued reference to FIG. 1A, the rifle bow assembly generally includes: (i) an outer barrel slide subassembly 20 coupled to the central portion of the bow assembly; (ii) a rifled projectile barrel subassembly 30 having a first end 30A and a second end 30B (e.g., see FIG. 6), the projectile barrel subassembly slidingly received within the outer barrel slide subassembly 20; (iii) a magazine subassembly 40 coupled to the second end 30B of the projectile barrel subassembly 30 (see FIG. 30B), the magazine subassembly 40 having attachment means (i.e., magazine latch mechanism or subassembly 254) for securing a projectile magazine 60 thereto; (iv) a release subassembly 136, 146, 168 coupled to an end portion of the magazine subassembly 40, the release subassembly 136, 146, 168 including at least one string release mechanism 136 (see FIG. 30A) for releasably engaging the bow string 91 of the bow assembly 10; and (v) a projectile magazine 60 coupled to the magazine subassembly 40 by the attachment means 254, the projectile magazine 60 having a plurality of projectiles 70 disposed therein (see e.g., FIG. 30B). The projectile barrel subassembly 30 is configured to retract with the bow string 91 when the bow string 91 is pulled back by a user, and the projectile barrel subassembly 30 is configured to remain stationary when the projectile 70 is discharged from the rifle bow 100 (e.g., because a user is holding the projectile barrel subassembly 30 in place by virtue of his or her grasp on the handle portion 52 of the handle subassembly 50).

Figure 2:
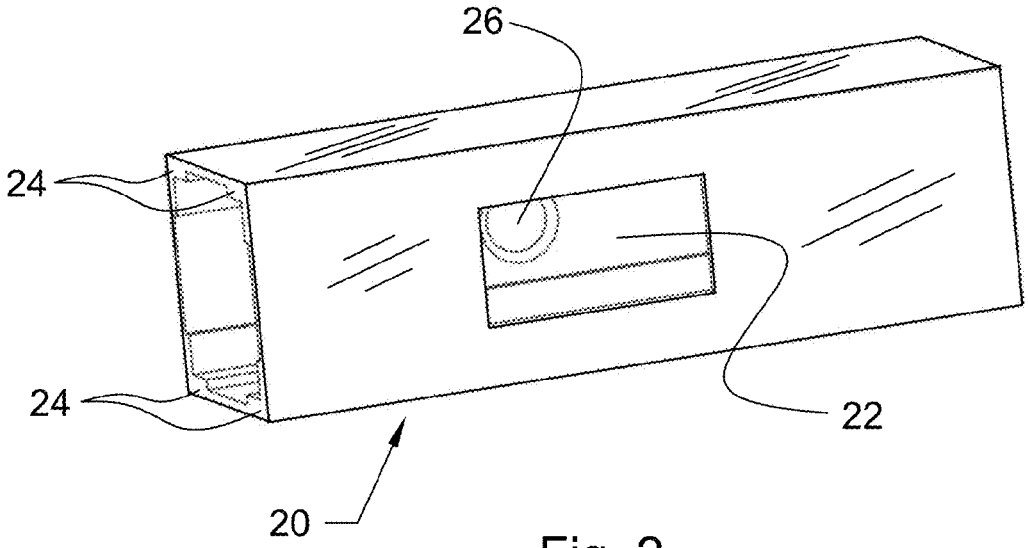
FIG. 2 is a perspective view of an outer barrel slide subassembly of the rifle bow assembly of FIG. 1B.
Figure 3:
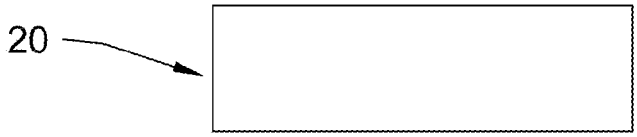
FIG. 3 is a top view of the outer barrel slide subassembly of the rifle bow assembly of FIG. 1B.
Figure 4:
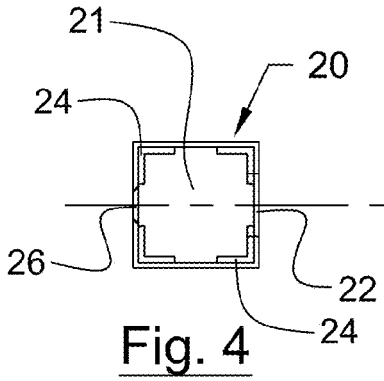
FIG. 4 is an end view of the outer barrel slide subassembly of the rifle bow assembly of FIG. 1B.
Figure 5:
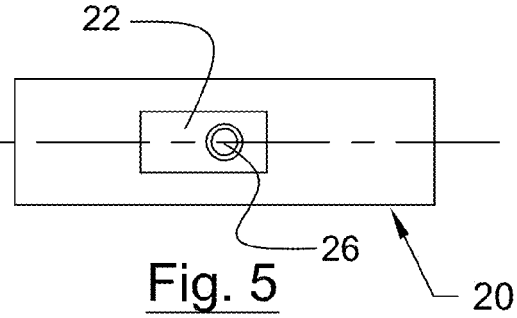
FIG. 5 is a side view of the outer barrel slide subassembly of the rifle bow assembly of FIG. 1B.
Figure 29:
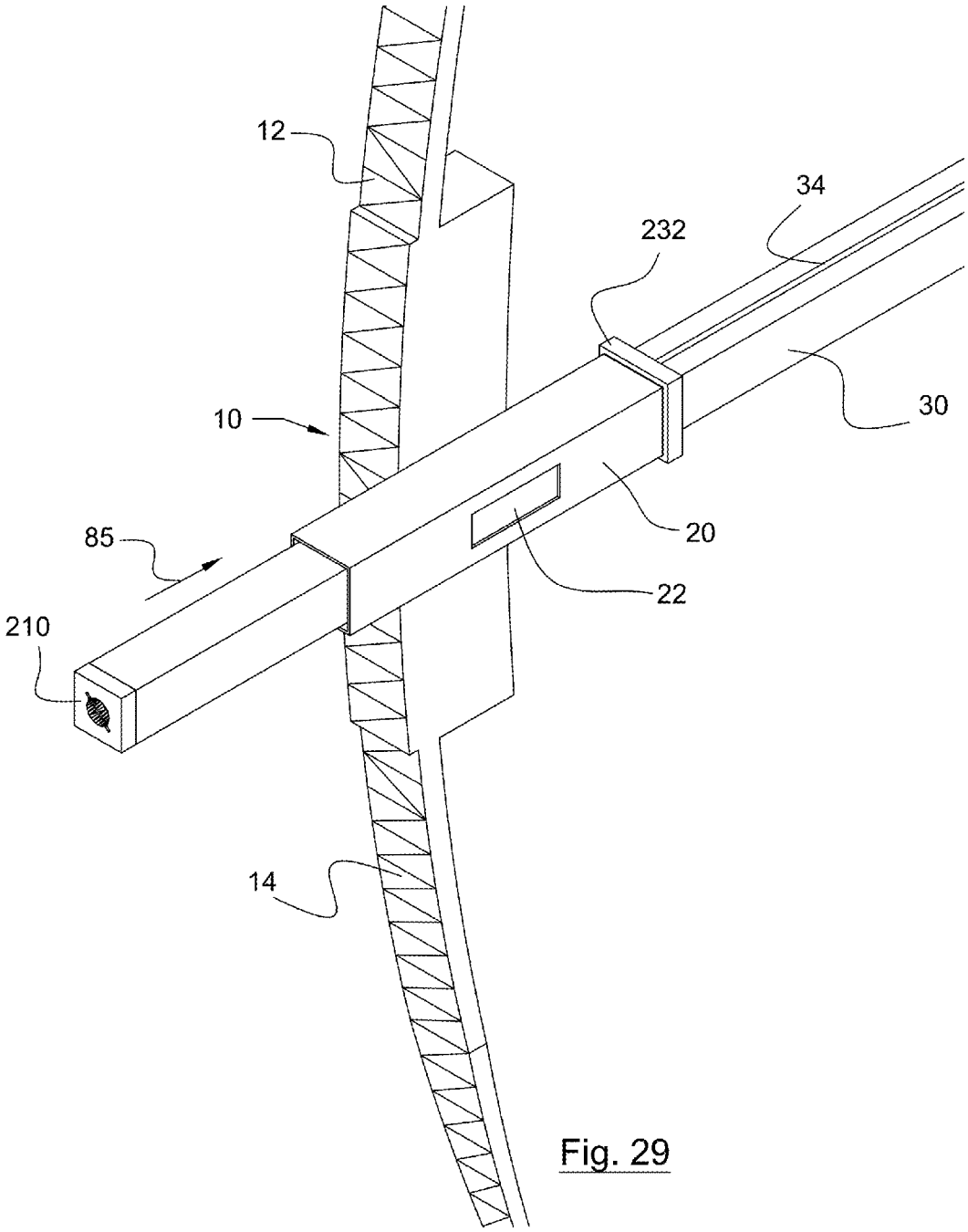
FIG. 29 is a partial, enlarged perspective view of the outer barrel slide subassembly and the projectile barrel subassembly attached to a rifle bow according to an embodiment of the invention.

With reference to FIGS. 2-5, the outer barrel slide subassembly 20 of the rifle bow assembly will be described in detail. Referring initially to FIGS. 2 and 4, it can be seen that the outer barrel slide subassembly 20 has an elongate cavity 21 disposed therethrough. In other words, the outer barrel slide subassembly 20 is in the form of a tubular member (e.g., with a generally square cross section). As best shown in FIGS. 2 and 4, the outer barrel slide subassembly 20 of the illustrated embodiment comprises a plurality of corner glides 24 disposed in each of the four (4) corners of the elongate cavity 21. Advantageously, the corner glides 24 facilitate the sliding movement of the rifled projectile barrel subassembly 30 relative to the outer barrel slide subassembly 20 by reducing the friction between the components. In FIGS. 2 and 5, it can be seen that the outer barrel slide subassembly 20 comprises a rectangular fastener access aperture 22 disposed in a side thereof. As illustrated in FIGS. 4 and 5, the fastener access aperture 22 is substantially vertically aligned with a countersink fastener aperture 26 disposed in the side of the outer barrel slide subassembly 20 that is generally opposite to the side containing the fastener access aperture 22. The countersink fastener aperture 26 accommodates a flat-head bolt or screw, which has a countersunk head, for securing the outer barrel slide subassembly 20 to the side of the central portion of the bow assembly 10 (see FIGS. 1A and 29). The fastener access aperture 22 allows the head of a screwdriver or wrench to pass into the elongate cavity 21 of the outer barrel slide subassembly 20 so that the flat-head bolt or screw, which secures the outer barrel slide subassembly 20 to the bow assembly 10, can be tightened by a user.

Figure 6:
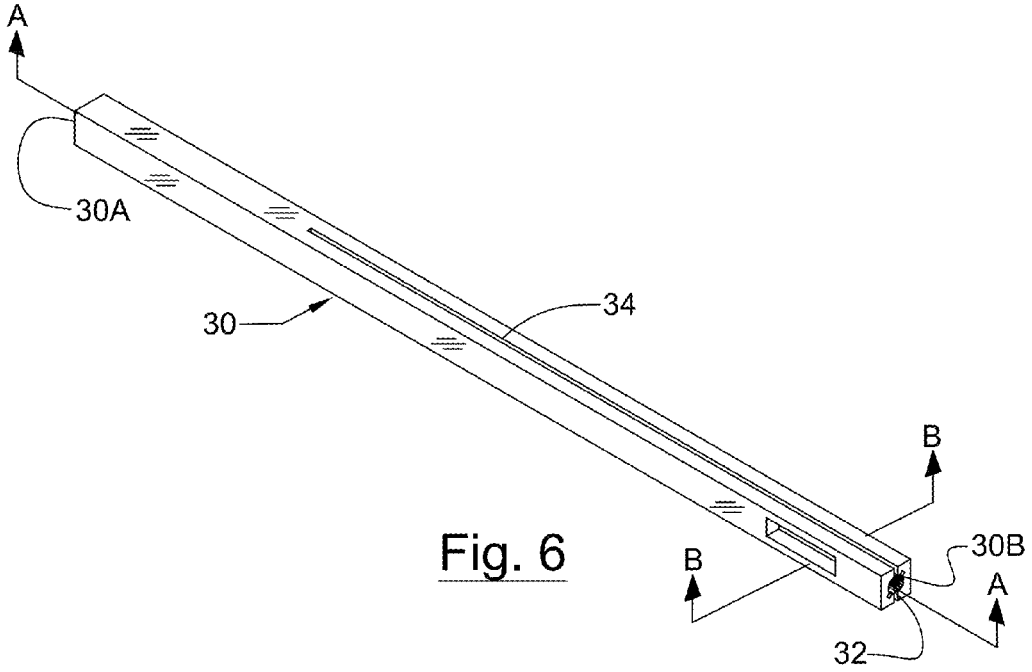
FIG. 6 is a side-rear perspective view of a projectile barrel subassembly of the rifle bow assembly of FIG. 1B.
Figure 7A:
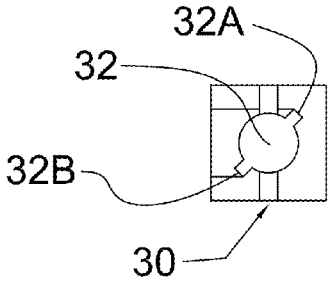
FIG. 7A is a transverse sectional view of the projectile barrel subassembly of the rifle bow assembly of FIG. 1B, wherein the section is cut along the cutting-plane line B-B in FIG. 6.
Figure 7B:
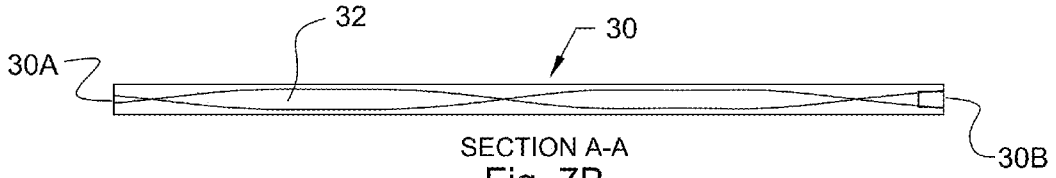
FIG. 7B is a longitudinal sectional view of the projectile barrel subassembly of the rifle bow assembly of FIG. 1B, wherein the section is cut along the cutting-plane line A-A in FIG. 6.
Figure 7C:
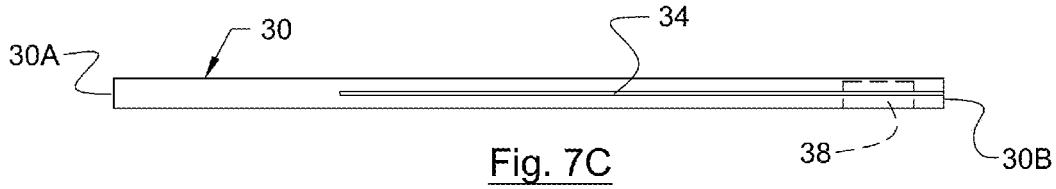
FIG. 7C is a top view of the projectile barrel subassembly of the rifle bow assembly of FIG. 1B.
Figure 7D:
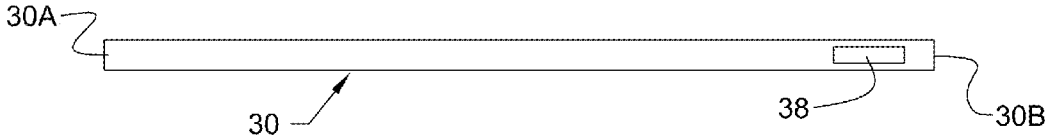
FIG. 7D is a side view of the projectile barrel subassembly of the rifle bow assembly of FIG. 1B.
Figure 26:
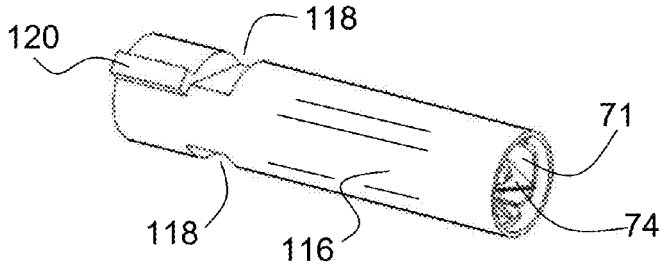
FIG. 26 is a perspective view of the projectile of FIGS. 25A-25F disposed within its shell and wad.
Figure 27:
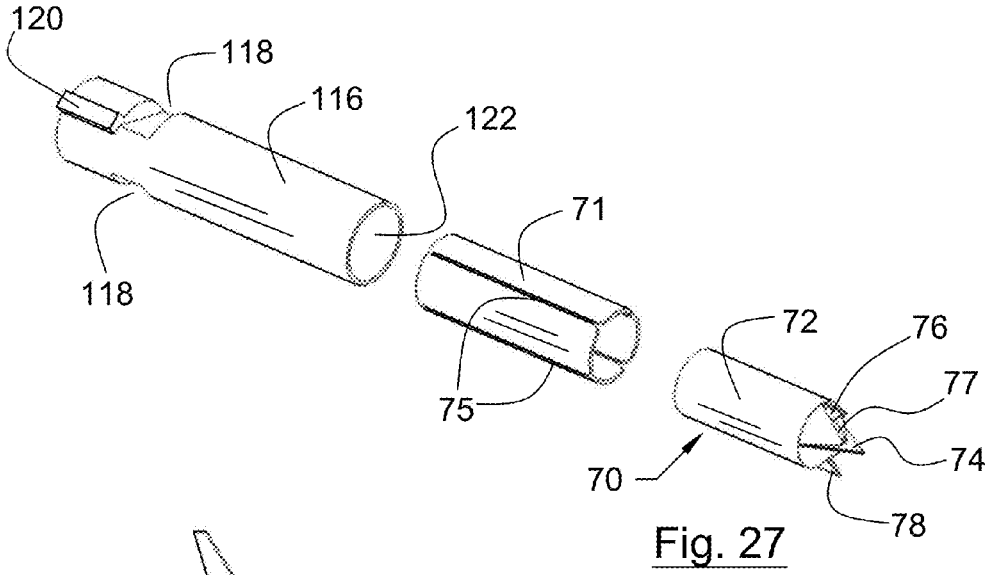
FIG. 27 is an exploded perspective view of the projectile shell of FIGS. 24A-24B, the projectile wad of FIGS. 24C-24D, and the projectile of FIGS. 25A-25F.
Figure 28:
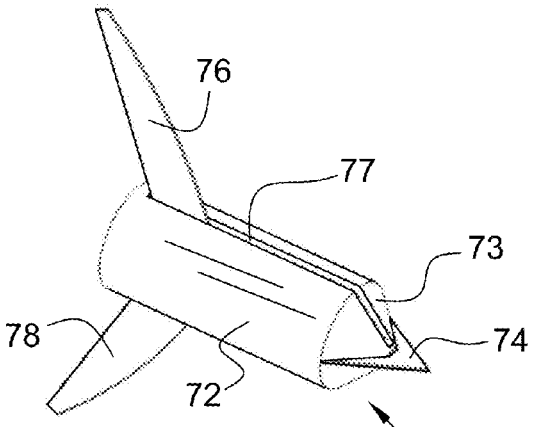
FIG. 28 is a perspective view of the projectile illustrated in FIGS. 25A-25F, wherein the side blades of the projectile are disposed in an extended position.

Now, turning to FIGS. 6-12, the rifled projectile barrel subassembly 30 of the rifle bow assembly will be explained. As described above, referring initially to FIG. 6, the projectile barrel subassembly 30 has a first end 30A and a second end 30B. The projectile barrel subassembly 30 is slidingly received within the elongate cavity 21 of the outer barrel slide subassembly 20 (as illustrated by the arrow 85 in FIG. 29, which diagrammatically denotes one direction of barrel translation). As shown in FIG. 7B, the projectile barrel subassembly 30 has a helical projectile passageway 32 extending in a lengthwise direction thereof (i.e., the projectile barrel subassembly 30 is rifled). In one embodiment of the invention, the rifling pattern of the projectile passageway 32 is such that there is approximately one (1) revolution for every twenty-eight (28) inches of barrel length. As best depicted in the end view and transverse sectional view of FIGS. 7A and 12, respectively, the helical projectile passageway 32 of the projectile barrel subassembly 30 has a substantially circular cross-sectional shape. In addition, the helical projectile passageway 32 of the projectile barrel subassembly 30 comprises two grooves 32A, 32B, which are oppositely disposed with respect to one another (e.g., see FIG. 7A). Each of the two grooves 32A, 32B of the helical projectile passageway 32 is configured to receive a respective protrusion 120 of a projectile shell 116 (e.g., see FIG. 26).

Figure 8:
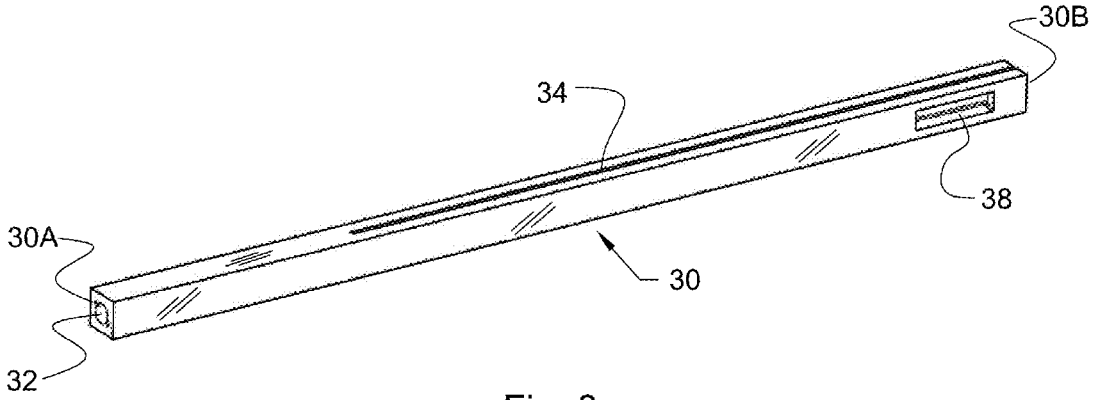
FIG. 8 is a front-side perspective view of a projectile barrel subassembly of the rifle bow assembly of FIG. 1B.
Figure 9:
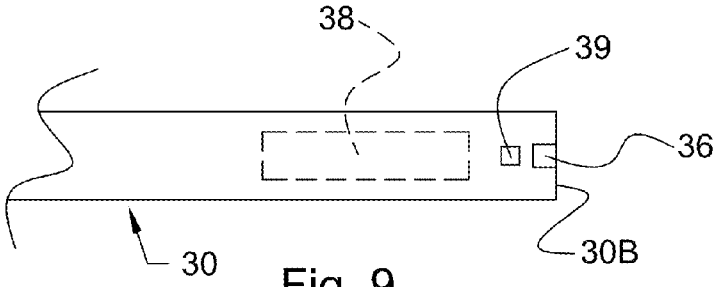
FIG. 9 is a partial, enlarged first side view of a rear end portion of the projectile barrel subassembly of the rifle bow assembly of FIG. 1B.
Figure 10:
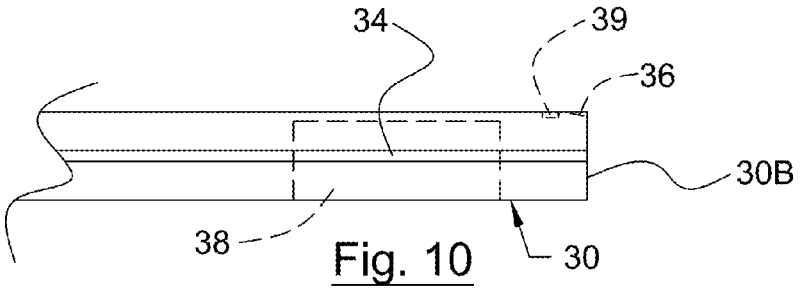
FIG. 10 is a partial, enlarged top view of the rear end portion of the projectile barrel subassembly of the rifle bow assembly of FIG. 1B.
Figure 12:
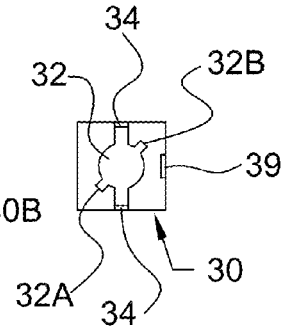
FIG. 12 is a transverse sectional view of the projectile barrel subassembly of the rifle bow assembly of FIG. 1B, wherein the section is cut along the cutting-plane line D-D in FIG. 11.

Referring again to FIG. 6, it can be seen that the top side of the projectile barrel subassembly 30 comprises an elongate slot 34 disposed along a length thereof, wherein the elongate slot 34 is configured to receive the bow string 91 therein. As illustrated in FIGS. 6 and 8, the elongate slot 34 of the projectile barrel subassembly 30 only extends along a portion of the length of the projectile barrel subassembly 30 (e.g., approximately three-quarters (¾) of the length of the projectile barrel subassembly 30). In FIG. 6, it can be seen that the elongated slot 34 extends from the second end 30B of the projectile barrel subassembly 30 to a location spaced apart from its first end 30A by a predetermined distance (e.g., approximately one-quarter (¼) of the length of the projectile barrel subassembly 30). As shown in FIGS. 9, 10, and 12, the projectile barrel subassembly 30 is provided with a notch 39 disposed in the side thereof for receiving the beveled end 114 of the handle assembly locking mechanism 90. A ramp 36 is also provided at the second end 30B of the projectile barrel subassembly 30 in order to facilitate the insertion of the beveled end 114 of the handle assembly locking mechanism 90 into the notch 39 (i.e., so as to guide the beveled end 114 of the handle assembly locking mechanism 90 into the notch 39).

Figure 11:
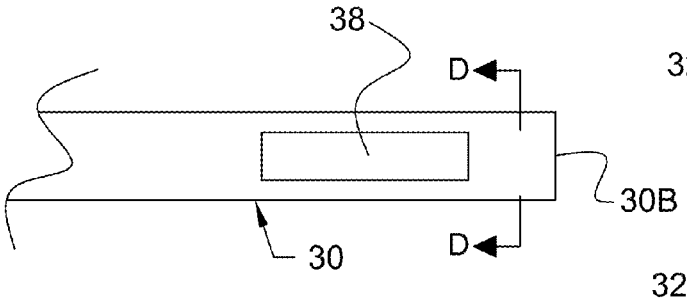
FIG. 11 is a partial, enlarged second side view of a rear end portion of the projectile barrel subassembly of the rifle bow assembly of FIG. 1B.

As best illustrated in FIGS. 8 and 11, the projectile barrel subassembly 30 includes a magazine aperture 38 disposed in a side thereof proximate to its second end 30B. Referring to FIGS. 10 and 11, it can be seen that the magazine aperture 38 is in communication with the helical projectile passageway 32 of the projectile barrel subassembly 30. The magazine aperture 38 is configured to accommodate a projectile 70 passing therethrough, and into the helical projectile passageway 32.

Figure 57A:
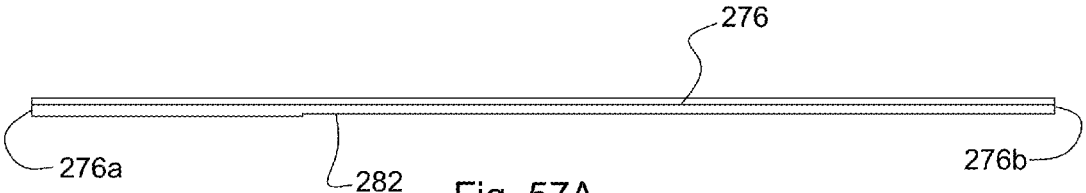
FIG. 57A is a top view of an alternative embodiment of the projectile barrel subassembly of the rifle bow assembly, wherein a half section of the projectile barrel subassembly is illustrated in FIG. 57A.
Figure 57B:
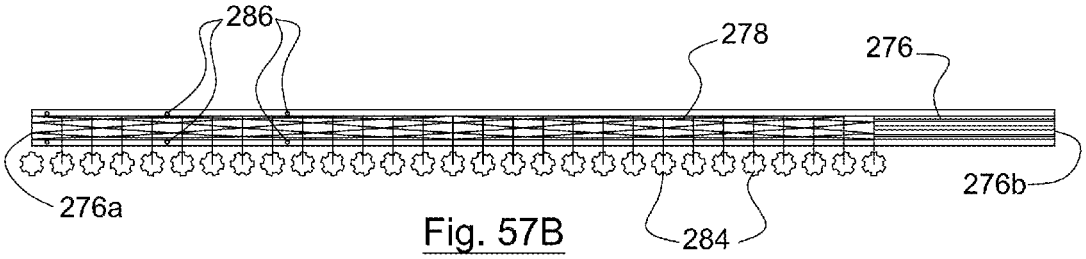
FIG. 57B is a side view of the projectile barrel subassembly of FIG. 57A, wherein a barrel cross-section is diagrammatically illustrated along a length of the projectile barrel subassembly.
Figure 57C:
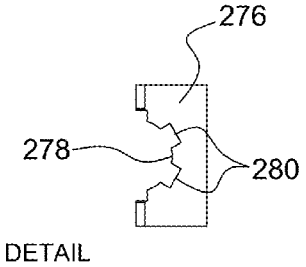
FIG. 57C is a rear end view of the projectile barrel subassembly of FIG. 57A.
Figure 57D:
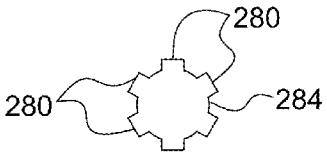
FIG. 57D is enlarged detail view of the barrel cross-section of projectile barrel subassembly of FIG. 57A.

Next, turning to FIGS. 57A-57D, an alternative embodiment of a rifled projectile barrel subassembly of the rifle bow assembly will be explained. The rifled projectile barrel subassembly of FIGS. 57A-57D is similar in some respects to the rifled projectile barrel subassembly 30 described above. However, the rifled projectile barrel subassembly of FIGS. 57A-57D is also different from the rifled projectile barrel subassembly 30 in several ways. First of all, as illustrated in FIGS. 57A-57D, the rifled projectile barrel subassembly of the alternative embodiment is formed from two half sections 276 that are operatively connected to one another, which is different from the single piece projectile barrel subassembly 30 described above. Referring initially to FIGS. 57A and 57B, it can be seen that the half section 276 of the projectile barrel subassembly has a first end 276*a* and a second end 276*b*. The two half sections 276 of the projectile barrel subassembly are connected together using a plurality of alignment pins 286 (see FIG. 57B). After the two half sections 276 of the projectile barrel subassembly are assembled together, the projectile barrel subassembly is slidingly received within the elongate cavity 21 of the outer barrel slide subassembly 20. As shown in the end view of FIG. 57C, each half section 276 of the projectile barrel subassembly has a half portion 278 of a helical or rifled projectile passageway extending in a lengthwise direction thereof. As best depicted in FIGS. 57B and 57D, the overall barrel cross-section 284 of the rifled projectile passageway has a generally circular cross-sectional shape with a plurality of grooves 280 generally equally spaced apart about a circumference thereof. In the illustrated embodiment of FIGS. 57B and 57D, the projectile barrel subassembly comprises six grooves 280 that are equally spaced apart about the circumference of the overall barrel cross-section 284. Each of the six grooves 280 of the barrel cross-section 284 is configured to receive a respective protrusion 360 of a projectile shell 356 (e.g., see FIGS. 63A-63E).

Referring again to FIG. 57A, it can be seen that the top side of the half section 276 of the projectile barrel subassembly comprises a half portion 282 of an elongate slot disposed along a length thereof. When the two half sections 276 of the projectile barrel subassembly are assembled together, the two half slot portions 282 collectively form an elongate slot that is configured to receive the bow string 91 therein. As illustrated in FIG. 57A, the half portion 282 of the elongate slot in the half section 276 of projectile barrel subassembly only extends along a portion of the length of the projectile barrel subassembly (e.g., approximately three-quarters (¾) of the length of the projectile barrel subassembly). In FIG. 57A, it can be seen that the half portion 282 of the elongate slot extends from the second end 276*b* of the half section 276 of the projectile barrel subassembly to a location spaced apart from its first end 276*a* by a predetermined distance (e.g., approximately one-quarter (¼) of the length of the half section 276 of the projectile barrel subassembly). Advantageously, forming the projectile barrel subassembly in two sections 276 rather than from a single machined piece of material, makes it easier to manufacture the projectile barrel subassembly.

Figure 1B:
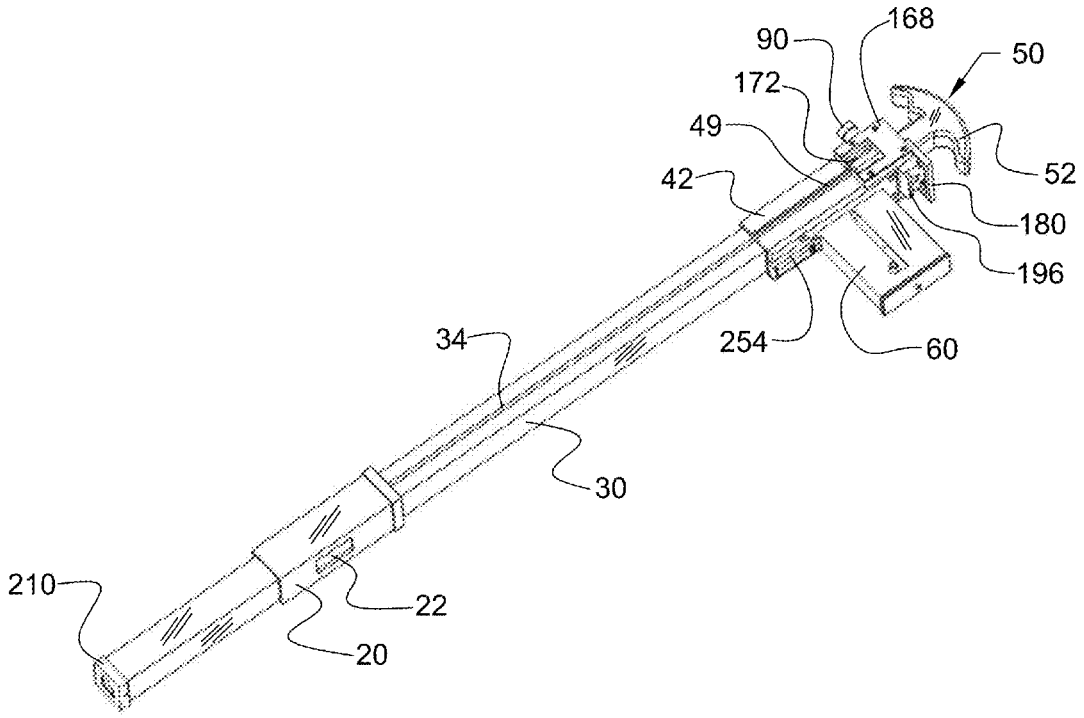
FIG. 1B is a perspective view of the rifle bow assembly of FIG. 1A.
Figure 13:
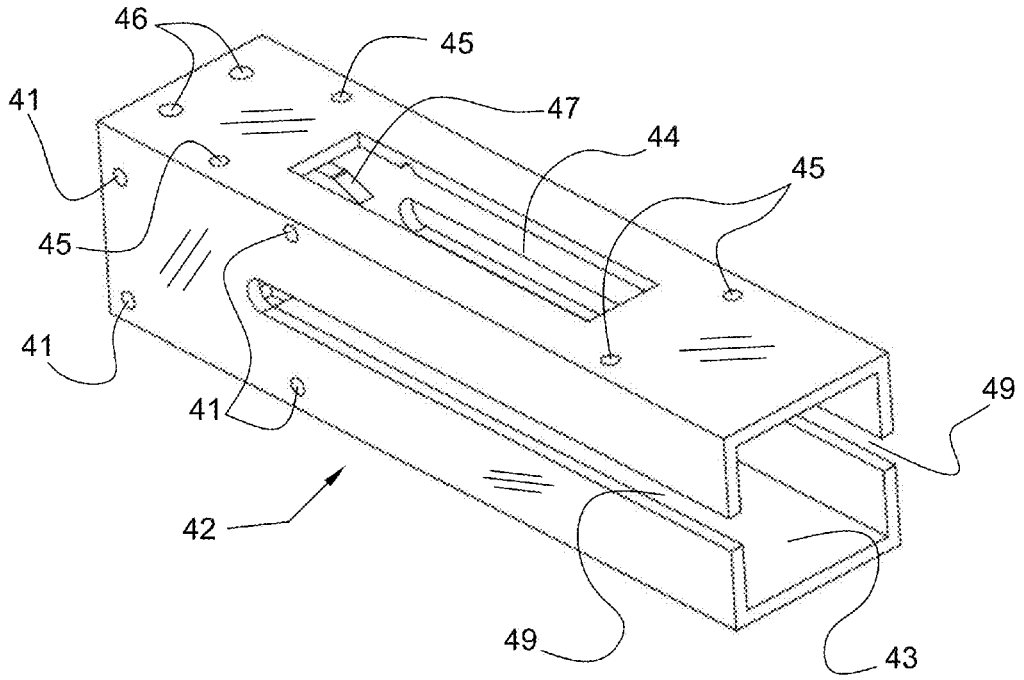
FIG. 13 is a perspective view of a magazine subassembly body portion of the rifle bow assembly of FIG. 1B.
Figure 14A:
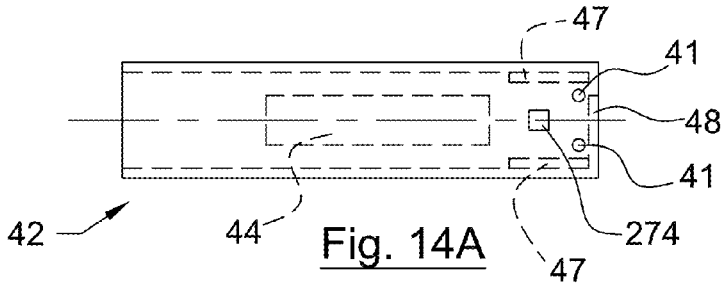
FIG. 14A is a first side view of the magazine subassembly body portion of the rifle bow assembly of FIG. 1B.
Figure 14B:
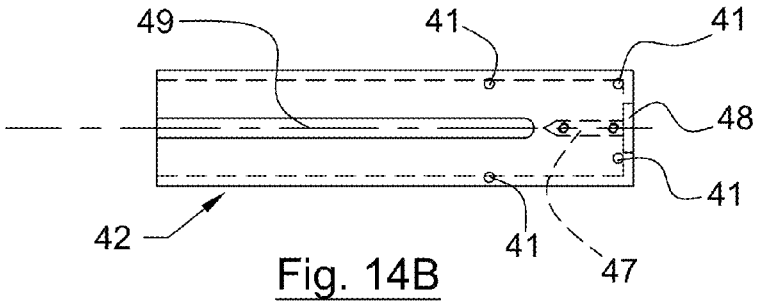
FIG. 14B is a top view of the magazine subassembly body portion of the rifle bow assembly of FIG. 1B.
Figure 14C:
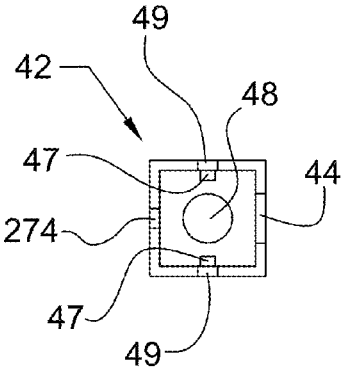
FIG. 14C is a front end view of the magazine subassembly body portion of the rifle bow assembly of FIG. 1B.
Figure 14D:
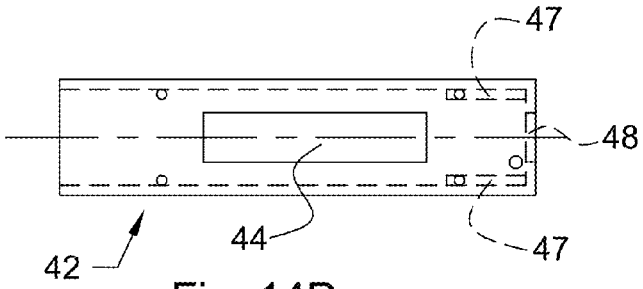
FIG. 14D is a second side view of the magazine subassembly body portion of the rifle bow assembly of FIG. 1B.

Next, referring to FIGS. 13-15D and 55-56D, the magazine subassembly 40 of the rifle bow assembly will be described. As best shown in the partially exploded view of FIG. 30B, the magazine subassembly 40 slips over the second end portion of the projectile barrel subassembly 30 (i.e., the direction of insertion is indicated by arrow 93 in FIG. 30B). In particular, turning to FIG. 13, it can be seen that the body portion 42 of the magazine subassembly 40 comprises an elongate cavity 43 that receives the second end portion of the projectile barrel subassembly 30. The body portion 42 of the magazine subassembly 40 also comprises a magazine aperture 44 that is configured to be generally aligned with at least a portion of the magazine aperture 38 of the projectile barrel subassembly 30 (e.g., see FIG. 30B). In addition, as illustrated in the perspective view of FIG. 13 and the top view of FIG. 14B, it can be seen that the top and bottom sides of the magazine subassembly body portion 42 comprise an elongate bow string slot 49 disposed along a length thereof. The elongate slot 49 of the magazine subassembly body portion 42 is configured to receive the bow string 91 therein, and as shown in FIGS. 1A and 1B, the elongate slot 49 of the magazine subassembly body portion 42 is generally aligned with the elongate slot 34 of the projectile barrel subassembly 30. Also, as shown in FIGS. 13, 14A, and 14B, the magazine subassembly body portion 42 is provided with a first pluralities of mounting apertures 41 disposed therein for receiving fasteners that secure the release subassembly 136, 146, 168 to the magazine subassembly body portion 42 (e.g., see FIG. 30B). Moreover, the magazine subassembly body portion 42 comprises a second plurality of mounting apertures 45 disposed therein for receiving fasteners that secure the magazine mounting plate 80 to the magazine subassembly body portion 42 (e.g., see FIG. 30A). Furthermore, the magazine subassembly body portion 42 comprises a third plurality of mounting apertures 46 disposed therein for receiving fasteners that secure the handle subassembly 50 to the magazine subassembly body portion 42 (e.g., see FIG. 30A). As best illustrated in the end view of FIG. 14C, the rear wall of the magazine subassembly body portion 42 includes a circular aperture 48 disposed therein for accommodating the passage of the chamber insert member 124 therethrough. The structure and functionality of the chamber insert member 124 will be described in detail hereinafter.

Figure 14E:
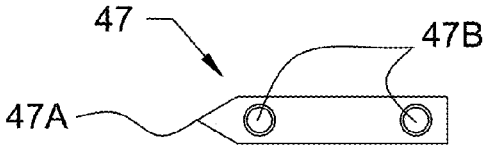
FIG. 14E is a top view of a barrel spreader member of the magazine subassembly body portion of FIG. 13.
Figure 14F:
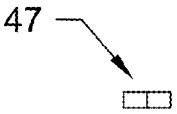
FIG. 14F is a front end view of the barrel spreader member of the magazine subassembly body portion of FIG. 13.
Figure 14G:
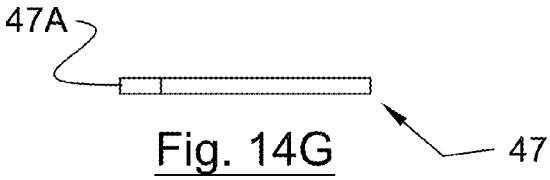
FIG. 14G is a side view of the barrel spreader member of the magazine subassembly body portion of FIG. 13.

As shown in FIGS. 13 and 14A-14D, the magazine subassembly body portion 42 includes barrel spreader members 47 disposed on the top and bottom interior surfaces thereof. The barrel spreader members 47 are configured to slide into the top and bottom end portions of the elongated slot 34 in the projectile barrel subassembly 30 so as prevent the elongated slot 34 from deforming inwardly at the second end 30B of the projectile barrel subassembly 30 (i.e., because the bow string elongate slot 34 passes completely through the projectile barrel subassembly 30). In other words, barrel spreader members 47 ensure that the width of the end portion of the elongated slot 34 is generally the same as the width of the elongated slot 34 along the remainder of its length. Turning to FIGS. 14E-14G, it can be seen that each of the barrel spreader members 47 comprises a pointed tip portion 47A and a generally straight body portion with a plurality of fastener apertures 47B disposed therethrough for securing the barrel spreader members 47 to the respective inside surfaces of the magazine subassembly body portion 42. The pointed tip portion 47A of each barrel spreader member 47 facilitates the insertion of the barrel spreader members 47 into the elongated slot 34 of the projectile barrel subassembly 30.

Figure 15A:
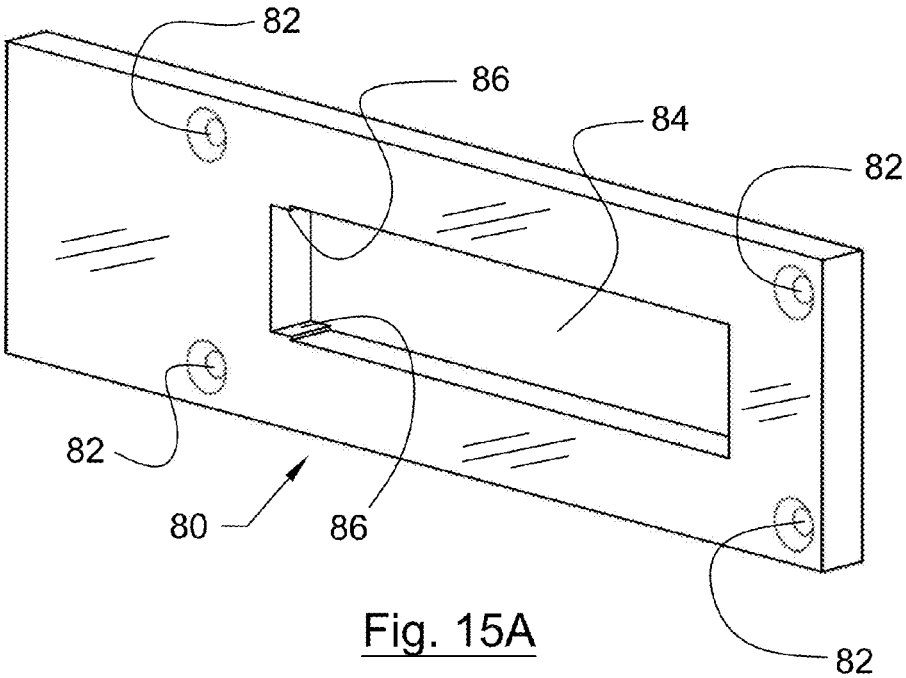
FIG. 15A is a perspective view of a magazine mounting plate of the magazine subassembly of FIG. 1B.
Figure 15B:
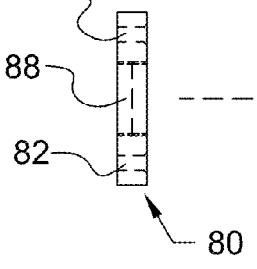
FIG. 15B is an end view of the magazine mounting plate of FIG. 15A.
Figure 15C:
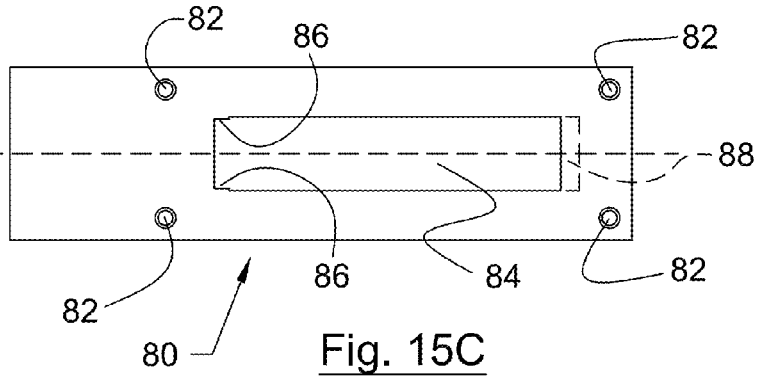
FIG. 15C is a side view of the magazine mounting plate of FIG. 15A.
Figure 15D:
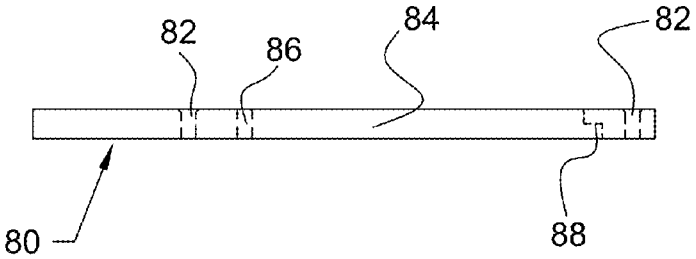
FIG. 15D is a bottom view of the magazine mounting plate of FIG. 15A.

Next, with reference to FIGS. 15A-15D, the magazine mounting plate 80 of the magazine subassembly 40 will be described. As best illustrated in FIG. 15A, the magazine mounting plate 80 comprises a plurality of countersink fastener apertures 82 for receiving fasteners that secure the magazine mounting plate 80 to the side of the magazine subassembly body portion 42 (refer to FIGS. 30A and 30B). Also, referring to FIGS. 15A and 15C, it can be seen that the magazine mounting plate 80 comprises a magazine aperture 84 that is configured to be generally aligned with the magazine aperture 44 of the magazine subassembly body portion 42 (e.g., see FIG. 30B). Like the magazine aperture 44 of the magazine subassembly body portion 42, the magazine aperture 84 of the magazine mounting plate 80 is configured to allow the passage of a projectile 70 therethrough, and into the helical projectile passageway 32 of the projectile barrel subassembly 30. In addition, as best shown in FIGS. 15A and 15C, a front portion of the peripheral bounding edge of the magazine aperture 84 is provided with two oppositely disposed stepped portions 86 for engaging the frontmost protrusion 63 of the projectile magazine 60. Also, referring to FIGS. 15C and 15D, it can be seen that the peripheral bounding edge of the magazine aperture 84 also comprises a rear stepped portion 88 that engages the side attachment projection tab 68 of the projectile magazine 60. That is, the side attachment projection tab 68 of the projectile magazine 60 slips under the rear stepped portion 88 of the magazine mounting plate 80 so as to secure the rear end of the projectile magazine 60 in place. The front end of the projectile magazine 60 is secured in place by means of the magazine latching subassembly 254, as will be described hereinbelow.

Figure 30A:
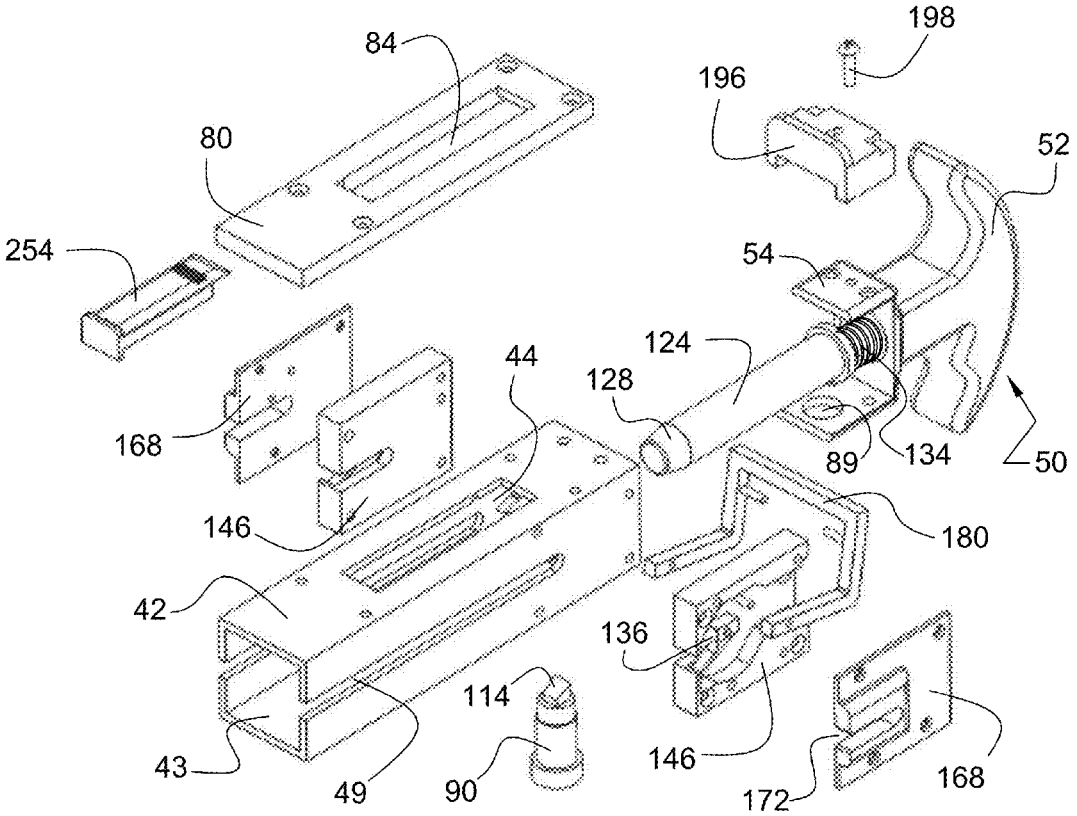
FIG. 30A is an exploded perspective view of the magazine subassembly, the handle subassembly, and the string release subassembly of FIG. 1B.
Figure 30B:
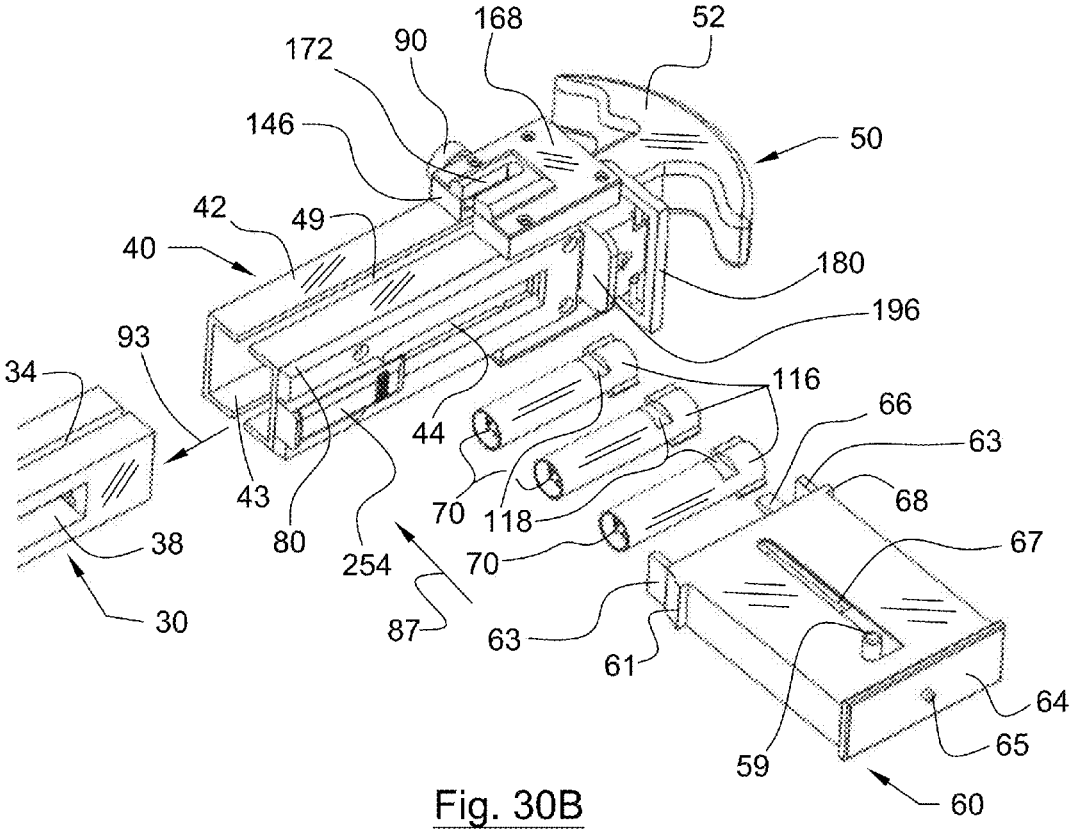
FIG. 30B is an exploded perspective view of a projectile magazine, projectiles, and projectile barrel subassembly exploded from the magazine, string release, and handle subassemblies.
Figure 55:
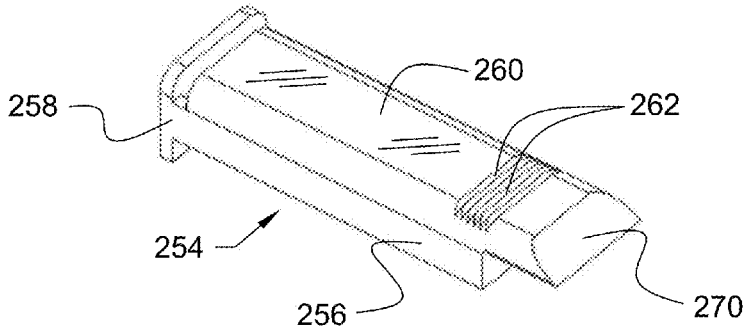
FIG. 55 is a perspective view of a magazine latching subassembly of the rifle bow assembly of FIG. 1B.
Figure 56A:
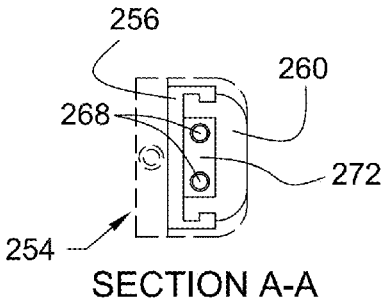
FIG. 56A is a transverse sectional view of the magazine latching subassembly of FIG. 55, wherein the section is cut along the cutting-plane line A-A in FIG. 56B.
Figure 56B:
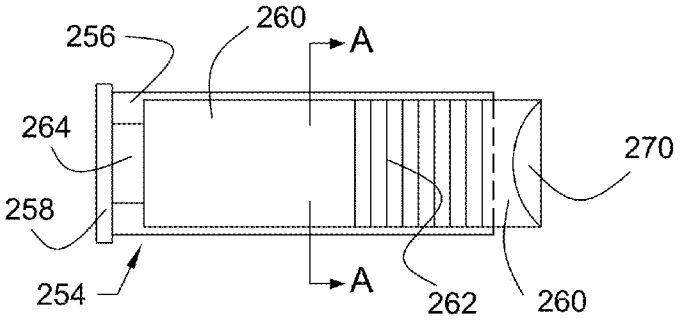
FIG. 56B is a top view of the magazine latching subassembly of FIG. 55.
Figure 56C:
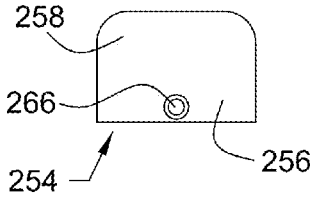
FIG. 56C is a front end view of the magazine latching subassembly of FIG. 55.
Figure 56D:
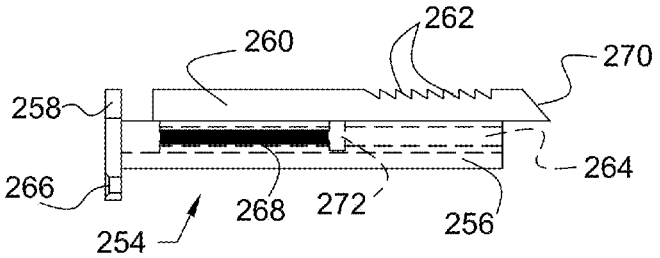
FIG. 56D is a side view of the magazine latching subassembly of FIG. 55.

As briefly mentioned above, the magazine subassembly 40 further includes a magazine latching subassembly 254 for removably coupling a projectile magazine 60 thereto (see FIG. 30B). In FIG. 30B, the general direction of attachment of the projectile magazine 60 to the magazine subassembly 40 is indicated by the directional arrow 87. Now, with reference to FIGS. 55 and 56A-56D, the structure of the magazine latching subassembly 254 will be explained. Initially, as shown in the perspective view of FIG. 55, it can be seen that the latching mechanism subassembly 254 generally comprises a T-shaped base portion 256 with an end plate 258 and sliding latch portion 260 that is slidingly disposed relative to the T-shaped base portion 256. As best shown in the top view of FIG. 56B, the T-shaped base portion 256 comprises an inner slot 264 for slidingly engaging the base projection 272 of the sliding latch portion 260. With reference to FIGS. 56A and 56D, it can also be seen that that the inner slot 264 comprises two (2) spring members 268 for biasing the sliding latch portion 260 of the latching mechanism subassembly 254 in a latched position wherein the projectile magazine 60 is secured to the magazine subassembly 40. Turning to the end view of FIG. 56C, it can be seen that the end plate 258 of the T-shaped base portion 256 of the latching mechanism subassembly 254 is provided with a countersink fastener aperture 266 for receiving a fastener that secures the magazine latching subassembly 254 to the front edge of the magazine mounting plate 80. Referring collectively to FIGS. 55, 56B, and 56D, it can be seen that the sliding latch portion 260 of the magazine latching subassembly 254 comprises a knurled gripping surface 262 for enhancing the frictional engagement between a user's finger and the top surface of the sliding latch portion 260, thereby making it easier for the user to latch and unlatch the projectile magazine 60 from the magazine subassembly 40. Also, as shown in these three figures, the sliding latch portion 260 of the magazine latching subassembly 254 further comprises slanted or beveled end portion 270 that engages the outer flat surface of the inclined protrusion 61 of the projectile magazine 60 when the projectile magazine 60 is attached to the magazine subassembly 40 (i.e., the beveled end portion 270 of the sliding latch portion 260 slides over the top of the outer flat surface of the inclined protrusion 61 in the latched state). Advantageously, the illustrated magazine latching subassembly 254 has a low overall cross-sectional profile that is unlikely to be inadvertently unlocked by brush or vegetation while a user is hunting in the wilderness.

Figure 16:
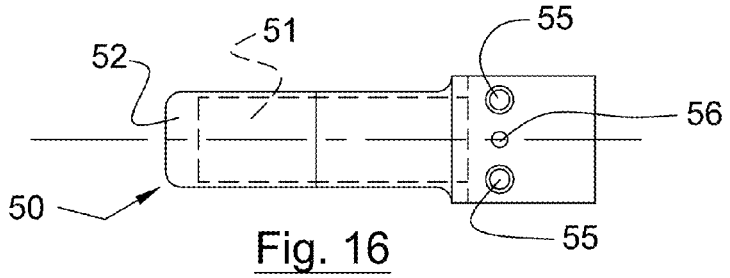
FIG. 16 is a first side view of a handle subassembly of the magazine subassembly of FIG. 1B.
Figure 17:
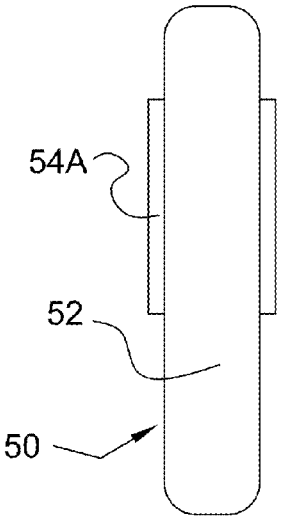
FIG. 17 is an end view of the handle subassembly of the magazine subassembly of FIG. 1B.
Figure 18:
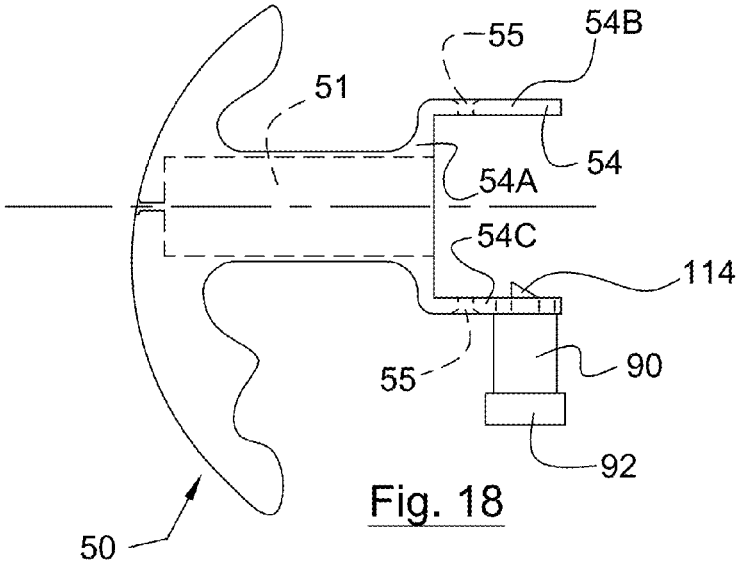
FIG. 18 is a top view of the handle subassembly of the magazine subassembly of FIG. 1B.
Figure 19:
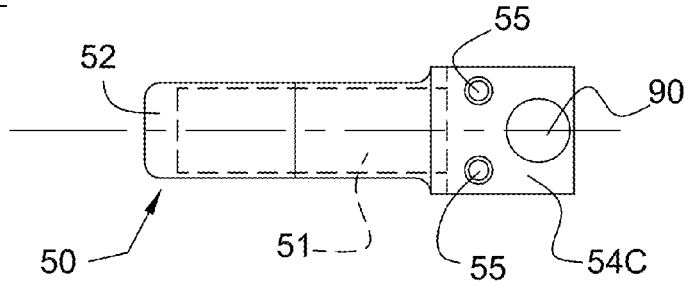
FIG. 19 is a second side view of the handle subassembly of the magazine subassembly of FIG. 1B.
Figure 20:
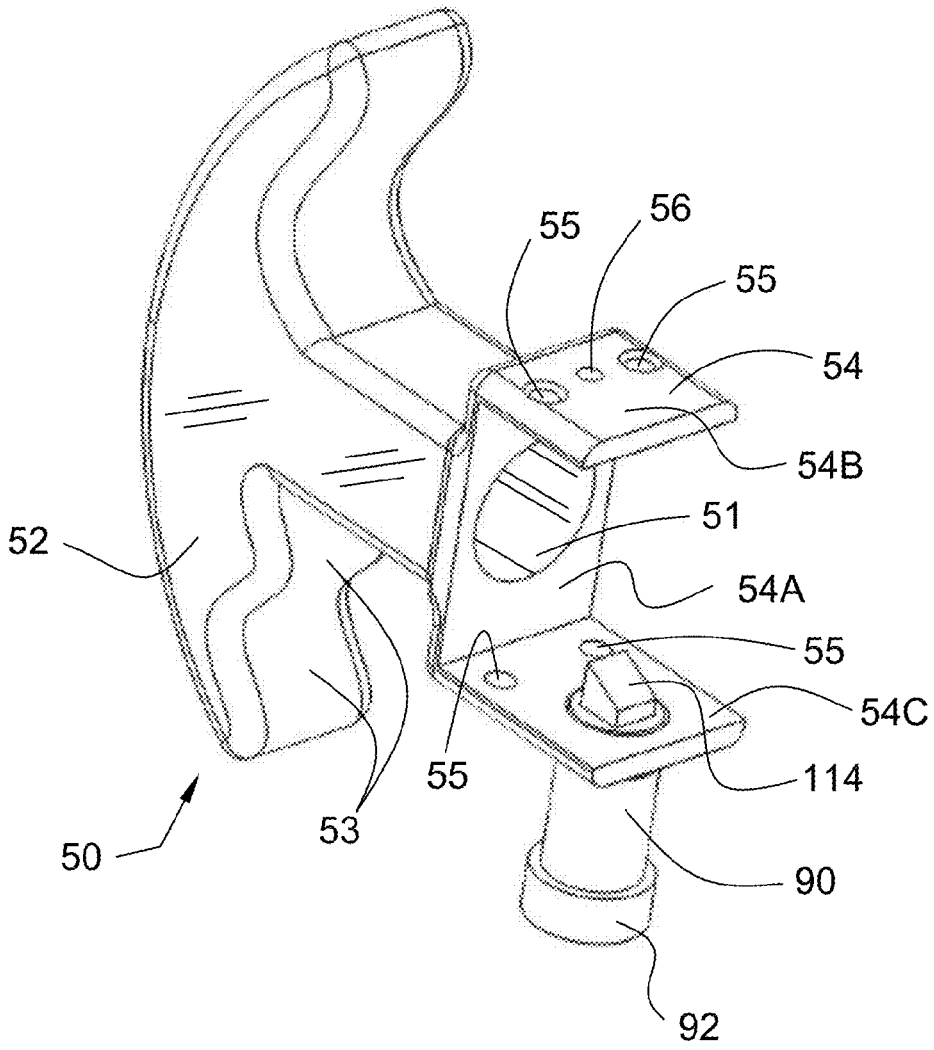
FIG. 20 is a perspective view of the handle subassembly of the magazine subassembly of FIG. 1B.

Now, with reference to FIGS. 16-20, the handle subassembly 50 of the rifle bow assembly will be described. Initially, referring to FIGS. 18 and 20, it can be seen that the handle subassembly 50 comprises an arc-shaped handle portion 52 for accommodating the hand of a user of the rifle bow 100. As shown in these figures, one side (i.e., the back side) of the arc-shaped handle portion 52 is generally curved, while the other side (i.e., the front side) of the arc-shaped handle portion 52 is provided with a plurality of grooves or indentations 53 for receiving the fingers of a user's hand. In the side view and perspective view of the handle subassembly 50 depicted in FIGS. 18 and 20, respectively, it can be seen that the handle subassembly 50 comprises a U-shaped portion 54 coupled to the arc-shaped handle portion 52. The U-shaped portion 54 of the handle subassembly 50 includes a base 54A, a first opposed leg 54B, and a second opposed leg 54C. The base 54A is attached to the handle portion 52. The opposed legs 54B, 54C, which are oppositely disposed on the opposed sides of the handle subassembly 50, are both coupled to the base 54A. As best illustrated in FIG. 30A, the space between the opposed legs 54B, 54C of the handle subassembly 50 accommodates an end portion of the magazine subassembly 40 (i.e., the end portion of the magazine subassembly body portion 42 is received within the space bounded by the two opposed leg portions 54B, 54C). The U-shaped portion 54 of the handle subassembly 50 slips over the end portion of the magazine subassembly body portion 42. Referring collectively to FIGS. 16 and 18-20, it can be seen that the opposed legs 54B, 54C of the U-shaped portion 54 of the handle subassembly 50 are provided with a plurality of countersink fastener apertures 55 disposed therethrough for receiving fasteners that secure the handle subassembly 50 to the magazine subassembly body portion 42 (i.e., the apertures 55 are generally aligned with the apertures 46 in the magazine subassembly body portion 42). Also, as shown in FIGS. 16 and 20, the opposed leg 54B of the handle U-shaped portion 54 comprises a fastener aperture 56 disposed therethrough for accommodating the fastener 198 of the safety subassembly 196 that secures the safety subassembly 196 to the handle subassembly 50. With reference to FIGS. 18-20, it can be seen that the oppositely disposed leg 54C accommodates the handle assembly locking mechanism 90 thereon. An end portion of the handle assembly locking mechanism 90 is received within the circular locking mechanism aperture 89 that is disposed through the opposed leg 54C (refer to FIG. 30A).

Figure 49:
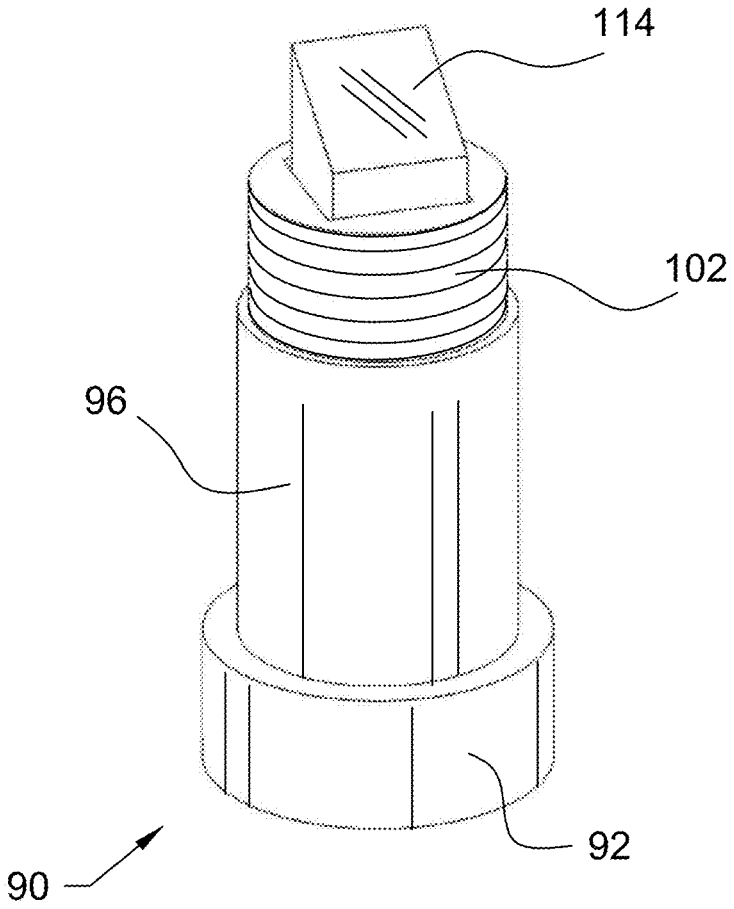
FIG. 49 is a perspective view of a handle assembly locking mechanism of the rifle bow assembly of FIG. 1B.
Figure 50:
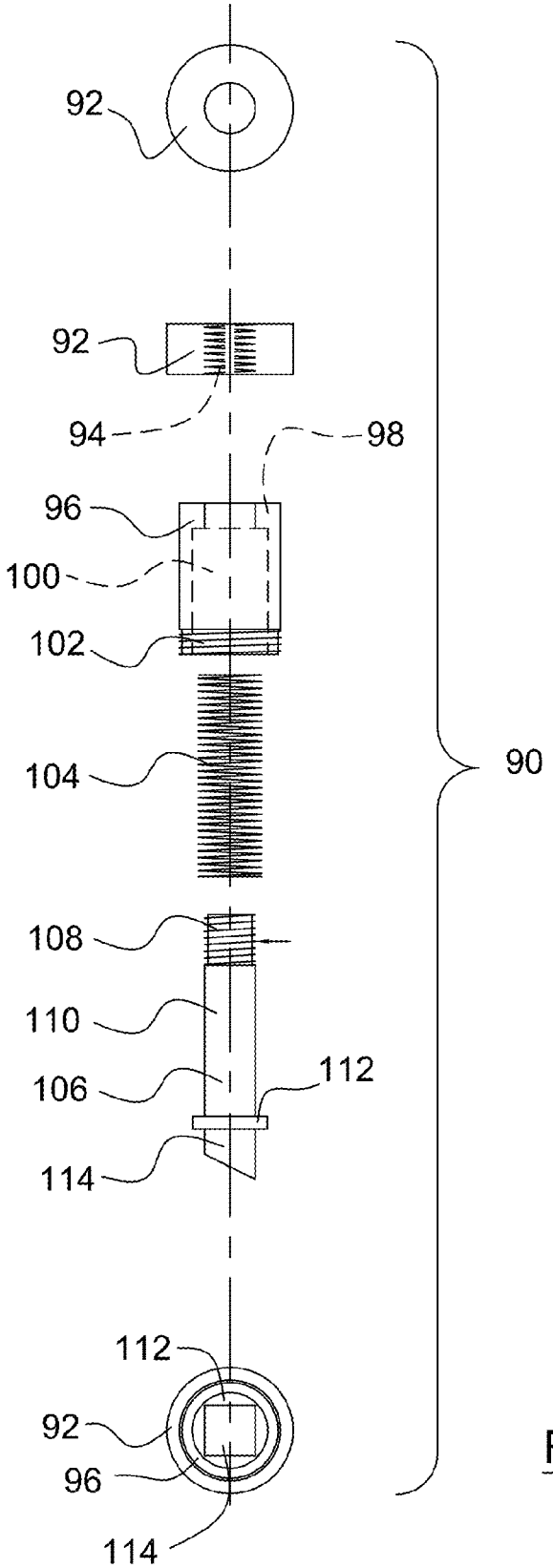
FIG. 50 is an exploded view of the handle assembly locking mechanism of FIG. 49.

The handle assembly locking mechanism 90 removably couples the magazine subassembly 40, handle subassembly 50, the release subassembly 136, 146, 168, 180, and the safety subassembly 196, which are all assembled together, to the rear end portion of the projectile barrel subassembly 30. With reference to FIGS. 49 and 50, the constituent components of the illustrative handle assembly locking mechanism 90 will be described. Initially, referring to the exploded view of FIG. 50, it can be seen that the handle assembly locking mechanism 90 generally comprises a displaceable end cap 92, an outer housing portion 96, a locking mechanism spring 104, and a central bolt member 106. With continued reference to FIG. 50, it can be seen that the central bolt member 106 of the handle assembly locking mechanism 90 comprises a shaft 110 with an externally threaded first end 108 and a beveled second end 114, which is disposed opposite to the threaded first end 108 thereof. As shown in FIG. 50, the central bolt member 106 further comprises a collar portion 112 disposed proximate to its beveled second end 114. The externally threaded first end 108 of the central bolt member 106 threadingly engages corresponding internal threads 94 on the end cap 92. Also, as illustrated in FIG. 50, the outer housing portion 96 of the handle assembly locking mechanism 90 comprises a base annular portion 98 with a central aperture for allowing the passage of the bolt shaft 110 therethrough. The outer housing portion 96 further comprises an internal cylindrical bore 100 for accommodating the locking mechanism spring 104 and the bolt shaft 110 therein. When the threaded first end 108 of the central bolt member 106 is engaged with the internal threads 94 on the end cap 92, the locking mechanism spring 104 is sandwiched between the collar portion 112 of the central bolt member 106 and the internal surface of the base annular portion 98 of the outer housing 96. With combined reference to FIGS. 49 and 50, it can be seen that the end of the outer housing 96, which is proximate to the beveled end 114, is provided with a plurality of external threads 102 that threadingly engage corresponding internal threads in the aperture 89 of the opposed leg 54C of the handle subassembly 50. This engagement between the external threads 102 of the outer housing 96 and the internal threads in the aperture 89 of the opposed leg 54C securely attaches the handle assembly locking mechanism 90 to the handle assembly 50.

As explained above, the handle assembly locking mechanism 90 releasably couples the magazine subassembly 40, handle subassembly 50, the release subassembly, and the safety subassembly 196, which are all assembled together, to the rear end portion of the projectile barrel subassembly 30. Advantageously, the removal of these subassemblies 40, 50, 136, 146, 168, 180, 196 from the rear end portion of the projectile barrel subassembly 30 allows the user to gain access to the helical projectile passageway 32 of the projectile barrel subassembly 30 (e.g., to clean the projectile passageway 32, etc.). To engage the subassemblies 40, 50, 136, 146, 168, 180, 196 with the rear end portion of the projectile barrel subassembly 30, a user simply slips the magazine subassembly body portion 42 over the rear end portion of the projectile barrel subassembly 30 until the beveled end 114 of the locking mechanism 90 clicks into place in notch 39 of the projectile barrel subassembly 30. As explained above, the ramp 36 in the second end 30B of the projectile barrel subassembly 30 helps facilitate the engagement of the beveled end 114 of the locking mechanism 90 with the notch 39 of the projectile barrel subassembly 30 (i.e., the ramp 36 helps inwardly displace the beveled end 114 of the locking mechanism 90 before it snaps into place in the notch 39. In the locked position of the locking mechanism 90, the beveled end 114 of the central bolt member 106 is engaged with the engagement aperture 274 in the magazine subassembly body portion 42 (see FIGS. 14A and 14C) and the engagement notch 39 in the rear end portion of projectile barrel subassembly 30 (see FIGS. 9, 10, and 12). The locking mechanism spring 104 biases the locking mechanism 90 in a locked position, wherein the beveled end 114 thereof is engaged with the engagement notch 39 of projectile barrel subassembly 30. In order to disengage the subassemblies 40, 50, 136, 146, 168, 180, 196 from the rear end portion of the projectile barrel subassembly 30, a user pulls outwardly on the end cap 92 (i.e., applies an outward axial force thereto) in order to disengage the beveled end 114 of the locking mechanism 90 from the engagement notch 39 of projectile barrel subassembly 30 so that the attached subassemblies 40, 50, 136, 146, 168, 180, 196 can be slid off the rear end portion of projectile barrel subassembly 30. When the user pulls outwardly on the end cap 92 of the locking mechanism 90, the locking mechanism spring 104 is compressed, and the beveled end 114 of the locking mechanism 90 is raised from engagement with the notch 39, thereby allowing the attached subassemblies 40, 50, 136, 146, 168, 180, 196 to be removed from projectile barrel subassembly 30. Advantageously, the locking mechanism 90 provides a toolless means by which the subassemblies 40, 50, 136, 146, 168, 180, 196 can be attached to, and detached from the projectile barrel subassembly 30.

Figure 31:
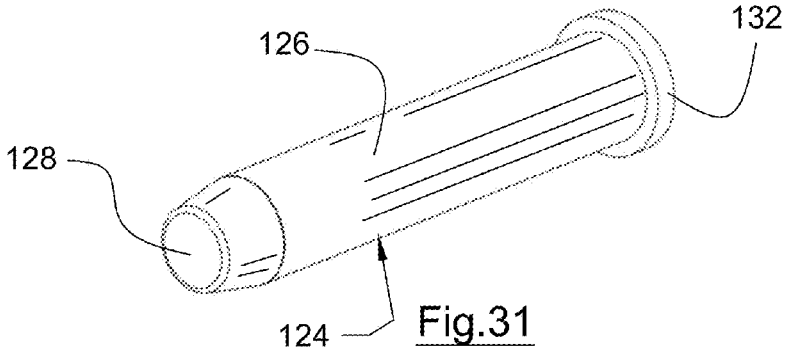
FIG. 31 is a perspective view of a chamber insert member of the rifle bow assembly of FIG. 1B.
Figure 32A:
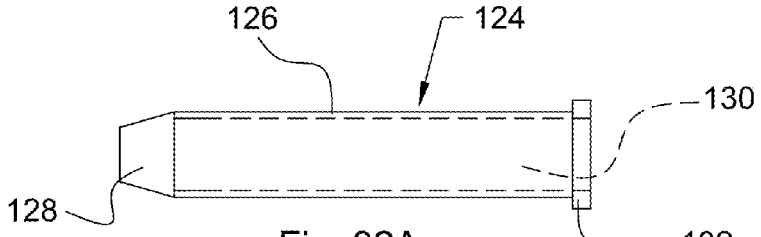
FIG. 32A is a side view of the chamber insert member of FIG. 31.
Figure 32B:
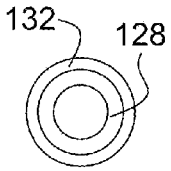
FIG. 32B is a front end view of the chamber insert member of FIG. 31.
Figure 32C:
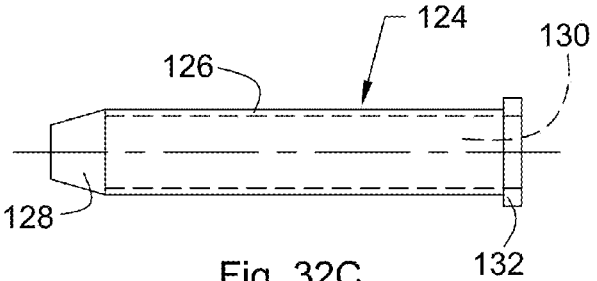
FIG. 32C is another side view of the chamber insert member of FIG. 31.
Figure 32D:
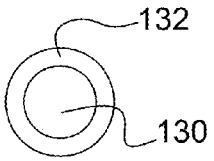
FIG. 32D is a rear end view of the chamber insert member of FIG. 31.
Figure 33:
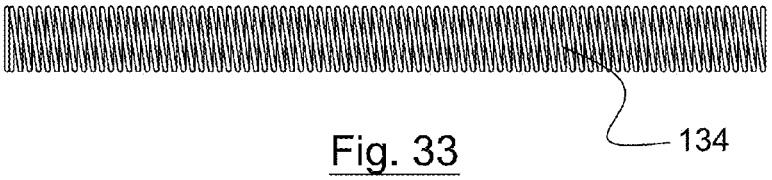
FIG. 33 is a side view of a spring of the chamber insert member of FIG. 31.

Initially referring to FIG. 30A, it can be seen that the handle subassembly 50 further includes a chamber insert member 124 that is slidingly received within a cylindrical spring cavity 51 of the handle portion 52 (see e.g., FIGS. 16 and 18-20). Immediately after a projectile 70 is launched from the rifle bow 100, the chamber insert member 124 springs into the portion of the projectile passageway 32 of the projectile barrel subassembly 30 that is adjacent to the magazine aperture 38 so as to prevent the next projectile 70 in the projectile magazine 60 from prematurely entering into the projectile passageway 32 before the bow string 91 is in a fire-ready position. Now, with reference to FIGS. 31, 32A-32D, and 33, the structure of the chamber insert member 124 will be described. As shown in the perspective view of FIG. 31, the chamber insert member 124 generally comprises a cylindrical body portion 126 with a beveled front end 128 and flanged second end 132. As best illustrated in FIGS. 32A, 32C, and 32D, the chamber insert member 124 additionally comprises a cylindrical spring cavity 130 disposed therein for receiving a helical compression spring 134 therein. In one exemplary embodiment, the helical compression spring 134 is formed from American Society for Testing and Materials (ASTM) 228 music wire with a wire diameter of approximately 0.090 inches, and the spring 134 comprises square and flat ends and two dead coils. However, in other embodiments, the spring 134 may be constructed from other suitable materials, and may have other suitable characteristics. The helical compression spring 134 biases the chamber insert member 124 in a chamber-filling position so as to prevent the next projectile 70 in the projectile magazine 60 from prematurely entering the projectile passageway 32. The beveled front end 128 of the chamber insert member 124 facilitates the insertion of the chamber insert member 124 into the projectile passageway 32, while the flanged second end 132 of the chamber insert member 124 prevents the chamber insert member 124 from being displaced too far into the projectile passageway 32 (i.e., the outer diameter of the flanged second end 132 is greater than the diameter of the circular aperture 48 of the magazine subassembly body portion 42 thereby only allowing the portion of the chamber insert member 124 in front of the flange 132 to enter the projectile passageway 32). Although, when the bow string 91 is pulled back into its fire-ready position (i.e., when it is engaged with string release member 136), the bow string 91 compresses the spring 134, thereby pushing the chamber insert member 124 into the cylindrical spring cavity 51 of the handle portion 52 so that the next projectile 70 in the projectile magazine 60 is now capable of entering the projectile passageway 32. Then, after the trigger 180 is pulled, and the bow string 91 is released, the spring force of the spring 134 propels the chamber insert member 124 back into the projectile passageway 32 so as to prevent the next projectile 70 from prematurely entering into the passageway 32.

Now, with reference to FIGS. 30A and 34-43B, the release/trigger subassembly 136, 146, 168, 180 of the rifle bow assembly will be explained. Initially, as shown in the exploded view of FIG. 30A, it can be seen that the release/trigger subassembly comprises two symmetrically arranged release mechanisms that are attached to opposed sides of the magazine subassembly body portion 42. Each of the two symmetrically arranged release mechanisms generally comprises a pivotable string release member 136 for selectively engaging the bow string 91, a housing base plate 146, and a housing cover plate 168. Each pivotable string release member 136 is enclosed within the housing base plate 146 and the housing cover plate 168. The release/trigger subassembly also generally comprises a trigger mechanism 180 for releasing the engagement of each string release member 136 with the bow string 91 so that the projectile 70 can be propelled down the projectile passageway 32 by the action of the bow string 91. When the trigger mechanism 180 is actuated by a user (i.e., when a user pulls back on the trigger mechanism 180), the opposed ends of the legs 184 of the trigger mechanism 180 are brought out of engagement with the respective pivotable string release members 136 so that the pivotable string release members 136 are free to rotate, and thereby release the bow string 91 from engagement therewith. That is, when the user pulls back on the trigger mechanism 180, the legs 184 of the trigger mechanism 180 simultaneously depress their respective springs 192, and the pivotable string release members 136 are disengaged from the bow string 91, thereby allowing the bow string 91 to propel the projectile 70 from the first end 30A of the projectile barrel subassembly 30. The springs 192 bias the trigger mechanism 180 in an engaged position (i.e., in a position in which the pivotable string release members 136 retain the bow string 91 in a pulled-back, restrained position).

Figure 34:
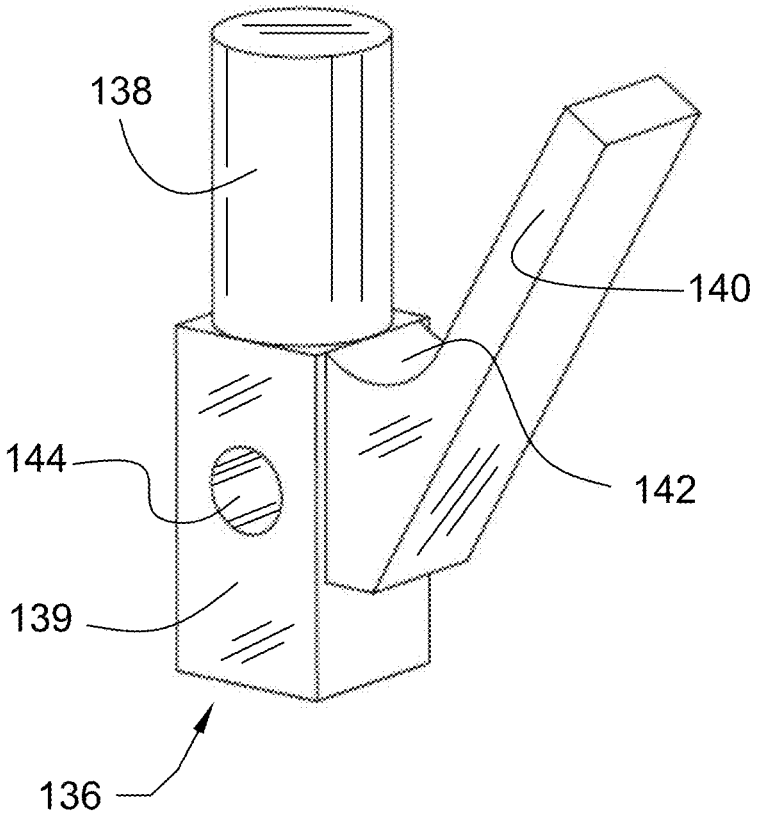
FIG. 34 is a perspective view of a string release member of the string release subassembly of FIG. 30A.
Figure 35A:
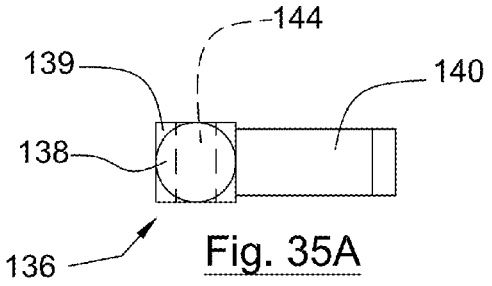
FIG. 35A is a top view of the string release member of FIG. 34.
Figure 35B:
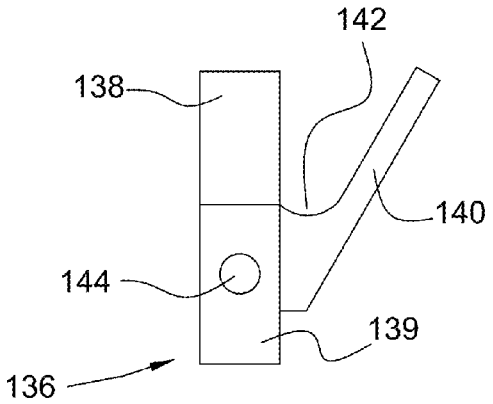
FIG. 35B is a front view of the string release member of FIG. 34.
Figure 35C:
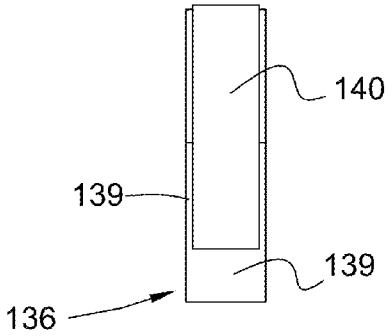
FIG. 35C is an end view of the string release member of FIG. 34.
Figure 35D:
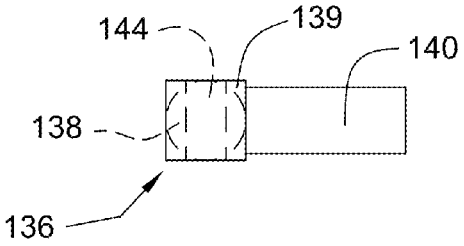
FIG. 35D is a bottom view of the string release member of FIG. 34.

Next, with particular reference to FIGS. 34-43B, each of the components of the release/trigger subassembly 136, 146, 168, 180 will be described in detail. First, as shown in FIGS. 34 and 35A-35D, each pivotable string release member 136 generally comprises a cylindrical portion 138, a square body portion 139, and a diagonally extending arm 140. The square body portion 139 of each pivotable string release member 136 comprises a rod or axle aperture 144 for receiving a pivot rod or axle 156 about which the pivotable string release member 136 rotates. Also, as best shown in FIGS. 34 and 35B, the diagonally extending arm 140 includes a curved notch 142 for accommodating the bow string 91 in the engaged position of the release/trigger subassembly. In the engaged position, the bow string 91 lies in the curved notch 42 between the cylindrical portion 138 and the diagonally extending arm 140. As depicted in the illustrative embodiment, the cylindrical portion 138 of each pivotable string release member 136 has a circular sidewall for accommodating the wrapping of the bow string 91 therearound, and to prevent the degradation of the bow string 91 by alleviating sharp edges in contact with the bow string 91. In addition, as best shown in FIGS. 34, 35A, and 35D, the width of the diagonally extending arm 140 is slightly less than that of the square body portion 139 in order to provide a clearance between the diagonally extending arm 140 and the recess surfaces of the housing plates 146, 168 when the pivotable string release member 136 is rotating within its housing.

Figure 36:
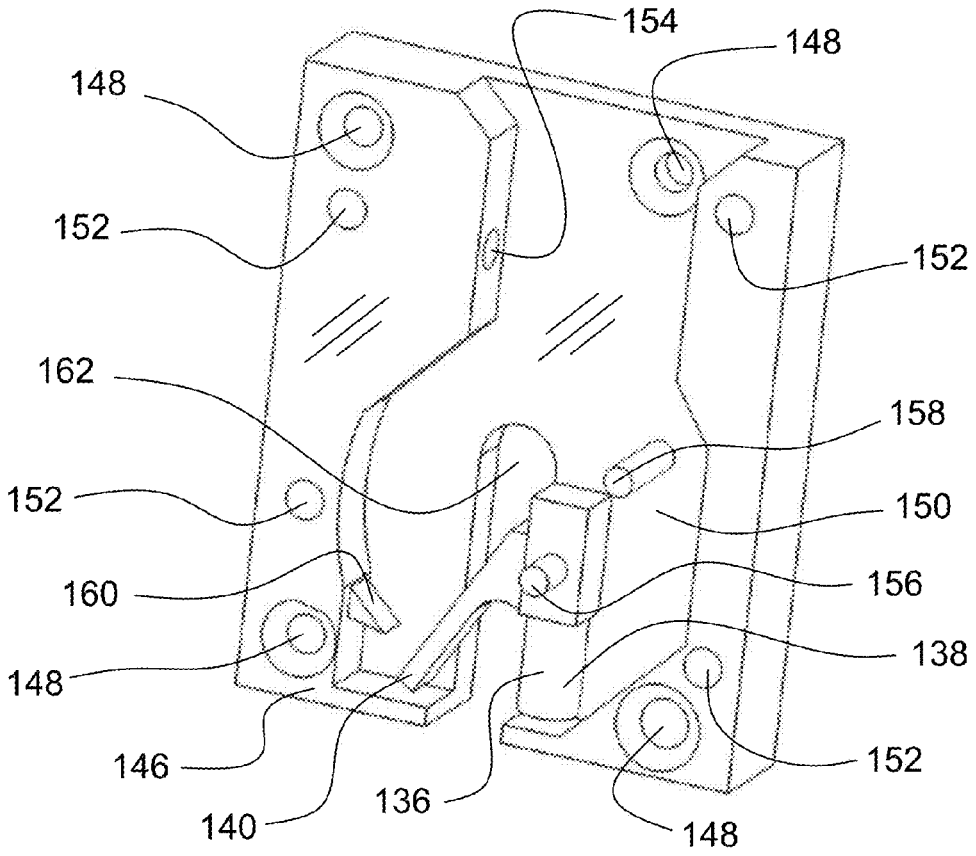
FIG. 36 is a perspective view of the string release member of FIG. 34 disposed inside a recess of a housing base plate.
Figure 37B:
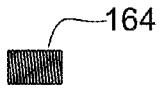
FIG. 37B is a side view of a trigger spring of the string release subassembly of FIG. 30A.
Figure 37A:
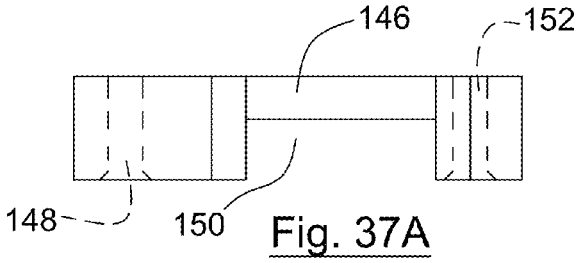
FIG. 37A is a top view of the housing base plate of FIG. 36.
Figure 37C:
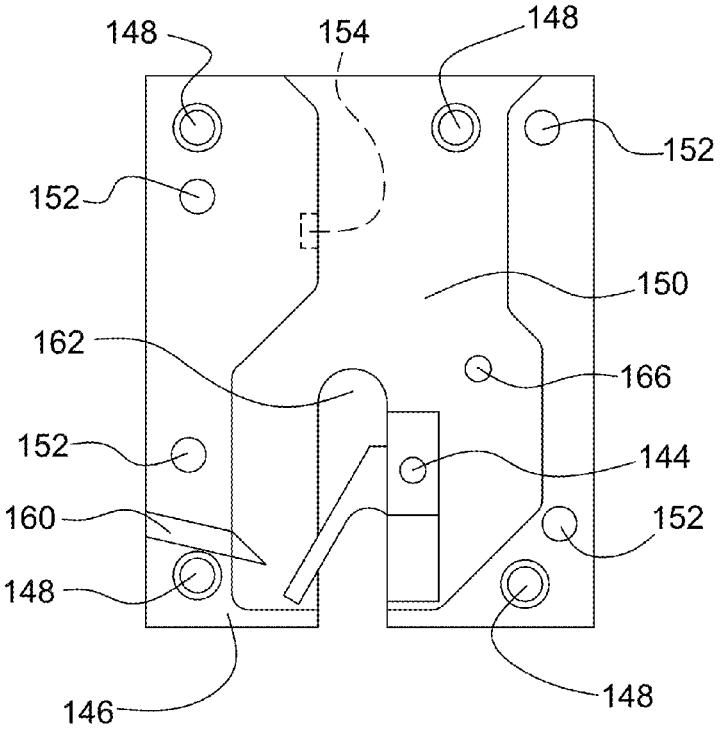
FIG. 37C is a front view of the string release member and the housing base plate of FIG. 36.
Figure 37D:
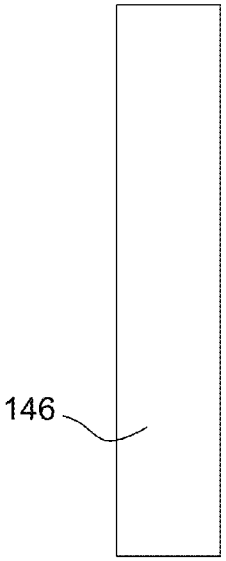
FIG. 37D is an end view of the housing base plate of FIG. 36.

Turning to FIGS. 36 and 37A-37D, the features of the housing base plate 146 of the release/trigger subassembly will now be explained. Initially, referring to the perspective view of FIG. 36, it can be seen that the housing base plate 146 comprises a plurality of countersink fastener apertures 148 for receiving fasteners for securing each housing base plate 146 to a respective side of the magazine subassembly body portion 42 (i.e., the fastener apertures 148 in the housing base plate 146 generally align with the fastener apertures 41 in opposed sides of the magazine subassembly body portion 42). Each housing base plate 146 further includes a plurality of fastener apertures 152 for receiving fasteners that secure each housing cover plate 168 to its respective housing base plate 146 (i.e., the fastener apertures 152 in the housing base plate 146 generally align with the fastener apertures 174 in housing cover plate 168). Also, it can be seen in FIG. 36 that each housing base plate 146 comprises a central cavity or recess portion 150 for accommodating the respective pivotable string release members 136. As shown in FIGS. 36 and 37C, a bounding side of the central cavity 150 of the housing base plate 146 comprises a cylindrical spring bore 154 for accommodating one of the trigger handle springs 164 (see FIG. 37B), which spring 164 is also received within the trigger spring bore 194 in the leg portion 184 of the trigger mechanism 180. In FIG. 36, it can be seen that the pivotable string release member 136 rotates about the pivot rod or pin 156, which is received within a bore in the bottom surface of the central cavity 150. A pivot rod or pin 158 for the trigger mechanism 180 is received within another bore 166 disposed in the bottom surface of the central cavity 150. The pivot rod or pin 158 is also received within the aperture 188 in the leg portion 184 of the trigger mechanism 180 with sufficient clearance such that the trigger mechanism 180 is able to pivot about the pivot rod 158 when the trigger mechanism 180 is pulled back by a user of the rifle bow. As best depicted in FIGS. 36 and 37C, a bounding side of the central cavity 150, which is disposed proximate to the pivotable string release member 136 comprises a wedge-like motion restriction tab 160 that prevents the free rotation of the pivotable string release member 136 after it has become disengaged from the bow string 91. Preferably, the wedge-like motion restriction tab 160 is formed from a resilient material (e.g., a resilient rubber material) that is capable of being elastically deformed by the diagonally-extending arm 140 of the pivotable string release member 136, and then snapping back into shape. After the trigger mechanism 180 is released, the diagonally-extending arm 140 of the pivotable string release member 136 passes over the diagonal surface of the motion restriction tab 160 until reaching its final disengaged position. In the disengaged position of the pivotable string release member 136, the flat surface of the motion restriction tab 160 engages the end of the diagonally-extending arm 140 so as to prevent the pivotable string release member 136 from freely rotating about the pivot rod or pin 156. Although, when the pivotable string release member 136 is rotated back into the engaged position with the bow string 91, the force of the bow string 91 against the diagonally-extending arm 140 is sufficient to elastically deform the wedge-like motion restriction tab 160 so that the pivotable string release member 136 can be rotated back to its engaged position with the bow string 91. In FIGS. 36 and 37C, it can be seen that the housing base plate 146 comprises a bow string slot 162 disposed therein for receiving the passage of the bow string 91. When the pivotable string release member 136 is engaged with the bow string 91, the bow string 91 is disposed in the rounded end portion of the bow string slot 162.

Figure 38:
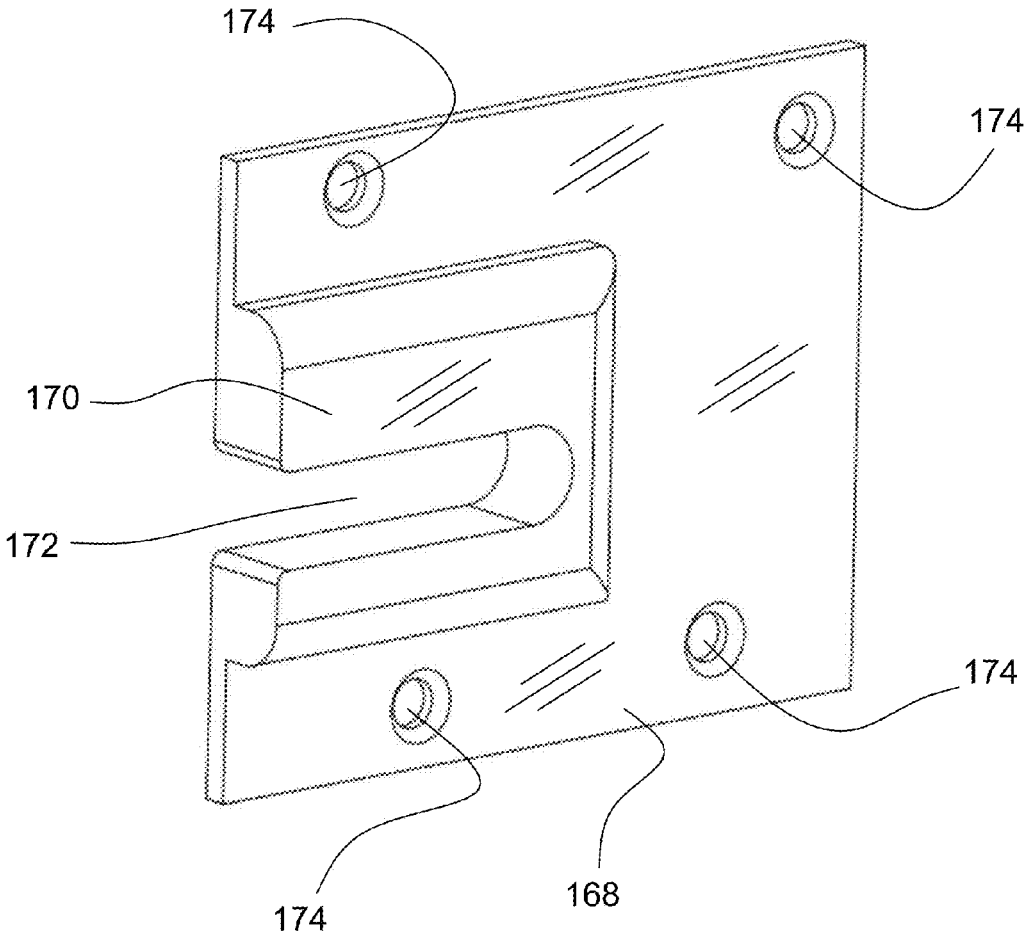
FIG. 38 is a perspective view of the housing cover plate of the string release subassembly of FIG. 30A.
Figure 39A:
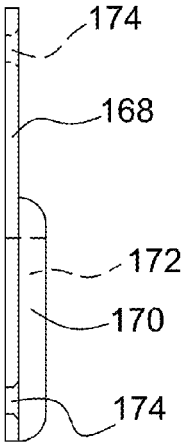
FIG. 39A is a side view of the housing cover plate of FIG. 38.
Figure 39B:
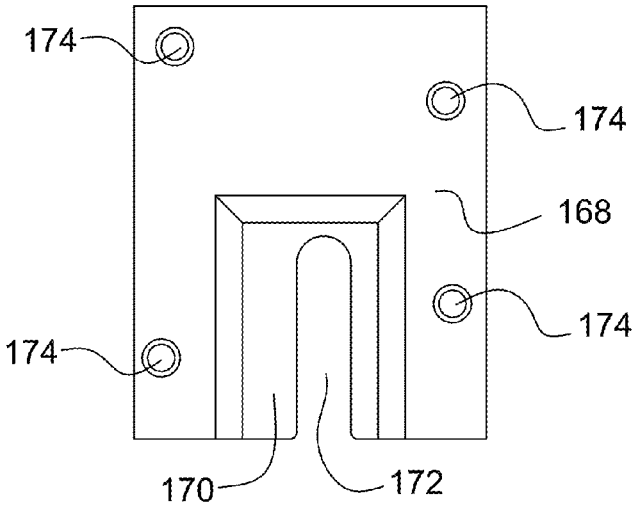
FIG. 39B is a front view of the housing cover plate of FIG. 38.
Figure 39C:
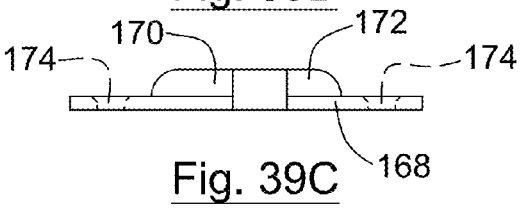
FIG. 39C is an end view of the housing cover plate of FIG. 38.
Figure 39D:
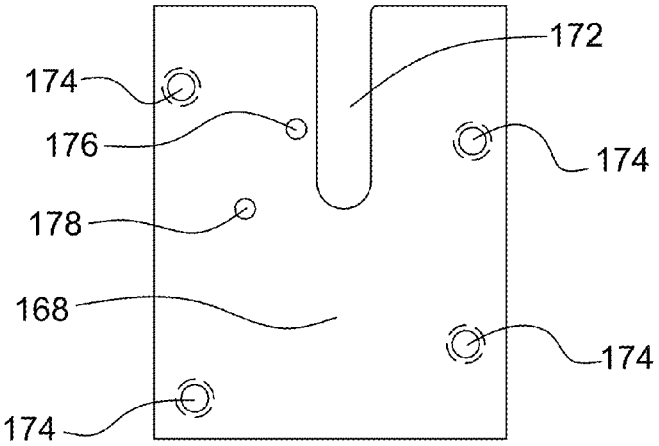
FIG. 39D is a rear view of the housing cover plate of FIG. 38.

Next, with reference to FIGS. 38 and 39A-39D, the features of the housing cover plate 168 of the release/trigger subassembly will be described. Initially, referring to the perspective view of FIG. 38, it can be seen that the housing cover plate 168 comprises a plurality of countersink fastener apertures 174 for receiving fasteners for securing each housing cover plate 168 to its respective housing base plate 146 (i.e., the fastener apertures 174 in the housing cover plate 168 generally align with the fastener apertures 152 in the housing base plate 146). As best shown in the perspective view of FIG. 38, the top surface of the housing cover plate 168 comprises a raised portion 170 for accommodating the extending lengths of the pivot rods 156, 158 of the pivotable string release member 136 and the trigger mechanism 180, respectively (i.e., the housing cover plate 168 must be sufficiently thick to accommodate the end portions of these pivot rods 156, 158). The outer end portions of the pivot rods 156, 158 are received within respective cylindrical bores 176, 178 in the rear surface of the housing cover plate 168 (see FIG. 39D). In FIGS. 38, 39B, and 39D, it can be seen that the raised portion 170 of the housing cover plate 168 comprises a bow string slot 172 disposed therethrough, which is generally aligned with the bow string slot 162 of the housing base plate 146. As described above for the bow string slot 162 of the housing base plate 146, the bow string 91 is disposed in the rounded end portion of the bow string slot 172 when the pivotable string release member 136 is engaged with the bow string 91.

Figure 40:
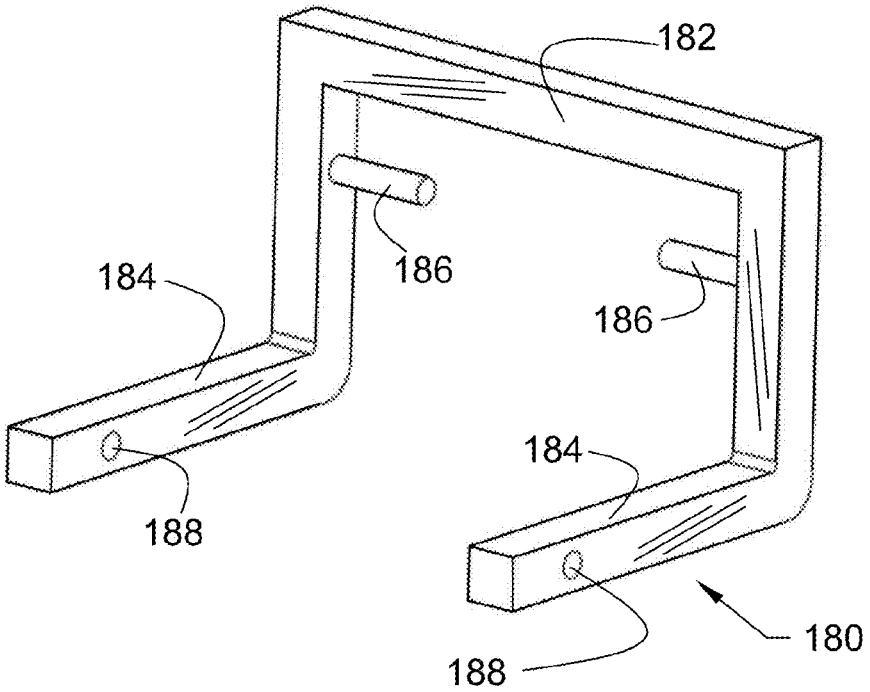
FIG. 40 is a perspective view of a trigger mechanism of the string release subassembly of FIG. 30A.
Figure 41A:
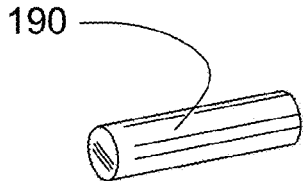
FIG. 41A is a perspective view of a trigger pivot pin of the string release subassembly of FIG. 30A.
Figure 41B:
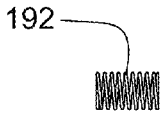
FIG. 41B is a side view of a trigger spring member of the string release subassembly of FIG. 30A.
Figure 42A:
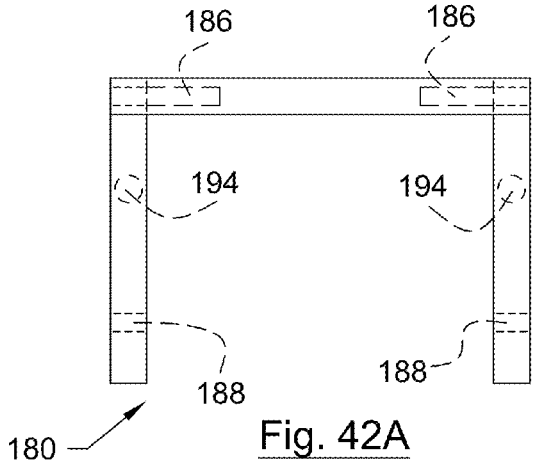
FIG. 42A is a top view of the trigger mechanism of FIG. 40.
Figure 42B:
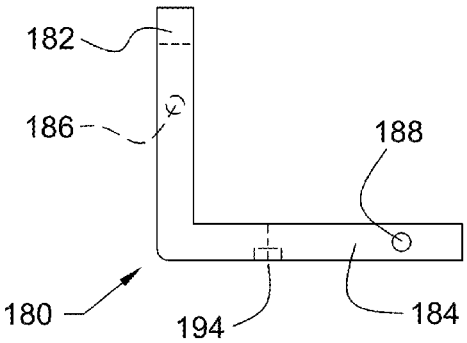
FIG. 42B is an end view of the trigger mechanism of FIG. 40.
Figure 42C:
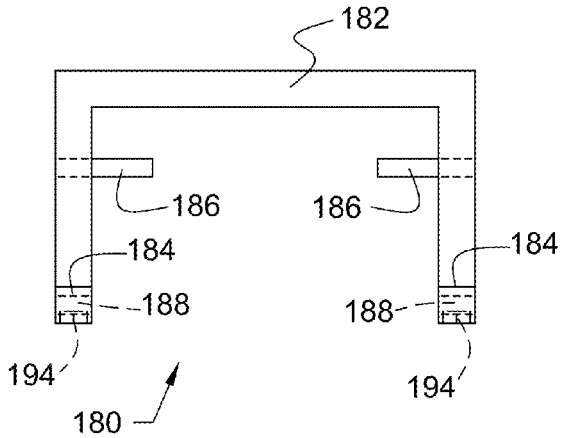
FIG. 42C is a side view of the trigger mechanism of FIG. 40.
Figure 43A:
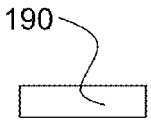
FIG. 43A is a side view of the trigger pivot pin of FIG. 41A.
Figure 43B:
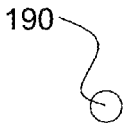
FIG. 43B is an end view of the trigger pivot pin of FIG. 41A.

The trigger mechanism 180 of the release/trigger subassembly will be described with reference to FIGS. 40, 41A-41B, 42A-42C, and 43A-43B. First, referring to the perspective view of FIG. 40, it can be seen that the trigger mechanism 180 generally comprises a U-shaped portion 182 with leg portions 184 attached to the respective opposed ends of the U-shaped portion 182. As best shown in the side view of FIG. 42B, each leg portion 184 is disposed generally perpendicular to the U-shaped portion 182 of the trigger mechanism 180. Referring collectively to FIGS. 40 and 42C, it can be seen that the U-shaped portion 182 of the trigger mechanism 180 comprises a pair of cylindrical projections 186 disposed on respective inner surfaces of the U-shaped portion 182 (i.e., the cylindrical projections 186 extend in an axial direction towards one another). The cylindrical projections 186 on the trigger mechanism 180 are designed to engage the trigger safety subassembly 196, as will be described in more detail hereinafter. Also, as illustrated in FIGS. 40 and 42A-42C, each of the opposed leg portions 184 of the trigger mechanism 180 comprises a respective aperture 188 disposed therein for receiving a respective trigger pivot rod or pin 190 (see FIGS. 43A and 43B). As explained above, the trigger mechanism 180 pivots about these two (2) pivot rods or pins 190. In addition, as shown in FIGS. 42B and 42C, each of the opposed leg portions 184 of the trigger mechanism 180 comprises a respective trigger spring bore 194 disposed in a respective bottom surface thereof for receiving a respective trigger spring member 192 (refer to FIG. 41B). As described above, the two trigger spring members 192 bias the trigger mechanism 180 in an engaged position with the end portion of the square body portion 139 of the pivotable string release member 136, wherein the bow string 91 is held in an engaged state (i.e., a fire-ready state) by means pivotable string release member 136.

Figure 44A:
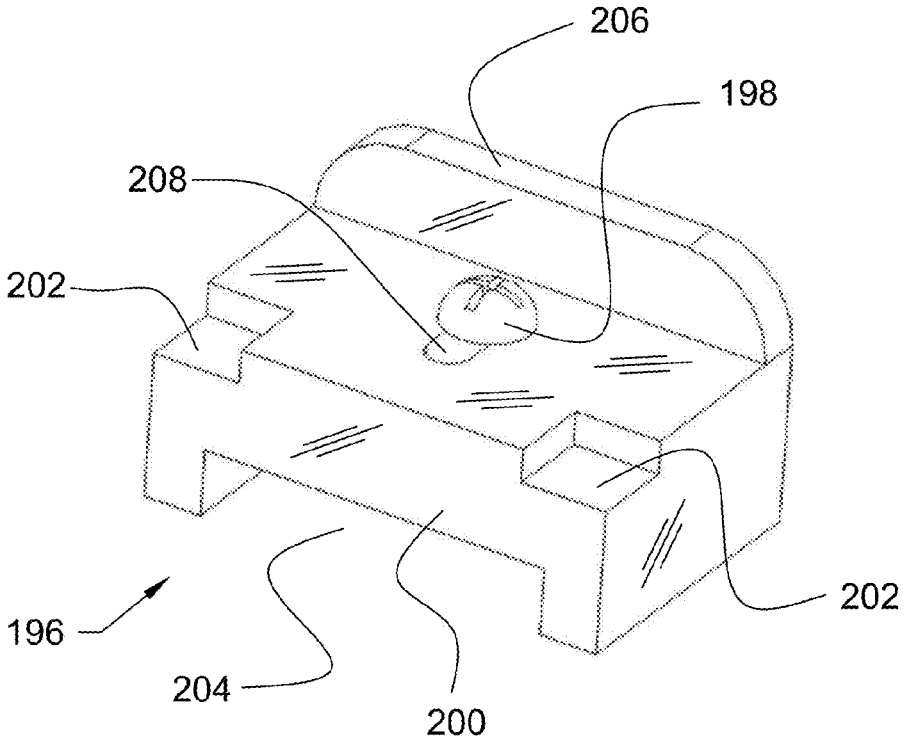
FIG. 44A is a perspective view of a string release safety subassembly of FIG. 30A.
Figure 44B:
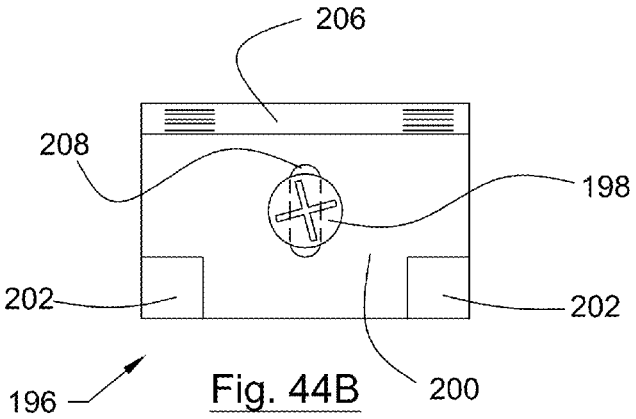
FIG. 44B is a top view of the string release safety subassembly of FIG. 44A.
Figure 44C:
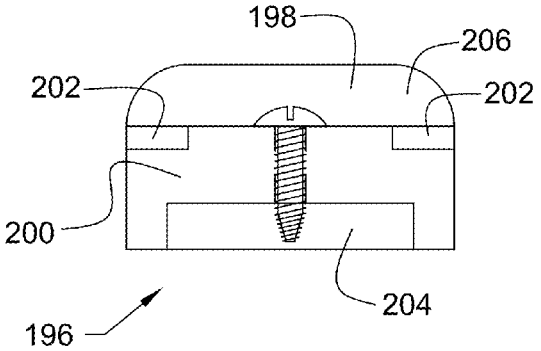
FIG. 44C is a front view of the string release safety subassembly of FIG. 44A.
Figure 44D:
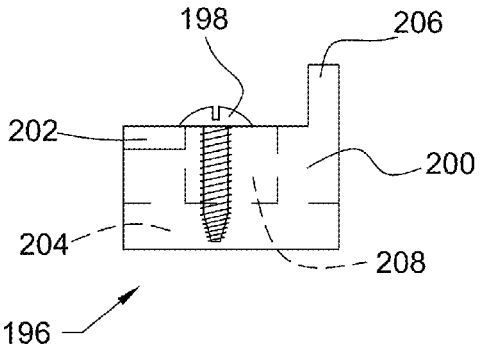
FIG. 44D is an end view of the string release safety subassembly of FIG. 44A.

The trigger safety subassembly 196 of the rifle bow 100 will now be explained with regard to FIGS. 44A-44D. Initially, referring to the perspective view of FIG. 44A, it can be seen that the trigger safety subassembly 196 generally comprises a body portion 200 with upper notches 202 disposed on opposite sides of the body portion 200. The upper side notches 202 are designed to receive the cylindrical projections 186 of the trigger mechanism 180 so as to prevent any significant rotation of the trigger mechanism 180, thereby preventing the rifle bow 100 from being inadvertently discharged by a user thereof. The bottom portion of the safety body portion 200 includes a lower central notch 204 in order to accommodate the thickness of the opposed leg portion 54B of the handle subassembly 50 therein. The upper surface of the safety body portion 200 additionally includes a finger grasping projection 206 in order to facilitate the grasping of the safety body portion 200 by a user thereof (i.e., to engage and disengage the trigger safety). Also, as best shown in FIGS. 44A, 44B, and 44D, the safety body portion 200 comprises a slot 208 with rounded ends for accommodating the fastener 198 (e.g., a phillips screw) that secures the safety body portion 200 to the opposed leg 54B of the handle U-shaped portion 54 (i.e., the fastener 198 passes through the slot 208 in the body portion 200 and then through the fastener aperture 56 in the opposed leg 54B of the handle portion 52). In one exemplary embodiment, the safety body portion 200 is formed as a one-piece or unitary component from a material, such as a hard polymer or a hard plastic. Although, in other embodiments, different materials and construction techniques are used for forming the safety body portion 200.

In order to engage the trigger safety 196, a user of the rifle bow 100 grasps the finger projection 206 of the body portion 200 and slides the body portion 200 rearwardly until the fastener 198 is generally disposed in the front, rounded end of the slot 208 (because the fastener 198 is fixed in place in the aperture 56 of the handle portion 52, the safety body portion 200 is able to slide relative to the fastener 198). Once the body portion 200 of the trigger safety 196 has been moved to its rearward position by the user, the rotation of the trigger mechanism 180 is essentially prevented by virtue of the engagement between the cylindrical projections 186 of the trigger mechanism 180 and the opposed notches 202 of the body portion 200. As such, the rifle bow 100 is unable to be discharged or fired until the trigger safety 196 is disengaged by the user. In order to disengage the trigger safety 196, the user of the rifle bow 100 grasps the finger projection 206 of the body portion 200 and slides the body portion 200 forwardly until the fastener 198 is generally disposed in the rear, rounded end of the slot 208. In this disengaged position, the trigger mechanism 180 is able to rotated without being obstructed by the trigger safety 196, and thus, the rifle bow 100 is capable of being fired by the user.

Figure 58A:
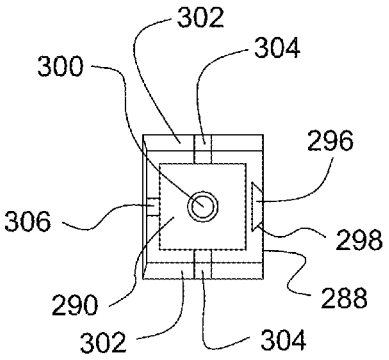
Figure 58B:
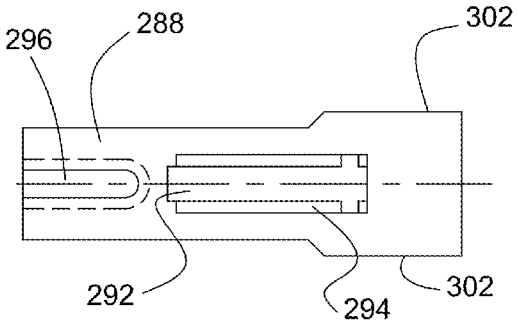
Figure 58C:
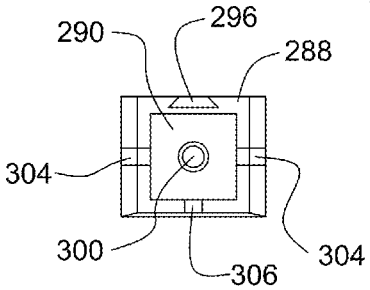
Figure 58D:
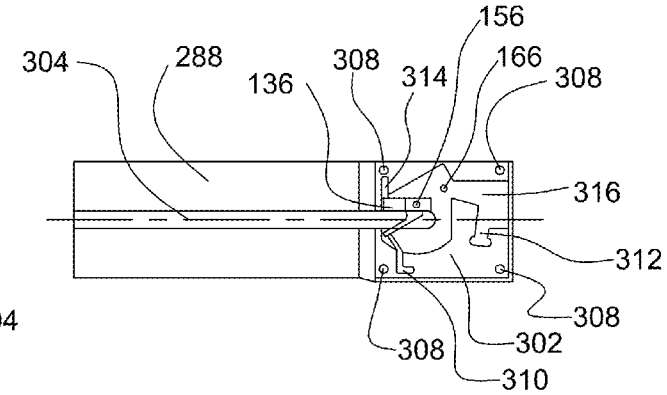
Figure 58E:
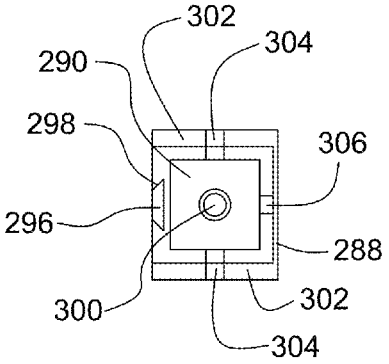
Figure 58F:
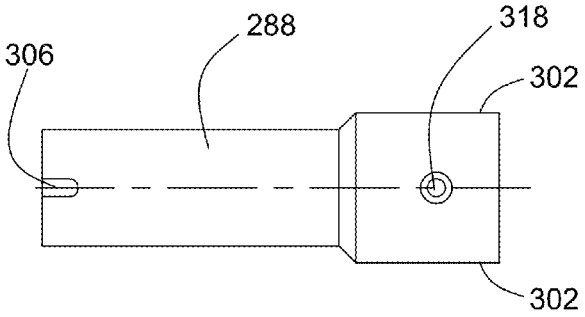
Figure 58G:
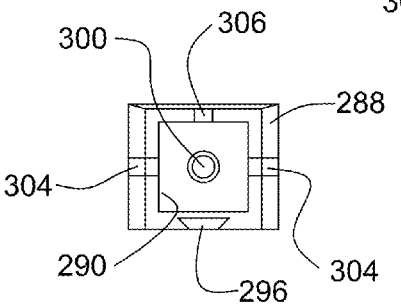
Figure 58H:
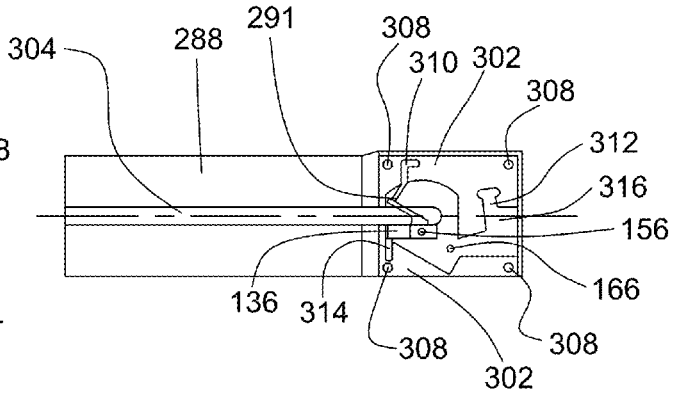

Now, a combination magazine subassembly and string release subassembly of an alternative embodiment of the rifle bow assembly will be described with reference to FIGS. 58A-58H. In general, the combination magazine subassembly and string release subassembly of FIGS. 58A-58H combines the magazine subassembly body portion 42 and the housing base plate 146 of the string release subassembly into a single unit to reduce the overall number of separate, constituent parts of the rifle bow assembly. Initially, referring to FIGS. 58A-58H, the body portion 288 of the combination magazine subassembly and string release subassembly will be explained. Like the magazine subassembly 40 described above, the combination magazine subassembly and string release subassembly slips over the second end portion of the projectile barrel subassembly. In particular, turning to FIGS. 58A, 58C, 58E, and 58G, it can be seen that the body portion 288 of the combination magazine subassembly and string release subassembly comprises an elongate cavity 290 that receives the second end portion of the projectile barrel subassembly. The body portion 288 of the combination magazine subassembly and string release subassembly also comprises a magazine aperture 292 that is configured to be generally aligned with at least a portion of the magazine aperture of the projectile barrel subassembly. In the side view of FIG. 58B, it can be seen that the magazine aperture 292 disposed in the body portion 288 comprises elongate ledges 294 disposed on opposite sides thereof for preventing the over-insertion of the projectile magazine 60' into the magazine aperture 292. In addition, as illustrated in FIGS. 58D and 58H, it can be seen that the top and bottom sides of the magazine subassembly body portion 288 comprise an elongate bow string slot 304 disposed along a length thereof. The elongate slot 304 of the magazine subassembly body portion 288 is configured to receive the bow string 91 therein, and the elongate slot 304 of the magazine subassembly body portion 288 is generally aligned with the elongate slot of the projectile barrel subassembly. Also, as shown in FIG. 58B, the magazine subassembly body portion 288 is provided with an elongate groove 296 for receiving the bottom portion of the magazine latching subassembly 254. As shown in FIGS. 58A and 58E, the elongate groove 296 is provided with tapered sides 298, which taper inwardly toward the outer side surface of the magazine subassembly body portion 288. Moreover, the magazine subassembly body portion 288 comprises a fastener access notch 306 for accommodating a tool (e.g., a shaft of tool) that is used to secure a fastener on the back side of the magazine latching subassembly 254. As illustrated in the end views of FIGS. 58A, 58C, 58E, and 58G, the fastener access notch 306 is substantially horizontally aligned with the elongate groove 296 that receives the bottom portion of the magazine latching subassembly 254, and the fastener access notch 306 is disposed in the side of the magazine subassembly body portion 288 that is generally opposite to the side containing the elongate groove 296. Furthermore, as shown in the end views of FIGS. 58A, 58C, 58E, and 58G, the rear wall of the magazine subassembly body portion 288 includes a circular aperture 300 disposed therein for accommodating the passage of the chamber insert member 124 therethrough. As shown in FIGS. 58A, 58C, 58E, and 58G, the circular aperture 300 comprises a collar or shoulder disposed therearound for engaging a flanged end of chamber insert member 124 so as to prevent the chamber insert member 124 from passing too far into the rifled projectile passageway of the projectile barrel subassembly. The structure and functionality of the chamber insert member 124 will be described in detail hereinafter. In addition, the magazine subassembly body portion 288 comprises an engagement aperture 318 disposed therein for receiving an end of the locking mechanism 90 that removably secures the combination magazine subassembly and string release subassembly to the projectile barrel subassembly. In the locked position of the locking mechanism 90, the end of the central bolt member 106 is engaged with the engagement aperture 318 in the magazine subassembly body portion 288.

The housing base plate of the string release subassembly is integrated into the combination magazine subassembly and string release subassembly of FIGS. 58A-58H. In particular, the magazine subassembly body portion 288 comprises string release body raised portions 302 disposed on opposite sides thereof (see e.g., FIGS. 58B and 58F) that accommodate the internal components of the release/trigger subassembly. Referring primarily to FIGS. 58D and 58H, the features of the string release body raised portions 302 of the release/trigger subassembly will now be explained. Initially, referring to these two figures, it can be seen that each string release body raised portion 302 includes a plurality of fastener apertures 308 for receiving fasteners that secure each housing cover plate 320 to its respective string release body raised portion 302 (i.e., the fastener apertures 308 in the string release body raised portion 302 generally align with the fastener apertures 326 in housing cover plate 320). Also, it can be seen in FIGS. 58D and 58H that each string release body raised portion 302 comprises a central cavity or recess portion 316 for accommodating the respective pivotable string release members 136. As shown in FIGS. 58D and 58H, a bounding side of the central cavity 316 of the string release body raised portion 302 comprises a spring notch 312 for accommodating one of the trigger handle springs 164 (see FIG. 37B), which spring 164 is also received within the trigger spring bore 194 in the leg portion 184 of the trigger mechanism 180. Similar to that described above in conjunction with the embodiment of FIG. 36, it can be seen that the pivotable string release member 136 rotates about the pivot rod or pin 156, which is received within a bore in the bottom surface of the central cavity 316. A pivot rod or pin 158 for the trigger mechanism 180 is received within another bore 166 disposed in the bottom surface of the central cavity 316. As best depicted in FIGS. 58D and 58H, a bounding side of the central cavity 316, which is disposed proximate to the pivotable string release member 136 comprises a motion restriction tab 310 that prevents the free rotation of the pivotable string release member 136 after it has become disengaged from the bow string 91. Preferably, the motion restriction tab 310 is formed from a resilient material (e.g., a resilient rubber material) that is capable of being elastically deformed by the diagonally-extending arm 140 of the pivotable string release member 136, and then snapping back into shape. On a bounding side of the central cavity 316 opposite to the side which contains the motion restriction tab 310, a bumper 314 is provided for cushioning a side of the cylindrical portion 138 of string release member 136. Like the motion restriction tab 310, the bumper 314 is preferably formed from a resilient material (e.g., a resilient rubber material). After the trigger mechanism 180 is released, the diagonally-extending arm 140 of the pivotable string release member 136 passes over the diagonal surface of the motion restriction tab 310 until reaching its final disengaged position. In the disengaged position of the pivotable string release member 136, the motion restriction tab 310 engages the end of the diagonally-extending arm 140 so as to prevent the pivotable string release member 136 from freely rotating about the pivot rod or pin 156. Also, as shown in FIGS. 58D and 58H, when the pivotable string release member 136 is in its disengaged position, the end of the cylindrical portion 138 of string release member 136 rests against the bumper 314. Although, when the pivotable string release member 136 is rotated back into the engaged position with the bow string 91, the force of the bow string 91 against the diagonally-extending arm 140 is sufficient to elastically deform the motion restriction tab 310 so that the pivotable string release member 136 can be rotated back to its engaged position with the bow string 91. When the pivotable string release member 136 is engaged with the bow string 91, the bow string 91 is disposed in the rounded end portion of the elongate bow string slot 304 in the magazine subassembly body portion 288.

Figure 59A:
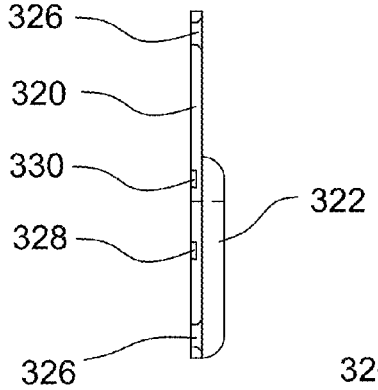
Figure 59B:
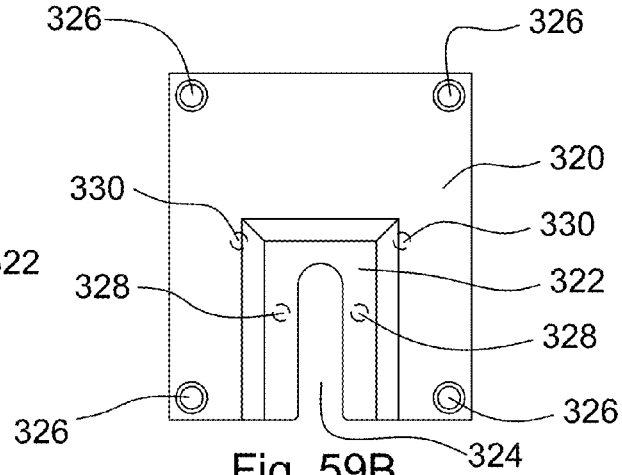
Figure 59C:
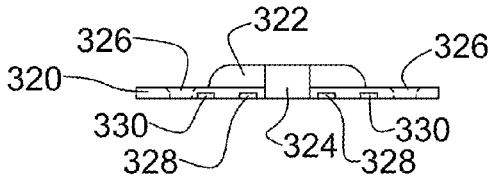
Figure 59D:
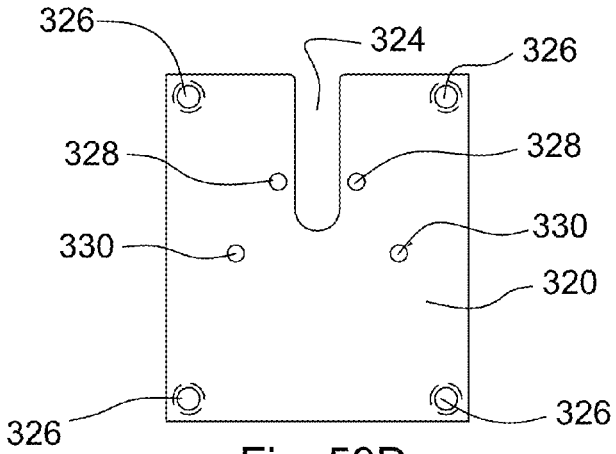

Next, with reference to FIGS. 59A-59D, the features of an alternative embodiment of a housing cover plate 320 of the release/trigger subassembly will be described. Initially, referring to the front view of FIG. 59B, it can be seen that the housing cover plate 320 comprises a plurality of countersink fastener apertures 326 for receiving fasteners for securing each housing cover plate 320 to its respective string release body raised portion 302 (i.e., the fastener apertures 326 in the housing cover plate 320 generally align with the fastener apertures 308 in the string release body raised portion 302). Also, as shown in FIGS. 59A-59C, the top surface of the housing cover plate 320 comprises a raised portion 322 for accommodating the extending lengths of the pivot rods 156, 158 of the pivotable string release member 136 and the trigger mechanism 180, respectively (i.e., the housing cover plate 320 must be sufficiently thick to accommodate the end portions of these pivot rods 156, 158). The increased thickness of the housing cover plate raised portion 322 also adds rigidity and strength to the housing cover plate 320. The outer end portions of the pivot rods 156, 158 are received within respective cylindrical bores 328, 330 in the rear surface of the housing cover plate 320 (see FIG. 59D). In FIGS. 59B and 59D, it can be seen that the raised portion 322 of the housing cover plate 320 comprises a bow string slot 324 disposed therethrough, which is generally aligned with the bow string slot 304 of the magazine subassembly body portion 288. As described above for the bow string slot 304 of the magazine subassembly body portion 288, the bow string 91 is disposed in the rounded end portion of the bow string slot 324 when the pivotable string release member 136 is engaged with the bow string 91. Advantageously, the housing cover plate 320 of FIGS. 59A-59D comprises a set of cylindrical bores 328, 330 disposed on each side of the bow string slot 324 (i.e., in a mirrored arrangement) so that the housing cover plate 320 is capable of being used as a universal cover plate in the rifle bow assembly (i.e., the housing cover plate 320 can be interchangeably used on both the top and bottom string release body raised portion 302 so that two independent plates are not required). Thus, the manufacturing and part costs of the rifle bow assembly may be reduced because unique cover plates are not required for both the top and bottom string release body raised portion 302.

Now, referring to FIGS. 60A-62C and 65C, an alternative embodiment of a handle subassembly of the rifle bow assembly will be described. As best shown in the assembly view of FIG. 65C, the handle subassembly generally includes a handle tubular member 332, a threaded end cap 338 disposed on the end of the handle tubular member 332, and a handle member 344 received on the handle tubular member 332. Initially, with reference to FIGS. 60A and 60B, the handle tubular member 332 of the handle subassembly will be explained. In the side view of FIG. 60B, it can be seen that the handle tubular member 332 comprises a first end 332*a*, a second end 332*b*, and a cylindrical passageway 334 disposed centrally through the handle tubular member 332 (see FIG. 60A). The cylindrical passageway 334 of the handle tubular member 332 accommodates the spring-biased chamber insert member 124 therein. The first end 332*a* of the handle tubular member 332 is affixedly secured to the magazine subassembly body portion 288 (e.g., by welding) and does not contain threads thereon, while the second end 332*b* of the handle tubular member 332 is provided with a plurality of external threads 336 disposed thereon for threadingly receiving the internal threads 342 of the threaded end cap 338. Advantageously, because the threaded end cap 338 is removable from the threaded second end 332*b* of the handle tubular member 332, the chamber insert member 124 disposed in the cylindrical passageway 334 of the handle tubular member 332 can be easily accessed for servicing and/or replacement, if necessary.

Turning to FIGS. 61A-61C, it can be seen that the threaded end cap 338 of the illustrative embodiment is generally hexagonal in shape with a plurality of sides 340 disposed about the circumference thereof. In addition, as depicted in FIGS. 61A-61C, the threaded end cap 338 comprises a plurality of internal threads 342 that threadingly engage with the plurality of external threads 336 on the second end portion of the handle tubular member 332. In the assembled state of the handle subassembly, the threaded end cap 338 is threadingly engaged with the handle tubular member 332 (see FIGS. 65A and 65C).

Next, as depicted in FIGS. 62A-62C, it can be seen that the handle member 344 of the handle subassembly is similar in some respects to the arc-shaped handle portion 52 described hereinbefore. However, it can also be seen that the handle member 344 differs in various respects from the handle portion 52. Initially, as shown in the side view of FIG. 62B, the handle member 344 includes a first grip portion 348 and a second grip portion 350 for accommodating the hand of a user of the rifle bow. The front side of the first grip portion 348 comprises a plurality of notches or grooves 352 for receiving a plurality of fingers of a user's hand, while the front side of the second grip portion 350 comprises a single notch or groove 354 for receiving another one of the fingers of the user's hand. Also, as shown in the side view of FIG. 62B, the back sides of each of the first and second grip portions 348, 350 are generally curved without the inclusion of indentations. In the end view of FIG. 62A, it can be seen that the handle member 344 comprises a circular aperture 346 for receiving the handle tubular member 332 such that the handle member 344 is capable of being structurally engaged with the handle tubular member 332 in the manner shown in FIGS. 65A and 65C.

Figure 21A:
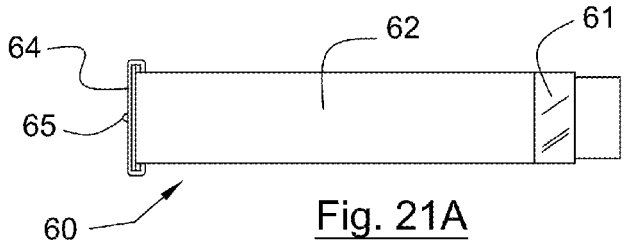
FIG. 21A is a side view of a projectile magazine of the rifle bow assembly of FIG. 1B.
Figure 21B:
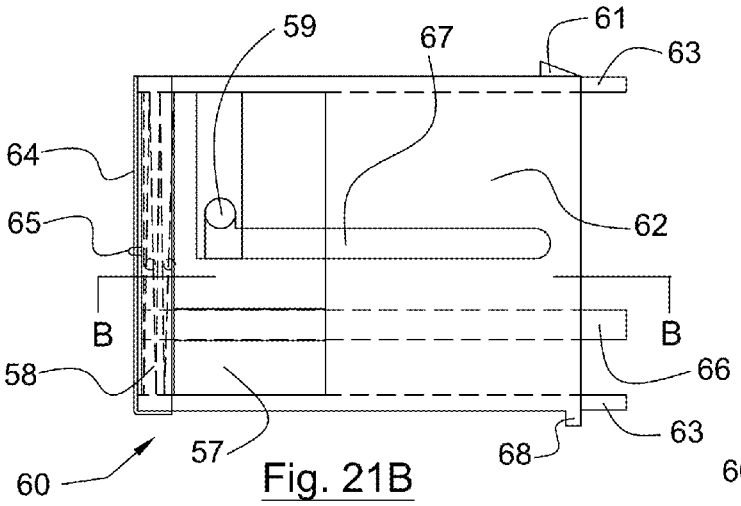
FIG. 21B is a top view of the projectile magazine of the rifle bow assembly of FIG. 1B.
Figure 21C:
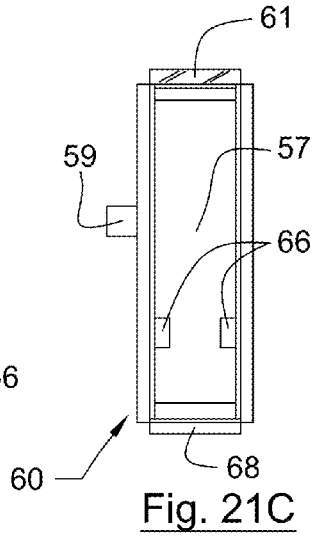
FIG. 21C is an end view of the projectile magazine of the rifle bow assembly of FIG. 1B.
Figure 21D:
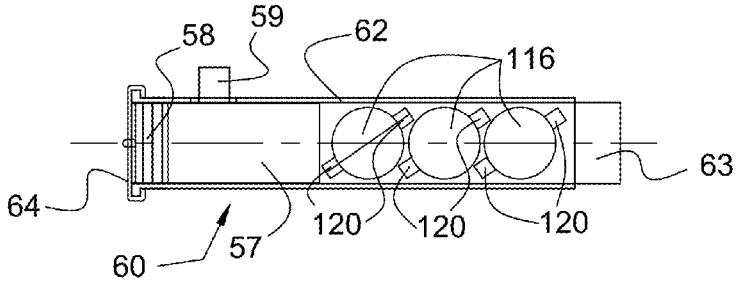
FIG. 21D is a longitudinal sectional view of the projectile magazine of the rifle bow assembly of FIG. 1B, wherein the section is cut along the cutting-plane line B-B in FIG. 21B.
Figure 22:
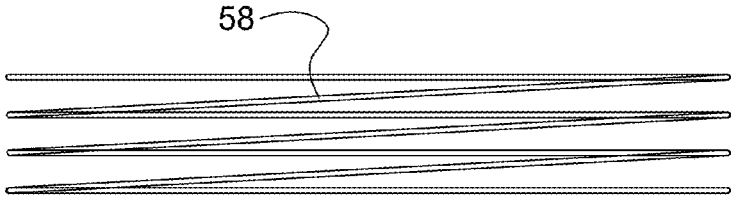
FIG. 22 is a top view of a spring of the projectile magazine of FIGS. 21A-21D.
Figure 23:
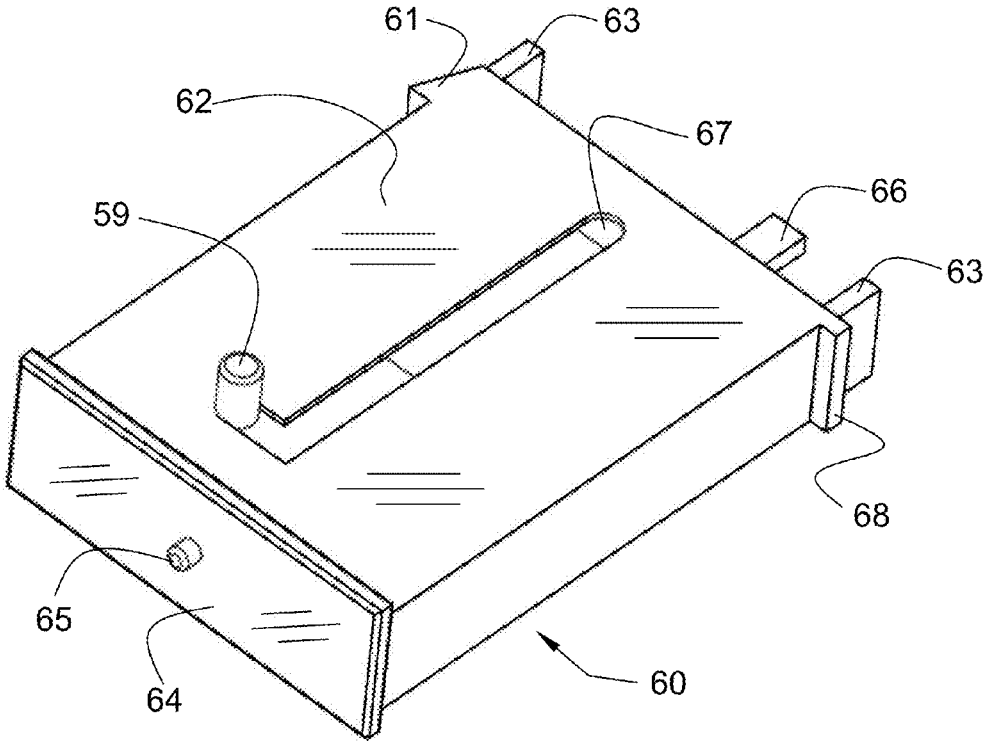
FIG. 23 is a perspective view of the projectile magazine of FIGS. 21A-21D.
Figure 24A:
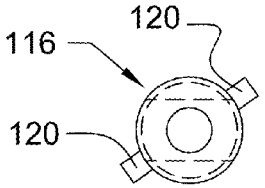
FIG. 24A is a rear end view of a projectile shell of a projectile illustrated in FIG. 30B.
Figure 24B:
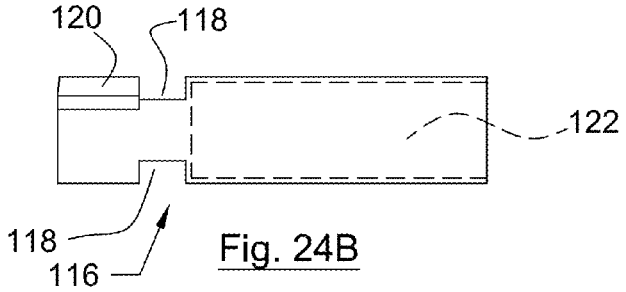
FIG. 24B is a side view of the projectile shell of a projectile illustrated in FIG. 30B.
Figure 24C:
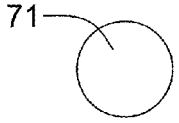
FIG. 24C is a rear end view of a projectile wad of a projectile illustrated in FIG. 30B.
Figure 24D:
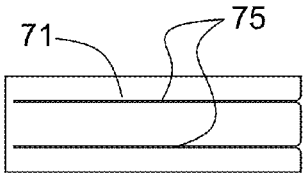
FIG. 24D is a side view of a projectile wad of a projectile illustrated in FIG. 30B.
Figure 25A:
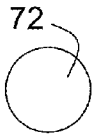
FIG. 25A is a rear end view of a projectile illustrated in FIG. 30B.
Figure 25B:
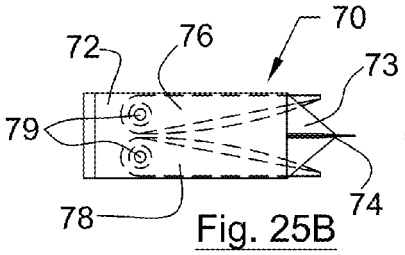
FIG. 25B is a side view of the projectile illustrated in FIG. 30B, wherein the side blades of the projectile are disposed in a retracted position.
Figure 25C:
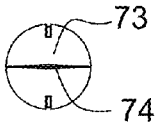
FIG. 25C is a front end view of the projectile illustrated in FIG. 30B.
Figure 25D:
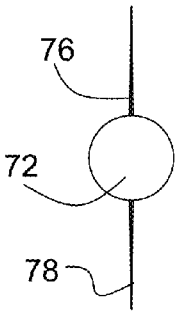
FIG. 25D is a rear end view of a projectile illustrated in FIG. 30B, wherein the side blades of the projectile are disposed in an extended position.
Figure 25E:
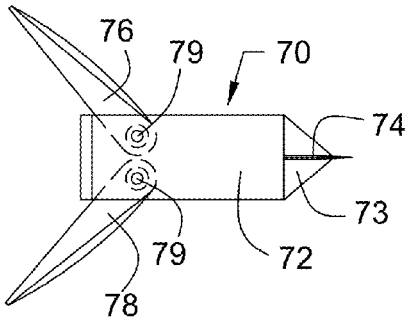
FIG. 25E is a side view of the projectile illustrated in FIG. 30B, wherein the side blades of the projectile are disposed in an extended position.
Figure 25F:
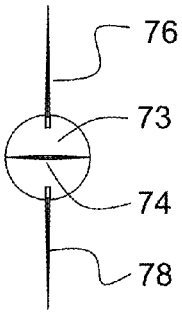
FIG. 25F is a front end view of the projectile illustrated in FIG. 30B, wherein the side blades of the projectile are disposed in an extended position.

Next, the projectile magazine 60 of the rifle bow assembly will be explained with reference to FIGS. 21A-21D, 22, and 23. As best shown in FIGS. 21A and 23, the projectile magazine 60 generally comprises a body portion 62 and an end cover portion 64. The body portion 62 and the end cover portion 64 of the projectile magazine 60 together house a plurality of projectiles (e.g., a plurality of projectiles 70, as illustrated in FIGS. 21D and 30B). In FIGS. 21B and 23, it can be seen that a first attachment projection (i.e., inclined protrusion 61) and a second attachment projection (i.e., projection tab 68) are arranged on opposed sides of the open end of the body portion 62 of the projectile magazine 60. As mentioned above, the projection tab 68 of the projectile magazine 60 engages with the rear stepped portion 88 of the magazine mounting plate 80, while the inclined protrusion 61 engages with the sliding latch portion 260 of the magazine latching subassembly 254, thereby removably securing the projectile magazine 60 to the side of the magazine subassembly 40. In FIG. 30B, the directional arrow 87 diagrammatically illustrates the direction of attachment of the projectile magazine 60 to the magazine subassembly 40. When a user wishes to disengage the projectile magazine 60 from the magazine subassembly 40, he or she simply slides the sliding latch portion 260 of the magazine latching subassembly 254 (i.e., slides the sliding latch portion 260 of the magazine latching subassembly 254 in a forward direction), thereby releasing the projectile magazine 60 from engagement with the magazine subassembly 40.

As shown in FIGS. 21B and 23, the open end of the projectile magazine 60 also comprises outwardly directed protrusions 63 for facilitating the alignment of the projectile magazine 60 with the magazine aperture 84 in the magazine mounting plate 80 and the magazine aperture 44 in the magazine subassembly body portion 42 (i.e., the protrusions 63 guide the projectile magazine 60 as it is brought into engagement with the magazine subassembly 40). In addition, as shown in FIGS. 21A and 23, the end cover portion 64 of the projectile magazine 60 is provided with a centrally located projection 65 protruding from the outer surface thereof.

The internal features of the projectile magazine 60 will be described with reference to FIGS. 21B-21D, 22, and 23. Beginning with FIGS. 21B and 21D, it can be seen that the projectile magazine 60 includes a projectile push block 57 slidingly disposed therein. Advantageously, the projectile push block 57 automatically pushes the next projectile 70 into the projectile passageway 32 of the projectile barrel 30 after a projectile 70 is discharged, and the chamber insert member 124 has been moved out of the path of the projectile 70. The projectile push block 57 is spring-biased by a projectile magazine spring 58 (see FIG. 22) so as to effectively push the next projectile 70 into the passageway or chamber 32 of the projectile barrel 30. In other words, by means of the spring 58, the projectile push block 57 drives the ammunition into the chamber 32. In order to load new ammunition into the projectile magazine 60, the projectile push block 57 is provided with a cylindrical finger projection or protrusion 59 that engages with a notched end of the L-shaped projection slot 67 of the projectile magazine 60. That is, in order to load projectiles 70 (e.g., three (3) projectiles 70) into the projectile magazine 60, a user slides the projectile push block 57 using the projection 59 towards the end cover portion 64 of the projectile magazine 60, while simultaneously compressing the projectile magazine spring 58, until the cylindrical projection or protrusion 59 reaches the notched end of the L-shaped slot 67. Upon reaching this end of the slot 67, the projectile push block 57 is locked into place by virtue of the engagement of the cylindrical projection 59 with the notched end of the L-shaped slot 67 (i.e., FIG. 21B for the locked position of the projectile push block 57). Once the projectiles 70 have been loaded into the projectile magazine 60, and the projectile magazine 60 is reengaged with the magazine subassembly 40, the cylindrical projection or protrusion 59 is moved back into the main linear part of the L-shaped slot 67 by the user so that the projectile magazine spring 58 may apply a pushing spring force to the projectile push block 57, thereby enabling the automatic loading of the projectiles 70 into projectile passageway 32 of the projectile barrel 30. Turning again to FIGS. 21B, 21C, and 23, it can be seen that projectile alignment rails 66 are provided on the top and bottom interior surfaces of the projectile body portion 62 in order to maintain the proper alignment of the projectiles 70 inside the projectile magazine 60 (e.g., the projectile alignment rails 66 engage the opposed notches 118 of each projectile shell 116 in order to maintain an approximately 35 degree angle between each opposed protrusion 120 of the projectile shell 116 and the top or bottom interior surface of the projectile body portion 62).

Now, with reference to FIGS. 64A-64D, an alternative embodiment of the projectile magazine 60' of the rifle bow assembly will be explained. As shown in these figures, the projectile magazine 60' of the alternative embodiment is similar in most respects to the projectile magazine 60 described above. However, unlike the projectile magazine 60, the interior chamber of the projectile magazine 60' of FIGS. 64A-64D comprises opposed projectile grooves 364 for accommodating the protrusions 360 of the projectile shells 356 that are received within the interior chamber of the projectile magazine 60' (see FIGS. 64B-64D). The grooves 364 in the interior chamber of the projectile magazine 60' enables it to accommodate the alternative design of the projectile shell 356 that is utilized with the rifled projectile barrel subassembly of FIGS. 57A-57D. Referring to FIGS. 65A-65C, it can be seen that the projectile magazine 60' is removably secured to the combination magazine subassembly and string release subassembly by means of magazine latching subassembly 254.

An exemplary projectile 70 utilized in conjunction with the rifle bow assembly is illustrated in FIGS. 25A-25F and 26-28. Referring initially to FIGS. 25A-25F, it can be seen that the projectile 70 has a generally cylindrically-shaped body portion 72 with a conical front portion 73. The conical front portion 73 of the projectile 70 includes a transversely extending blade 74 centrally disposed through the apex of the conical front portion 73. As best shown in the perspective view of FIG. 28, the transversely extending blade 74 has a sharp edge for effectively piercing a target (e.g., an animal being pursued by the bow hunter). With particular reference to FIGS. 25B, 25D-25F, and 28, it can be seen that the body portion 72 of the projectile 70 includes two oppositely disposed wings or blades 76, 78 on its circular side wall. Each of the oppositely disposed wings or blades 76, 78 on the projectile 70 are pivotal about a pin or rod 79 disposed in the projectile body portion 72. Each of the blades 76, 78 is designed to be stowed in a retracted position in respective side blade slots 77 of the projectile body portion 72 (see FIG. 28) until the projectile 70 strikes an object or target (e.g., the animal being pursued by the bow hunter). Upon striking the object, the blades 76, 78 rotate in respective counter-clockwise and clockwise directions about respective pins 79 until the blades are in a fully-extended position (i.e., the fully-extended positions of FIGS. 25E and 28). The fully-extended position of the blades 76, 78 allows the projectile 70 to make a larger cut into the struck object (e.g., to make the wound inflicted by the projectile 70 more humane when the struck object is an animal). Advantageously, the projectile 70 is not in the form of a conventional arrow with a broadhead and fletchings mounted on an elongated shaft, which are typically quite expensive. Also, advantageously, the projectile 70 does not comprise any nock, like conventional arrows.

Referring to FIGS. 24C, 24D, 26, and 27, it can be seen that the projectile 70 is contained within a projectile wad 71. The projectile wad 71 is provided with a plurality of longitudinally-extending slots 75 generally equally spaced apart about the circumference thereof. In turn, with reference to FIGS. 24A, 24B, 26, and 27, the projectile wad 71, with the projectile 70 disposed therein, is received within a central cylindrical cavity 122 of an outer projectile shell 116. As described above, the projectile shell 116 comprises opposed notches 118 that engage the projectile alignment rails 66 of the projectile magazine 60 and opposed protrusions 120 that engage respective grooves 32A, 32B of the helical projectile passageway 32 in the projectile barrel subassembly 30.

Figure 53A:
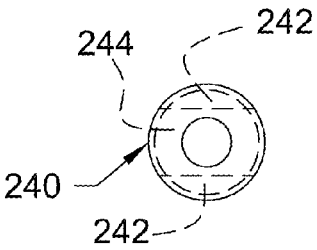
FIG. 53A is a rear end view of a shot shell utilized in conjunction with the rifle bow of FIG. 1A.
Figure 53B:
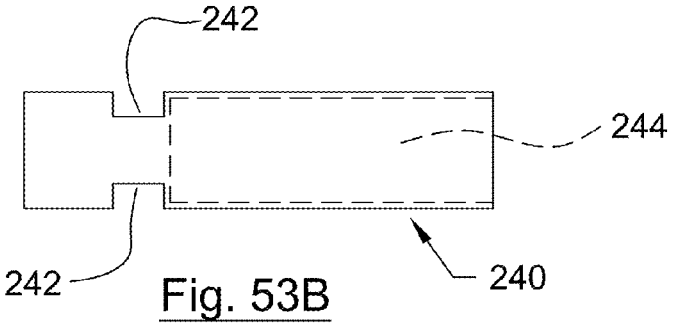
FIG. 53B is a side view of the shot shell of FIG. 53A.
Figure 53C:
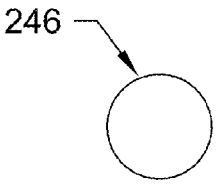
FIG. 53C is a rear end view of a shot wad utilized in conjunction with the rifle bow of FIG. 1A.
Figure 53F:
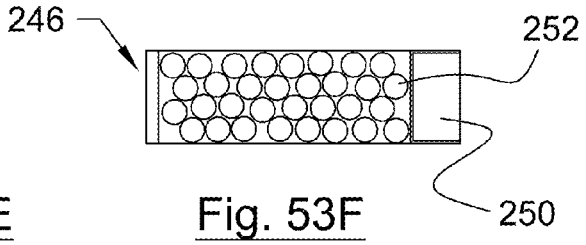
FIG. 53F is a sectional side view of the shot wad of FIG. 53C-53D.
Figure 54:
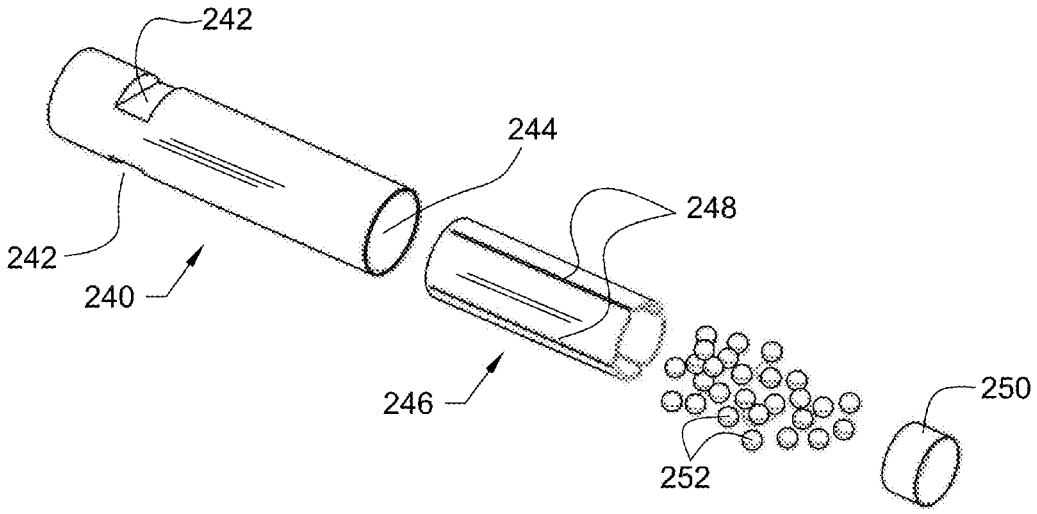
FIG. 54 is an exploded perspective view of the shot shell of FIGS. 53A-53B, the projectile wad of FIGS. 53C-53D, and the shot pellets of FIG. 53F.

In another embodiment of the invention, a projectile in the form of a cylindrically-shaped shot shell 240 is utilized in conjunction with the rifle bow assembly. Referring initially to FIGS. 53A, 53B, and 54, it can be seen that the shot shell 240 comprises a push end with a central shot cavity 244 that receives a shot wad 246 with a plurality of small spherical pellets 252 disposed within the cylindrical wad housing 246. In FIG. 53F, it can be seen that the front end of the shot wad 246 is provided with a front end cap 250 to contain the spherical pellets 252 within the shot wad 246 (e.g., the front end cap 250 may be formed from paper or a suitable cardboard material). The plurality of small pellets 252 is configured to be expelled from the shot shell 240 when the shot shell 240 reaches the first end 30A of the projectile barrel subassembly 30. In one embodiment, the small spherical pellets 252 contained in the shot shell 240 are formed from plastic, and are specially designed for use in the rifle bow. The projectile in the form of a cylindrically-shaped shot shell 240 is particularly suitable for use in small game hunting (e.g., ducks, etc.).

Figure 53D:
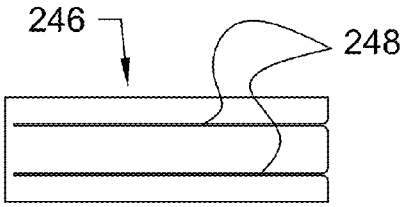
FIG. 53D is a side view of the shot wad of FIG. 53C.
Figure 53E:
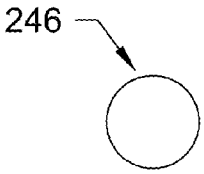
FIG. 53E is another rear end view of the shot wad of FIGS. 53C-53D.

With reference to FIGS. 53D and 54, it can be seen that, like the projectile wad 71 described above, the shot wad 246 is provided with a plurality of longitudinally-extending slots 248 generally equally spaced apart about the circumference thereof. Also, similar to that described above with regard to the projectile shell 116, the shot shell 240 comprises opposed notches 242 that engage the projectile alignment rails 66 of the projectile magazine 60 (refer to FIGS. 53A, 53B, and 54). Although, unlike the projectile shell 116, the shot shell 240 does not contain any opposed protrusions 120 (i.e., rifle wings).

When the alternative rifled projectile barrel subassembly of FIGS. 57A-57D is used in conjunction with the rifle bow assembly, a modified version of the projectile shell is employed. In particular, referring to FIGS. 63A-63E, an alternative embodiment of the projectile shell 356 will be described. Like the projectile shell 116 described above, the projectile shell 356 of the alternative embodiment comprises opposed notches 358 that engage the projectile alignment rails 66 of the projectile magazine 60, 60' and a central cylindrical cavity 362 for receiving a projectile 70 therein. Although, rather than being provided with the two (2) opposed protrusions 120, the projectile shell 356 of the alternative embodiment has a plurality of circumferentially spaced-apart protrusions 360 (e.g., six (6) equally spaced-apart protrusions 360) that engage respective grooves 280 of the helical projectile passageway of the projectile barrel subassembly (refer to FIGS. 63B, 63C, 63E and 57B, 57D).

Figure 47:
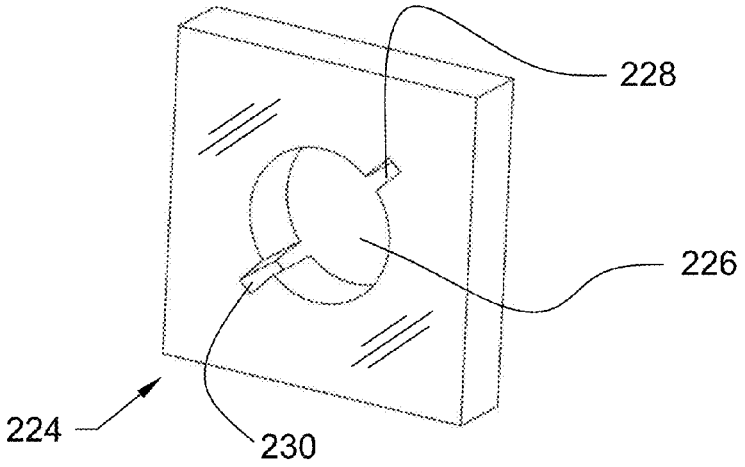
FIG. 47 is a perspective view of a projectile barrel restrictor insert of the rifle bow assembly of FIG. 1B.
Figure 48A:
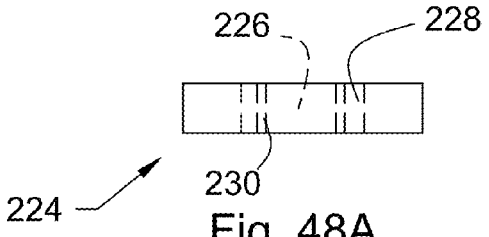
FIG. 48A is a top view of the projectile barrel restrictor insert of FIG. 47.
Figure 48B:
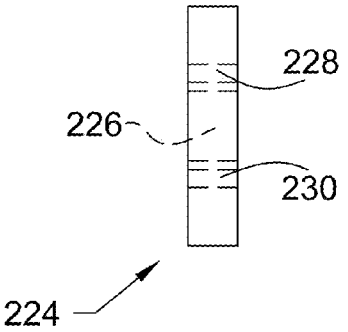
FIG. 48B is a side view of the projectile barrel restrictor insert of FIG. 47.
Figure 48C:
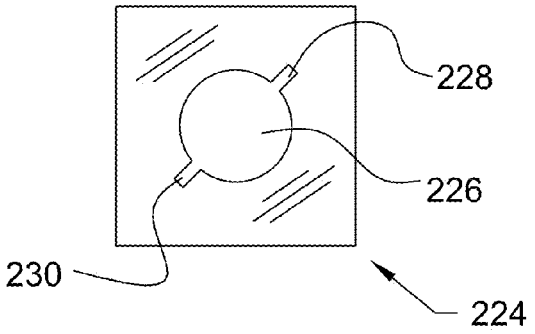
FIG. 48C is a front view of the projectile barrel restrictor insert of FIG. 47.

Now, referring to FIGS. 47-48C, the features of the illustrated projectile restrictor insert 224 of the rifle bow 100 will be explained. The projectile restrictor insert 224 abuts the first end 30A (i.e., front end) of the projectile barrel 30, and is sandwiched between the first end 30A of the projectile barrel 30 and the rear surface of the projectile barrel end cap 210, which will be described hereinafter. The projectile restrictor insert 224 frictionally engages, and thus, slows down the projectile shell 116 and the shot shell 240 when they reach the first end 30A of the projectile barrel 30 so that the projectile 70 and the shot pellets 252, which are respectively contained therein, are easily separated therefrom and directed at a high speed towards the intended object or target. After the projectile 70 or the shot pellets 252 are discharged from their respective projectile shell 116 or the shot shell 240, the empty projectile shell 116 or the shot shell 240 merely drops on the ground in relatively close proximity to the rifle bow 100. As shown in FIGS. 47 and 48A-48C, the projectile restrictor insert 224 includes a central circular projectile aperture 226, which is generally aligned with the circular projectile passageway 32 of the projectile barrel subassembly 30. The projectile restrictor insert 224 further includes two notches 228, 230, which are oppositely disposed with respect to one another (e.g., see FIGS. 47 and 48C), and which generally correspond to the two grooves 32A, 32B of the helical projectile passageway 32. Like the two grooves 32A, 32B of the helical projectile passageway 32, each of the two notches 228, 230 of the projectile restrictor insert 224 are configured to receive a respective protrusion 120 of a projectile shell 116 (e.g., see FIGS. 24A and 26).

Figure 45:
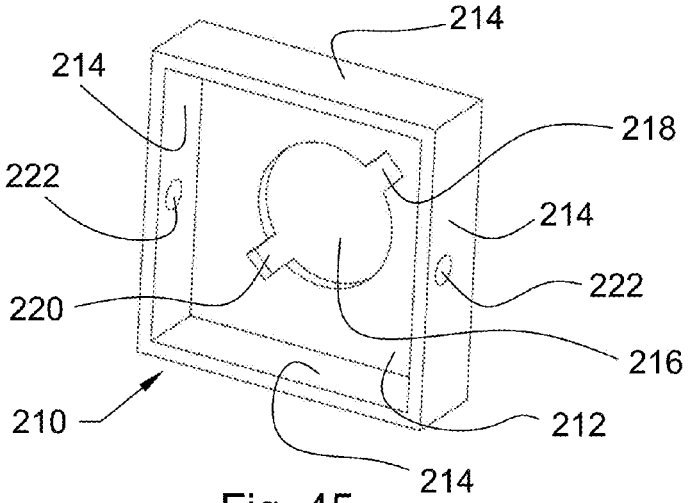
FIG. 45 is a perspective view of a projectile barrel end cap of the rifle bow assembly of FIG. 1B.
Figure 46A:
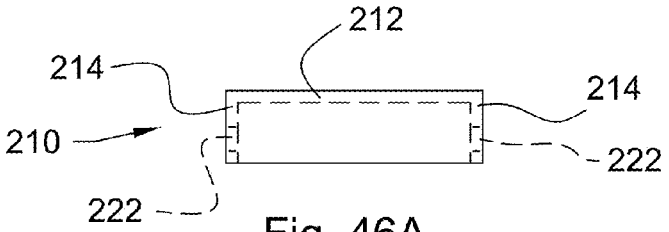
FIG. 46A is a top view of the projectile barrel end cap of FIG. 45.
Figure 46B:
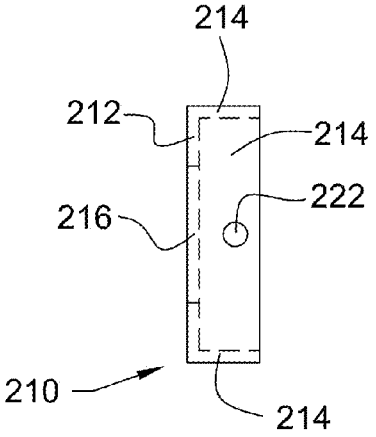
FIG. 46B is a side view of the projectile barrel end cap of FIG. 45.
Figure 46C:
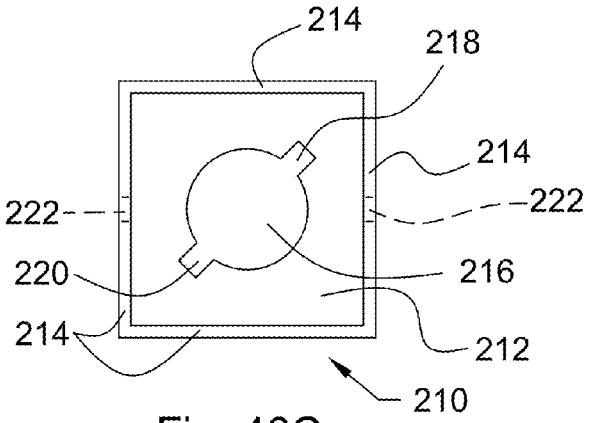
FIG. 46C is a rear view of the projectile barrel end cap of FIG. 45.

Next, with reference to FIGS. 45-46C, the features of the illustrated projectile barrel end cap 210 of the rifle bow 100 will be explained. As best shown in the perspective views of FIGS. 1A and 1B, the projectile barrel end cap 210 attaches to, and covers the first end 30A (i.e., front end) of the projectile barrel 30. The projectile barrel end cap 210 also covers the projectile restrictor insert 224, and as explained above, sandwiches the projectile restrictor insert 224 between its rear surface and the first end 30A of the projectile barrel 30. As depicted in FIGS. 45 and 46A-46C, the projectile barrel end cap 210 generally comprises a front plate member 212 and a plurality of side plate members 214 (i.e., four (4) side plate members 214) that circumscribe the front plate member 212. In FIGS. 45 and 46A, it can be seen that a pair of opposed side plate members 214 includes circular fastener apertures 222 disposed therethrough for receiving fasteners (e.g., screws) for securing the projectile barrel end cap 210 to the first end 30A (i.e., front end) of the projectile barrel 30. As shown in FIGS. 45 and 46C, the front plate member 212 of the projectile barrel end cap 210 includes a central circular projectile aperture 216, which is generally aligned with the central circular projectile aperture 226 of the projectile restrictor insert 224 and the circular projectile passageway 32 of the projectile barrel subassembly 30. The front plate member 212 of the projectile barrel end cap 210 further includes two notches 218, 220, which are oppositely disposed with respect to one another (e.g., see FIGS. 45 and 46C), and which generally correspond to the two notches 228, 230 of the projectile restrictor insert 224 and the two grooves 32A, 32B of the helical projectile passageway 32. Like the two notches 228, 230 of the projectile restrictor insert 224 and the two grooves 32A, 32B of the helical projectile passageway 32, each of the two notches 218, 220 of the projectile barrel end cap 210 are configured to receive a respective protrusion 120 of a projectile shell 116 (e.g., see FIGS. 24A and 26). As shown in FIGS. 45 and 46A-46C, the projectile barrel end cap 210 has a generally square shape that corresponds to the generally square cross-sectional shape of the projectile barrel 30.

Figure 51:
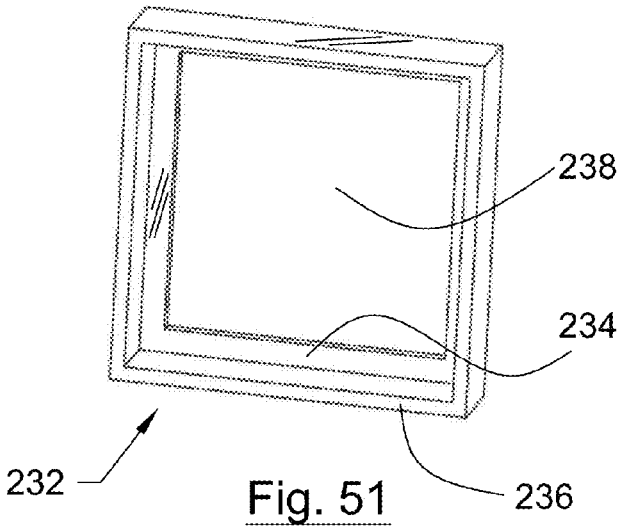
FIG. 51 is a perspective view of a cushion member of the outer barrel slide assembly illustrated in FIG. 1A.
Figure 52A:
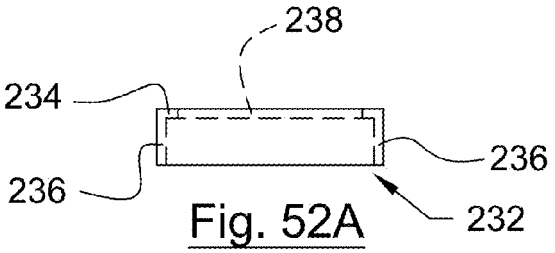
FIG. 52A is a top view of the cushion member of FIG. 51.
Figure 52B:
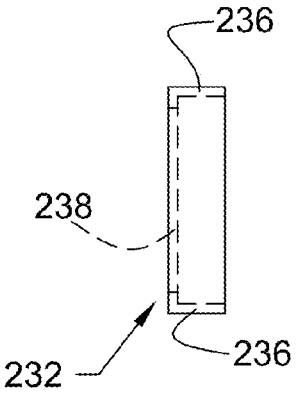
FIG. 52B is a side view of the cushion member of FIG. 51.
Figure 52C:
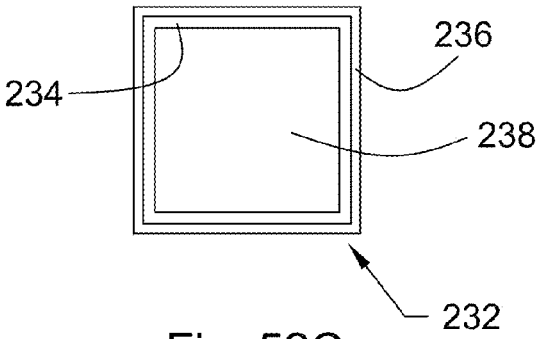
FIG. 52C is a front view of the cushion member of FIG. 51.

Referring to FIGS. 51 and 52A-52C, the features of the illustrated cushion member 232 of the outer barrel slide subassembly 20 of the rifle bow 100 will be described. As best shown in the perspective views of FIGS. 1A and 1B, the annular cushion member 232 attaches to, and covers the rear end of the outer barrel slide subassembly 20 so as to the cushion the engagement between the outer barrel slide subassembly 20 and projectile barrel 30 received therein, and so as to prevent these two components 20, 30 from banging against one another while the rifle bow 100 is being used. As shown in FIGS. 51 and 52A-52C, the cushion member 232 comprises a rear annular portion 234 with a central, generally square barrel aperture 238 for accommodating the generally square cross-section of the projectile barrel 30 passing therethrough. As best shown in FIGS. 51 and 52C, the cushion member 232 additionally comprises a flange portion 236 that circumscribes, and fits over the rear end of the outer barrel slide subassembly 20. In one exemplary embodiment, the cushion member 232 is formed from a flexible material, such as a suitable rubber, that is capable of acting as a cushion between the outer barrel slide subassembly 20 and projectile barrel 30, which in this exemplary embodiment are formed from a suitable metal. In this exemplary embodiment, a majority of the constituent components of the rifle bow assembly are formed from a suitable metal to ensure the durability and strength of these components.

Now, an exemplary manner in which the rifle bow assembly is installed on a bow assembly will be described in detail. Initially, with reference to FIGS. 1A, 1B, 2, and 29, the outer barrel slide subassembly 20 is attached to the central portion of the bow assembly 10 by installing a flat-head bolt or screw in the countersink fastener aperture 26 of the outer barrel slide subassembly 20, and then, into the pre-threaded hole of the bow assembly 10, which is normally used for the arrow rest installation. Preferably, the flat-head bolt or screw is further secured in place with an adhesive, and its head is made substantially flush with the inside surface of the outer barrel slide subassembly 20. Then, in the direction indicated by the directional arrow 85 in FIG. 29, the rifled projectile barrel subassembly 30 is inserted into the elongate cavity 21 of the outer barrel slide subassembly 20 by inserting the slotted end (i.e., with the elongate slot 34) and the magazine aperture 38 into the front end of the outer barrel slide subassembly 20. As the rifled projectile barrel subassembly 30 is inserted into the elongate cavity 21 of the outer barrel slide subassembly 20, the bow string 91 is inserted into the bow string elongate slot 34. If a user is looking from the front of the rifle bow, the magazine aperture 38 is on the right-hand side if the user is right-handed, or it is on the left-hand side if the user is left-handed. Then, the user slips the magazine subassembly body portion 42, which is assembled together with the handle subassembly 50, the release/trigger subassembly, and the safety subassembly 196, over the rear end portion of the projectile barrel subassembly 30 until the beveled end 114 of the locking mechanism 90 clicks into place in notch 39 of the projectile barrel subassembly 30. Then, the assembled components 30, 50, 136, 146, 168, 180, 196 are pushed forward until the bow string 91 is engaged in the pair of pivotable string release members 136, and the safety 196 is engaged. Next, the first projectile 70 is installed into the aperture 38, 44 for the projectile magazine 60. In this step, the user must make sure that the first round is properly positioned into the barrel chamber 32. Then, the projectile magazine 60 (e.g., a three-round projectile clip) is installed on the magazine subassembly 40 by engaging the projection tab 68 of the projectile magazine 60 with the rear stepped portion 88 of the magazine mounting plate 80, and engaging the inclined protrusion 61 of the projectile magazine 60 with the sliding latch portion 260 of the magazine latching subassembly 254. By using his or her hand, a user pushes the inclined protrusion 61 of the projectile magazine 60 into engagement with the sliding latch portion 260 of the magazine latching subassembly 254 until it clicks. This ensures that the projectiles 70 are correctly installed and ready to shoot.

Next, the manner in which the projectiles 70 are released from the rifle bow 100 will be explained. First, similar to a conventional bow, a user pulls back on the handle portion 52 of the handle subassembly 50. Then, he or she releases the safety mechanism 196. After which, the bow sites are lined up on the target. The user then pulls the trigger mechanism 180 in a rearward direction, and the projectile 70 is propelled down the helical projectile passageway 32 by the elasticity of the bow string 91, and is discharged from the rifle bow 100. After firing the shot, the components 30, 50, 136, 146, 168, 180, 196 are pushed forward until the bow string 91 is engaged again in the pair of pivotable string release members 136 of the release/trigger subassembly. The safety mechanism 196 is also engaged as needed. The spring-loaded projectile push block 57 of the projectile magazine 60 automatically loads the next projectile 70 in the barrel chamber 32. This ensures that the next projectile 70 is correctly positioned and ready to shoot. After the fourth shot is fired, the projectile magazine 60 must be removed and reloaded as needed.

Finally, the manner in which the rifle bow assembly is disarmed and unloaded will be described. First, the safety mechanism 196 of the rifle bow 100 is engaged. Then, the projectile magazine 60 is removed. After which, the last projectile 70 is removed from the rifled projectile barrel subassembly 30 by simply tilting the assembly so that it falls into the user's hand. Preferably, during the unloading of the sharp projectiles 70 from the rifle bow, protective gloves (e.g., leather gloves) are worn by the user to protect his or her hands from cuts and abrasions resulting from the sharp blades 74, 76, 78 on the projectiles 70.

It is readily apparent that the aforedescribed rifle bow assembly, and the rifle bow in which it is used, offers numerous advantages. First, the rifle bow assembly and rifle bow is capable of significantly reducing the cost associated with bow hunting by utilizing projectiles that are much less expensive than conventional arrows and broadheads. Secondly, the rifle bow assembly accommodates a magazine of projectiles, thereby enabling a plurality of projectiles to be quickly shot from the bow assembly in succession. Finally, rifle bow assembly described herein can be easily incorporated into almost any conventional compound design as a retrofit assembly, or can be easily incorporated into a crossbow design.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A rifle bow assembly comprising, in combination:

an outer barrel slide subassembly having an elongate cavity disposed therethrough, said outer barrel slide subassembly configured to be affixedly attached to a bow assembly such that said outer barrel slide subassembly remains stationary relative to said bow assembly;

a projectile barrel subassembly having a first end and a second end, said projectile barrel subassembly configured to be slidingly received within said elongate cavity of said outer barrel slide subassembly, and said projectile barrel subassembly having a rifled projectile passageway extending in a lengthwise direction thereof;

a magazine subassembly coupled to said second end of said projectile barrel subassembly, said magazine subassembly having attachment means for securing a projectile magazine thereto; and a release subassembly coupled to an end portion of said magazine subassembly, said release subassembly including at least one string release mechanism for releasably engaging a bow string of said bow assembly;

wherein said magazine subassembly and said release subassembly are mounted to a common body portion, said common body portion of said magazine subassembly and said release subassembly including opposed raised portions disposed on opposite sides thereof, each of said opposed raised portions of said common body portion comprising a central cavity disposed therein for receiving one or more components of said release subassembly, said common body portion of said magazine subassembly and said release subassembly further including a fastener access notch or aperture disposed in a first side thereof, said common body portion additionally including an elongate groove disposed in a second side thereof for receiving a portion of a magazine latching subassembly, said second side of said common body portion being disposed opposite to said first side, and said fastener access notch or aperture in said first side enabling a tool to gain access to a fastener securing said magazine latching subassembly within said elongate groove on said second side.

2. The rifle bow assembly according to claim 1, wherein said projectile barrel subassembly comprises an elongate slot disposed along a length thereof, said elongate slot configured to receive said bow string therein, and said elongate slot of said projectile barrel subassembly only extending along a portion of the length of said projectile barrel subassembly.

3. The rifle bow assembly according to claim 1, wherein said projectile barrel subassembly is formed by a pair of barrel half portions, each of said barrel half portions including approximately a half section of said rifled projectile passageway.

4. The rifle bow assembly according to claim 3, wherein at least one of said barrel half portions of said projectile barrel subassembly includes a plurality of alignment pins that are configured to matingly engage said at least one of said barrel half portions with the other of said barrel half portions.

5. The rifle bow assembly according to claim 1, wherein said rifled projectile passageway of said projectile barrel subassembly comprises a plurality of circumferentially spaced-apart grooves in a bounding sidewall thereof, each of said plurality of circumferentially spaced-apart grooves configured to receive a respective protrusion of a projectile shell.

6. The rifle bow assembly according to claim 5, wherein said plurality of circumferentially spaced-apart grooves in said bounding sidewall of said rifled projectile passageway of said projectile barrel subassembly comprises three or more circumferentially spaced-apart grooves that are generally equally spaced-apart from one another.

7. The rifle bow assembly according to claim 1, wherein said release subassembly further comprises a pair of cover plates, each of said pair of cover plates configured to be coupled to a respective one of said opposed raised portions of said common body portion, and each of said pair of cover plates configured to enclose said one or more components of said release subassembly that are disposed within said central cavity of said opposed raised portion.

8. The rifle bow assembly according to claim 1, wherein said common body portion of said magazine subassembly and said release subassembly further includes at least one elongate slot disposed along a length thereof, said at least one elongate slot of said common body portion configured to receive said bow string therein, and said at least one elongate slot of said common body portion generally aligned with a respective elongate slot of said projectile barrel subassembly.

9. The rifle bow assembly according to claim 1, further comprising a handle subassembly coupled to an end portion of said common body portion of said magazine subassembly and said release subassembly.

10. The rifle bow assembly according to claim 9, wherein said handle subassembly includes a tubular member, a handle member affixedly coupled to said tubular member, and an end cap removably coupled to said tubular member, said tubular member having a first end and a second end, said first end of said tubular member being affixed to said end portion of said common body portion, and said second end of said tubular member being removably coupled with said end cap.

11. The rifle bow assembly according to claim 10, wherein said tubular member further comprises a central passageway disposed therein for receiving a retractable chamber insert member that is configured to be slidingly received within a portion of said rifled projectile passageway of said projectile barrel subassembly.

12. The rifle bow assembly according to claim 1, wherein said release subassembly comprises a trigger mechanism configured to disengage said at least one string release mechanism from said bow string of said bow assembly so as to discharge a projectile from said first end of said projectile barrel subassembly.

13. A rifle bow comprising, in combination:

a bow assembly, said bow assembly comprising a central portion, an upper limb extending upwardly from said central portion, a lower limb extending downwardly from said central portion, and a bow string extending between an upper end portion of said upper limb and a lower end portion of said lower limb;

a rifle bow assembly coupled to said bow assembly, said rifle bow assembly including:

an outer barrel slide subassembly having an elongate cavity disposed therethrough, said outer barrel slide subassembly being affixedly attached to said central portion of said bow assembly such that said outer barrel slide subassembly remains stationary relative to said central portion of said bow assembly;

a projectile barrel subassembly having a first end and a second end, said projectile barrel subassembly slidingly received within said elongate cavity of said outer barrel slide subassembly, and said projectile barrel subassembly having a rifled projectile passageway extending in a lengthwise direction thereof;

a magazine subassembly coupled to said second end of said projectile barrel subassembly, said magazine subassembly having attachment means for securing a projectile magazine thereto;

a release subassembly coupled to an end portion of said magazine subassembly, said release subassembly including at least one string release mechanism for releasably engaging said bow string of said bow assembly; and a retractable chamber insert member configured to be slidingly received within a portion of said rifled projectile passageway of said projectile barrel subassembly, said retractable chamber insert member configured to prevent a projectile of said projectile magazine from entering into said rifled projectile passageway before said bow string is in a fire-ready position;

wherein said projectile barrel subassembly is configured to retract with said bow string when said bow string is pulled back by a user, and wherein said outer barrel slide subassembly and said projectile barrel subassembly are configured to remain stationary when a projectile travels through said rifled projectile passageway of said projectile barrel subassembly, and is discharged from said rifle bow.

14. The rifle bow according to claim 13, wherein said rifle bow assembly further comprises a handle subassembly coupled to an end portion of said magazine subassembly, said handle subassembly including a central passageway disposed therein for receiving a portion of said retractable chamber insert member.

15. A rifle bow comprising, in combination:

a bow assembly, said bow assembly comprising a central portion, an upper limb extending upwardly from said central portion, a lower limb extending downwardly from said central portion, and a bow string extending between an upper end portion of said upper limb and a lower end portion of said lower limb;

a rifle bow assembly coupled to said bow assembly, said rifle bow assembly including:

an outer barrel slide subassembly having an elongate cavity disposed therethrough, said outer barrel slide subassembly being affixedly attached to said central portion of said bow assembly such that said outer barrel slide subassembly remains stationary relative to said central portion of said bow assembly;

a projectile barrel subassembly having a first end and a second end, said projectile barrel subassembly slidingly received within said elongate cavity of said outer barrel slide subassembly, and said projectile barrel subassembly having a rifled projectile passageway extending in a lengthwise direction thereof;

a magazine subassembly coupled to said second end of said projectile barrel subassembly, said magazine subassembly having attachment means for securing a projectile magazine thereto;

a release subassembly coupled to an end portion of said magazine subassembly, said release subassembly including at least one string release mechanism for releasably engaging said bow string of said bow assembly;

a projectile magazine coupled to said magazine subassembly by said attachment means, said projectile magazine having a plurality of projectiles disposed therein; and a retractable chamber insert member configured to be slidingly received within a portion of said rifled projectile passageway of said projectile barrel subassembly, said retractable chamber insert member configured to prevent a next successive one of said plurality of projectiles of said projectile magazine from entering into said rifled projectile passageway before said bow string is in a fire-ready position;

wherein said projectile barrel subassembly is configured to retract with said bow string when said bow string is pulled back by a user, and wherein said outer barrel slide subassembly and said projectile barrel subassembly are configured to remain stationary when said projectile travels through said rifled projectile passageway of said projectile barrel subassembly, and is discharged from said rifle bow.

16. The rifle bow according to claim 15, wherein one or more of said plurality of projectiles comprises a projectile shell, said projectile shell including at least one notch configured to engage with an alignment rail of said projectile magazine, and said projectile shell further including at least one protrusion configured to engage with a groove in a bounding sidewall of said rifled projectile passageway of said projectile barrel subassembly.

17. The rifle bow according to claim 16, wherein said at least one protrusion of said projectile shell comprises a plurality of protrusions spaced apart about a circumference of said projectile shell, each of said plurality of protrusions configured to engage with a respective said groove in said bounding sidewall of said rifled projectile passageway of said projectile barrel subassembly.

18. The rifle bow according to claim 15, wherein each of said plurality of projectiles is not in the form of an arrow, and does not comprise a nock.

19. The rifle bow according to claim 15, wherein said magazine subassembly and said release subassembly are mounted to a common body portion, said common body portion of said magazine subassembly and said release subassembly being removably engaged with said projectile barrel subassembly by means of a locking mechanism.

20. The rifle bow according to claim 15, wherein said rifle bow assembly further comprises a handle subassembly coupled to an end portion of said magazine subassembly, said handle subassembly including a central passageway disposed therein for receiving a portion of said retractable chamber insert member.

* * * * *